US005787910A

United States Patent [19]

Oda et al.

[11] Patent Number: 5,787,910

[45] Date of Patent: Aug. 4, 1998

[54] WASHING APPARATUS

[75] Inventors: Masao Oda; Michio Fujiwara; Tomoyuki Kanda; Hideho Taguchi; Yasunori Kurahashi; Takao Morisaki; Takasuke Umemoto; Takayuki Inoue; Fusako Tanaka, all of Tokyo, Japan

[73] Assignee: Mitsubishi Denki Kabushiki Kaisha, Tokyo, Japan

[21] Appl. No.: 652,923

[22] Filed: May 24, 1996

[30] Foreign Application Priority Data

May 31, 1995 [JP] Japan ..... 7-133921

[51] Int. Cl.[6] ..... B08B 3/02

[52] U.S. Cl. ..... 134/102.2; 134/103.2; 134/198; 239/224

[58] Field of Search ..... 134/94.1, 95.1, 134/95.2, 98.1, 102.1, 102.2, 102.3, 103.1, 183, 198; 239/214.11, 214.13, 214.17, 214.21, 222, 223, 224

[56] References Cited

U.S. PATENT DOCUMENTS

| | | | |
|---|---|---|---|
| 1,439,823 | 12/1922 | Kaufman | 134/94.1 |
| 1,521,989 | 1/1925 | Bergstrom | 134/102.1 |
| 1,861,475 | 6/1932 | Hopkins et al. . | |
| 2,051,441 | 8/1936 | Ellis | 134/94.1 |
| 2,135,043 | 11/1938 | Seman | 134/94.1 |
| 2,779,961 | 2/1957 | Laughlin . | |
| 2,873,600 | 2/1959 | Demaret | 134/94.1 |
| 3,079,091 | 2/1963 | Anselmi | 134/183 |
| 3,114,924 | 12/1963 | Morrison . | |
| 3,144,034 | 8/1964 | Lyman et al. | 134/183 |
| 3,176,697 | 4/1965 | Gibson | 134/183 |
| 4,049,197 | 9/1977 | Brouwer . | |
| 4,172,463 | 10/1979 | Woolley et al. | 134/183 |
| 4,540,124 | 9/1985 | Haruch . | |
| 4,682,615 | 7/1987 | Burkman et al. | 134/102.2 |
| 4,768,534 | 9/1988 | Anderson . | |
| 5,522,941 | 6/1996 | Uchinami et al. | 134/102.2 |
| 5,546,968 | 8/1996 | Jeon et al. | 134/183 |
| 5,601,100 | 2/1997 | Kawakami et al. | 134/95.3 |

FOREIGN PATENT DOCUMENTS

| | | | |
|---|---|---|---|
| 0650692 | 5/1995 | European Pat. Off. . | |
| 0688607 | 12/1995 | European Pat. Off. . | |
| 1139327 | 6/1957 | France | 134/94.1 |
| 55-34041 | 8/1980 | Japan . | |
| 61-245858 | 11/1986 | Japan . | |

OTHER PUBLICATIONS

Shiro Matsumoto, A Fundamental Knowledge of Techniques For Making Liquid Particles, Science Technology Journal MOL, 1980, vol. 18, No. 2, pp. 25–31.

*Primary Examiner*—Frankie L. Stinson

[57] ABSTRACT

A washing apparatus is compact as well as easy to handle, with which a user can wash down dirt effectively in a short time. Washing liquid supplied from the washing liquid supplying means is made in the form of high-speed jet liquid by a high-speed jet stream spouting means. The high-speed jet liquid is spouted from the aperture of the first cover to wash down dirt by the impact given by the high-speed jet liquid. A washing object is dewatered by gas spouted from the aperture by a blowing means. The high-speed jet stream spouting means is comprised of a rotating object having a plurality of radial shape flow paths extending from a center portion to a circumference of the rotating object, and a liquid supplying portion for supplying washing liquid to a central portion of the radial shape flow paths. A rotating means rotates the rotating object so that washing liquid supplied in the radial shape flow paths is accelerated in the direction of a circumference as well as a radius of the rotating object by rotation. The accelerated washing liquid is spouted from an aperture in the form of high-speed jet liquid.

29 Claims, 46 Drawing Sheets

WASHING APPARATUS

BACKGROUND OF THE INVENTION

1. Field of the Invention

The invention relates to a washing apparatus for washing for example, tableware, foods or hands and other objects.

2. Description of the Prior Art

FIG. 49 shows a longitudinal cross sectional view of a conventional washing apparatus disclosed in Japanese Utility Model Publication No. 55-34041/80, for example.

The configuration of FIG. 49 comprises a main frame 1 of a washing apparatus, a water absorption valve 2 arranged on the upper portion of the main frame 1, an inner sink 3 arranged inside the main frame 1, a nozzle bearing 4 fixed on the bottom surface of the inner sink 3, a spouting nozzle 5 supported rotatably by the nozzle bearing 4, a tower nozzle 6 fixed in the center of the spouting nozzle 5, a bottom basket 7 arranged just over the spouting nozzle 5, and top basket 9 arranged on the upper potion of the tower nozzle 6. Each bottom and top baskets 7, 9 is supported by the sidewalls of the inner sink 3, and tablewares 8 which are washing objects are put in the baskets.

In the same FIG. 49, a concave portion 10 is arranged on a portion of the bottom surface of the inner sink 3, and a garbage filter 11 is provided therein. A pump 12 has a suction port connected with the concave portion 10 via a suction pipe 13, and a discharge port connected with the nozzle bearing 4 via a discharge pipe 14. A drain pipe 15 is connected with the bottom of the concave portion 10 and drawn outside the main frame 1.

In the conventional tableware washing apparatus constructed in the abovementioned manner, a piece of tableware 8 is stored in the bottom basket 7 and the top basket 9 provided inside the inner sink 3. Afterwards, the water absorption valve 2 is opened, and water supplied to the inner sink 3 from water line and is mingled with detergent, and the pump 12 is driven. This washing liquid sucked by the pump 12 is discharged via the discharge pipe 14, while a portion of the washing liquid is spouted upward from the spouting nozzle 5. The discharged washing liquid rotates by the reaction of jet, and washes the piece of tablewares 8 in the bottom basket 7. In a similar manner, a portion of the washing liquid is spouted upward from the tower nozzle 6 too. The rotating washing liquid washes the piece of tablewares 8 in the top basket 9.

After washing the piece of tablewares 8 in this way, the washing liquid falls inside the inner sink 3 and flows into the concave portion 10. Cleaned by the garbage filter 11, the washing liquid is sucked by the pump 12, and again supplied to the spouting nozzle 5 and the tower nozzle 6 from the discharge pipe 14. The washing operation is repeated in this way by circulating the washing liquid. When the washing operation by detergent is finished, the dirty liquid is drained through the drain pipe 15.

After draining the dirty liquid, the water absorption valve 2 is opened again to supply fresh water. In the same manner as the washing operation, fresh water is spouted from the spouting nozzle 5 and the tower nozzle 6 to rinse tablewares 8. After rinse is finished, water is drained again. Lastly, air is sent from a blower (not illustrated) to dry the piece of tablewares 8.

The conventional washing apparatus as mentioned above has following problems because pieces of tablewares 8 arranged in the baskets 7, 9 are washed by supplying washing liquid supplied by the pump 12 toward them.

(1) First, it takes troubles:

(a) Each piece of tableware 8 should be arranged neatly in the baskets 7, 9 so that each piece of tableware 8 is washed easily;

(b) Since the water stored in the inner sink 3 is used for washing, washing liquid gets too dirty to continue washing, if it washes down dirt heavily stuck on tableware 8. Therefore, the washing apparatus may fails to wash down dirt completely. Accordingly, whenever a user uses a tableware washing apparatus, the user has to take a trouble to rinse tableware beforehand to wash down dirt roughly.

(2) Second, a strong stream is not expected for washing:

Since each piece of tableware 8 is just put in the baskets 7, 9, it may collide against others in the baskets 7, 9 and may even be damaged, if washing liquid is spouted strongly. In other words, an appropriate jet pressure of washing liquid is limited to around $0.5kg/cm^2$, and less than $1kg/cm^2$ even at the maximum level in the conventional washing apparatus. A water stream stronger than this can not be used. Therefore, a powerful detergent dedicated for this washing apparatus is required to enhance washing effect. Furthermore, the stream adjustment is impossible in the conventional washing apparatus.

(3) Third, it takes a lot of time:

As mentioned above in (1), setting a piece of tableware 8 themselves takes time and troubles. Moreover, washing liquid should be heated by a heater to enhance washing effect. Accordingly, the conventional washing apparatus takes time for heating the liquid, in addition to washing tableware, draining the liquid, and rinsing tableware, which requires a large number of processing steps.

(4) Fresh water can not be used for washing:

If fresh water is supplied when washing liquid gets too dirty to continue washing, it lowers the temperature of washing liquid as well as the density of detergent.

(5) The washing apparatus is not used until tablewares are filled therein.

(a) Since the quantity of washing liquid and the washing time are the same regardless of the amount of tablewares 8, the washing apparatus is not used effectively when the number of pieces of tablewares 8 is small.

(b) If tablewares are left until they are filled in the washing apparatus, dirt stuck to the tableware get dried or solid while it has been left unwashed, which makes it too hard to take off.

(6) The apparatus is hardly small sized:

(a) Since the apparatus requires a space for arranging a certain amount of tableware, it is difficult to make the apparatus small size.

(b) The apparatus requires a concave portion having an enough capacity necessary for storing washing liquid as well as a garbage filter having an area wide enough for washing liquid to pass through in the water pump system. These structures are necessarily provided for discharging washing liquid and makes it hard to obtain a small sized washing apparatus.

It is an object of the present invention to obtain a compact washing apparatus with great ease of use, by which a user can wash down dirt completely and effectively in a short time.

SUMMARY OF THE INVENTION

According to one aspect of the invention, a washing apparatus comprises a high-speed jet stream spouting means for spouting washing liquid in the form of high-speed jet liquid toward a washing object; a first cover having at least an aperture through which the high-speed jet liquid passes, and covering the high-speed jet stream spouting means; a blowing means for spouting gas toward the object; a second cover having an aperture through which the gas passes, and covering the blowing means; and washing liquid supplying means for supplying the washing liquid to the high-speed jet stream spouting means.

According to another aspect of the invention, a washing apparatus comprises a high-speed jet stream spouting means comprising a rotating object having a plurality of radial shape flow paths extending from a center portion to a circumference of the rotating object, and a liquid supplying portion for supplying washing liquid to a central portion of the radial shape flow paths, for supplying washing liquid in the form of high-speed jet liquid toward a washing object; a first cover having at least an aperture through which the high-speed jet liquid passes, and covering the high-speed jet stream spouting means; a rotating means for rotating the rotating object; and washing liquid supplying means for supplying the washing liquid to the high-speed jet stream spouting means.

According to further aspect of the invention, a washing apparatus comprises a high-speed jet stream spouting means comprising a rotating object having a plurality of radial shape flow paths extending from a center portion to a circumference of the rotating object, and a liquid supplying portion for supplying washing liquid to a central portion of the radial shape flow paths, for supplying washing liquid in the form of high-speed jet liquid toward a washing object; a first cover having at least an aperture through which the high-speed jet liquid passes, and covering the high-speed jet stream spouting means; a blowing means for spouting gas toward the washing object; a second cover having an aperture through which the gas passes, and covering the blowing means; a rotating means for rotating the rotating object; washing liquid supplying means for supplying the washing liquid to the high-speed jet stream spouting means; a liquid quantity adjusting means for adjusting supplying quantity of the washing liquid; and a gas quantity adjusting means for adjusting a quantity of the supplying gas.

According to further aspect of the invention, a washing apparatus further comprises a jet mist scattering protection means for shutting out scatter of jet mist generated when high-speed jet liquid is spouted to a washing object.

According to further aspect of the invention, a washing apparatus is constructed so that a washing liquid supplying portion supplies washing liquid to a portion of the radial shape flow paths, the supplied washing liquid is accelerated in the portion of the radial shape flow paths by rotation, and the accelerated washing liquid is spouted from an aperture in the form of high-speed jet liquid toward a desired washing space.

According to further aspect of the invention, a washing apparatus is constructed so that the radial shape flow path is inclined forward in the direction of rotation from its central portion to its circumferential portion.

According to further aspect of the invention, a washing apparatus is constructed so that the radial shape flow paths has a larger cross section standing vertically against the flow path in its central portion than in its circumferential portion.

According to further aspect of the invention, a washing apparatus is constructed so that the liquid supplying portion comprises an adjusting means for adjusting the quantity of washing liquid supplied to the radial shape flow paths.

According to further aspect of the invention, a washing apparatus further comprises a supplementary plate provided under the rotating means for receiving washing liquid which fails to be spouted from an aperture of the first cover.

According to further aspect of the invention, a washing apparatus further comprises a branching means arranged at the front portion of the aperture of the first cover in the direction of rotation.

According to further aspect of the invention, a washing apparatus further comprises a second liquid supplying portion for supplying a liquid to a portion of the radial shape flow paths in a central portion of the radial shape flow paths.

According to further aspect of the invention, a washing apparatus is constructed so that a high-speed jet stream spouting means comprises a plurality of rotating objects arranged in parallel in the rotating axis direction, a plurality of liquid supplying portions for supplying washing liquid supplied from the washing liquid supplying means to the radial shape flow paths of the each rotating objects, and a rotating means for rotating the each rotating objects.

According to further aspect of the invention, a washing apparatus is constructed so that a high-speed jet stream spouting means comprises a plurality of rotating objects arranged in parallel in the radius direction of the rotating objects, a plurality of liquid supplying portions for supplying washing liquid supplied from the washing liquid supplying means to the radial shape flow paths of the each rotating objects, and a rotating means for rotating the each rotating objects.

According to further aspect of the invention, a washing apparatus comprises a washing start detecting means for outputting a washing start detecting signal for notifying a start of washing by detecting a washing object placed in a washing space; a washing completion detecting means for outputting a washing completion detecting signal for notifying a completion of washing by detecting washing operation is completed; and a high-speed jet stream supplying control means for driving a high-speed jet stream spouting means by receiving the washing start detecting signal and stopping driving a high-speed jet stream spouting means by receiving the washing completion detecting signal.

According to further aspect of the invention, a washing apparatus is constructed so that a high-speed jet stream spouting means comprises a blowing means; the gas quantity adjusting means adjusts a quantity of gas and supplies the gas to high-speed jet stream spouting means after the washing liquid supplying means stops supplying washing liquid to the high-speed jet stream spouting means.

According to further aspect of the invention, a washing apparatus is constructed so that a jet mist scattering protection means covers a washing space extending from an aperture of the first cover to a washing object.

According to further aspect of the invention, a washing apparatus comprises a dirt protection means for protecting a surface of a jet mist scattering protection means, which faces a washing space, from dirt.

According to further aspect of the invention, a washing apparatus is constructed so that a jet mist scattering protection means comprises a fluid portion covering a washing space extending from an aperture of the first cover to the washing object.

According to further aspect of the invention, a washing apparatus is constructed so that a jet mist scattering protection means covering a washing space extending from an aperture of the first cover to the washing object comprises a fluid portion where the washing object is put in and out to and from the washing space therethrough, and a solid material for the rest of portion.

According to further aspect of the invention, a washing apparatus is constructed so that main body of washing apparatus is placed in a place facing a user, and the aperture of the first cover is placed so that high-speed jet liquid is spouted downward in front of the user.

According to further aspect of the invention, a washing apparatus is constructed so that the main body of washing apparatus is placed obliquely in front of the user, and the aperture of the first cover is placed so that high-speed jet liquid is spouted downward in front of a user.

According to further aspect of the invention, a washing apparatus comprises a jet stream rocking means for changing the area where fluid spouted from the aperture strikes a washing object.

According to further aspect of the invention, a washing apparatus comprises a detergent mixing means for mixing detergent to the washing liquid.

According to further aspect of the invention, a washing apparatus is constructed so that the blowing means comprises blower blades; each axis of the blower blades is coupled with a rotation axis of the high-speed jet stream spouting means; and the blower blades spouts gas to a washing object by rotation of the axis.

According to further aspect of the invention, a washing apparatus is constructed so that the blowing means comprises blower blades for blowing gas by rotation; and at least one of a rotation axis of the blower blades or a rotation axis of a rotating object is removable from a rotation axis of a rotating means.

According to further aspect of the invention, a washing apparatus is constructed so that a high-speed jet stream spouting means is equipped at the first cover arranged on one side of a rotating object; a blowing means having blower blades is equipped on the other side of the rotating object.

According to further aspect of the invention, a washing apparatus comprises a washing liquid heating means for heating washing liquid which is spouted to the washing object.

According to further aspect of the invention, a washing apparatus comprises a gas heating means for heating gas which is spouted to the washing object.

According to further aspect of the invention, a washing apparatus is constructed so that the aperture is arranged all over the circumference of the rotating object.

DETAILED DESCRIPTION OF THE PREFERRED EMBODIMENTS

Embodiment 1.

Figure 1:
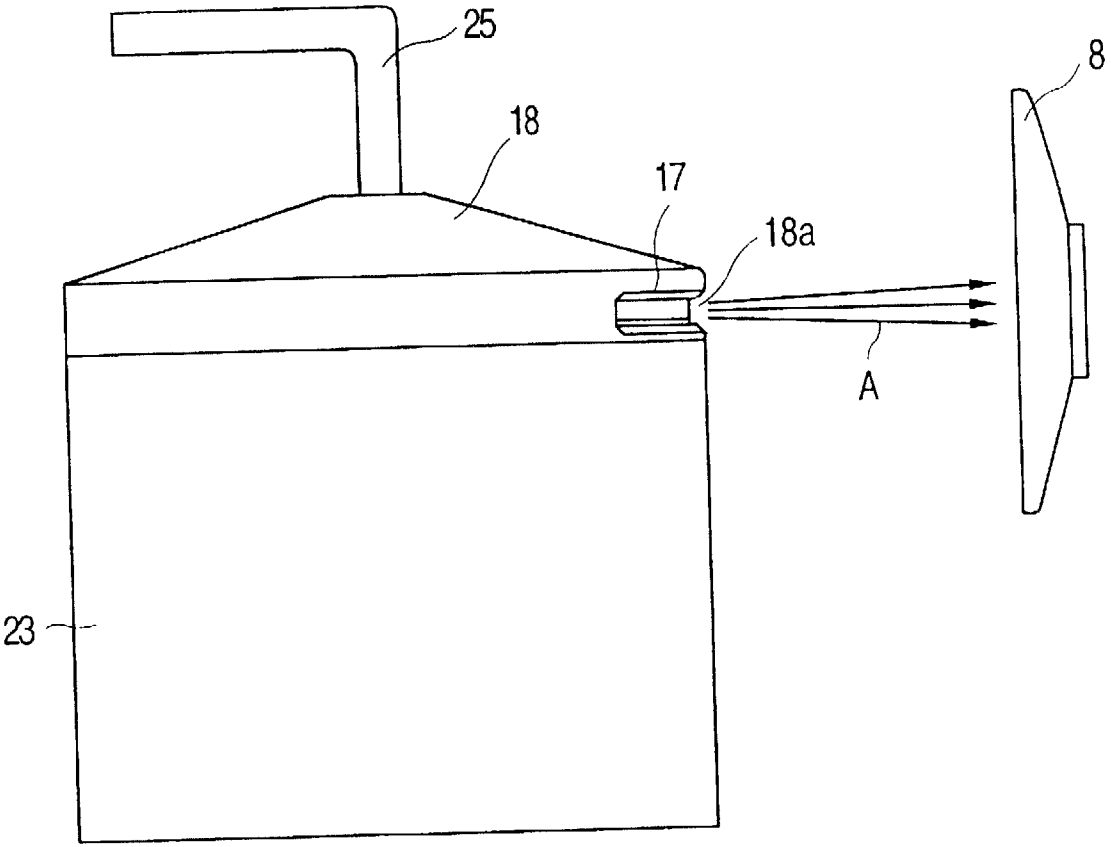
FIG. 1 is a top view showing a washing apparatus according to a first embodiment of the present invention.
Figure 2:
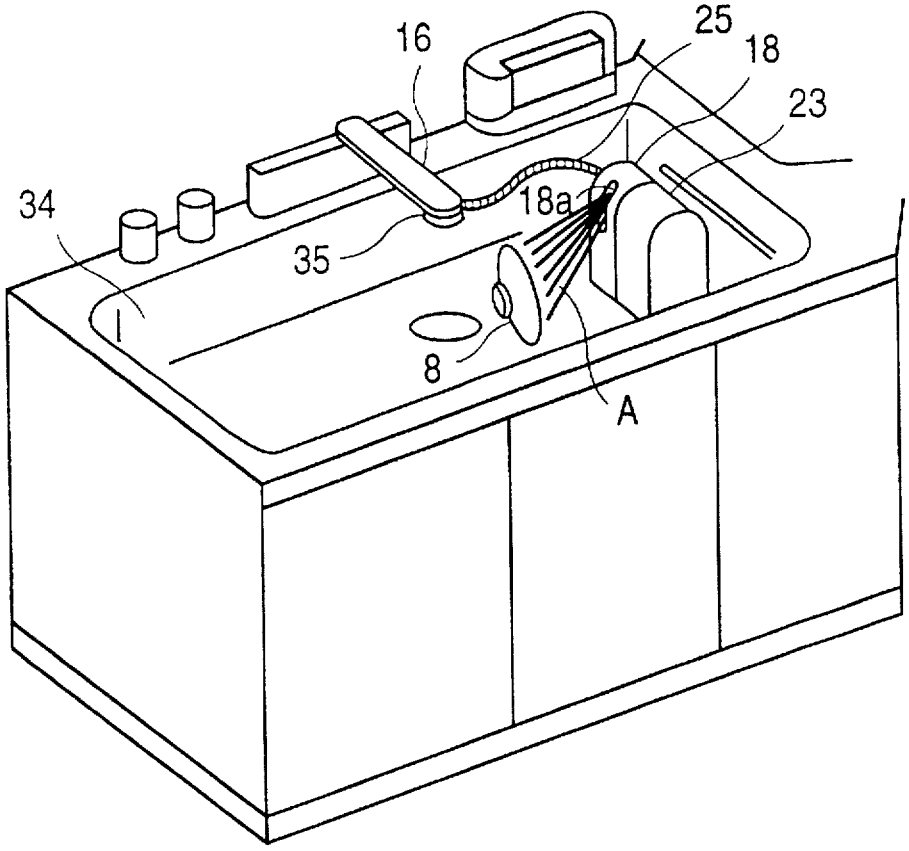
FIG. 2 is a perspective view showing how this tableware washing apparatus is arranged in a kitchen sink according to the first embodiment of the present invention.
Figure 3:
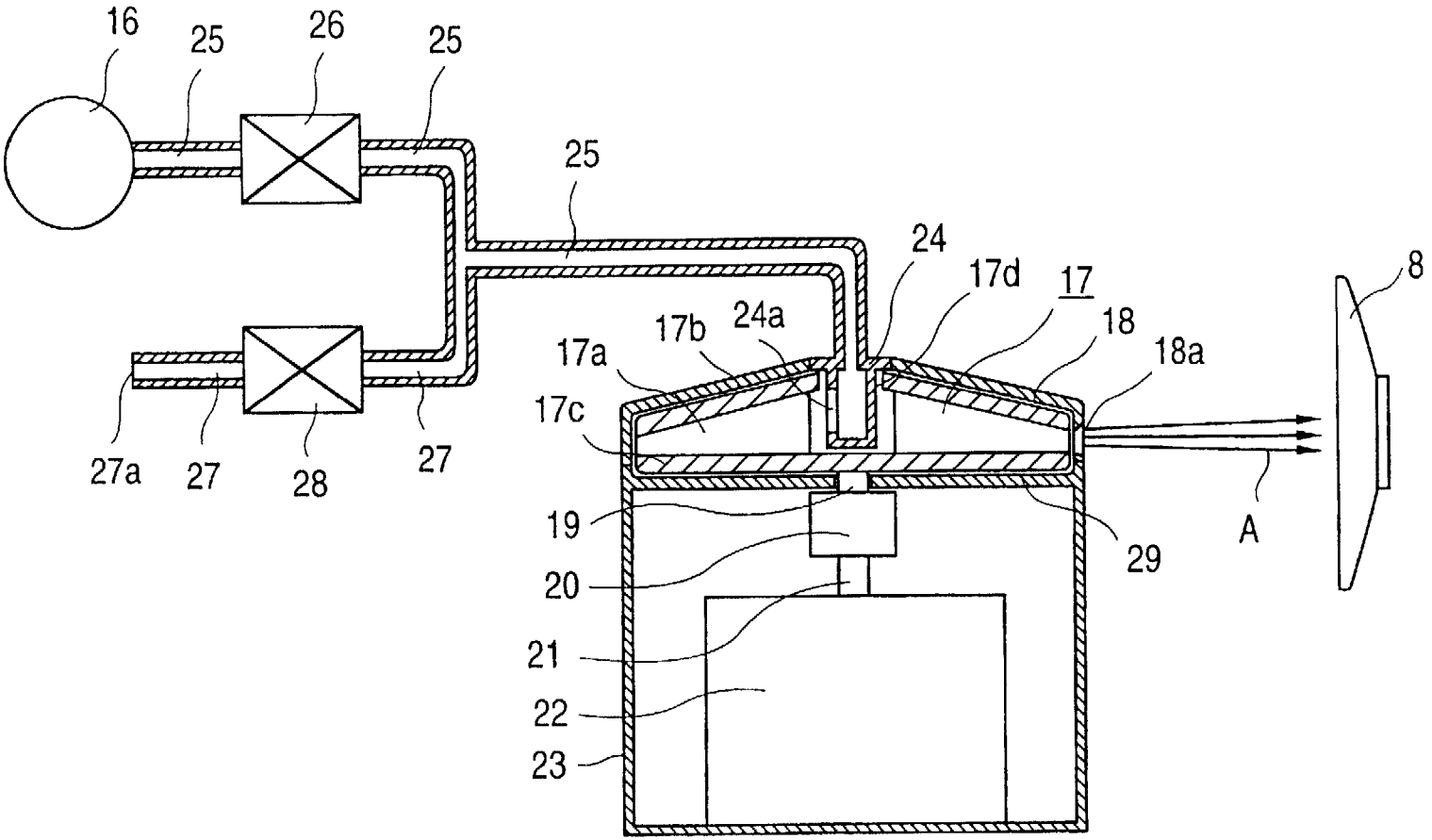
FIG. 3 is a cross sectional view showing a construction of the tableware washing apparatus according to the first embodiment of the present invention.
Figure 4:
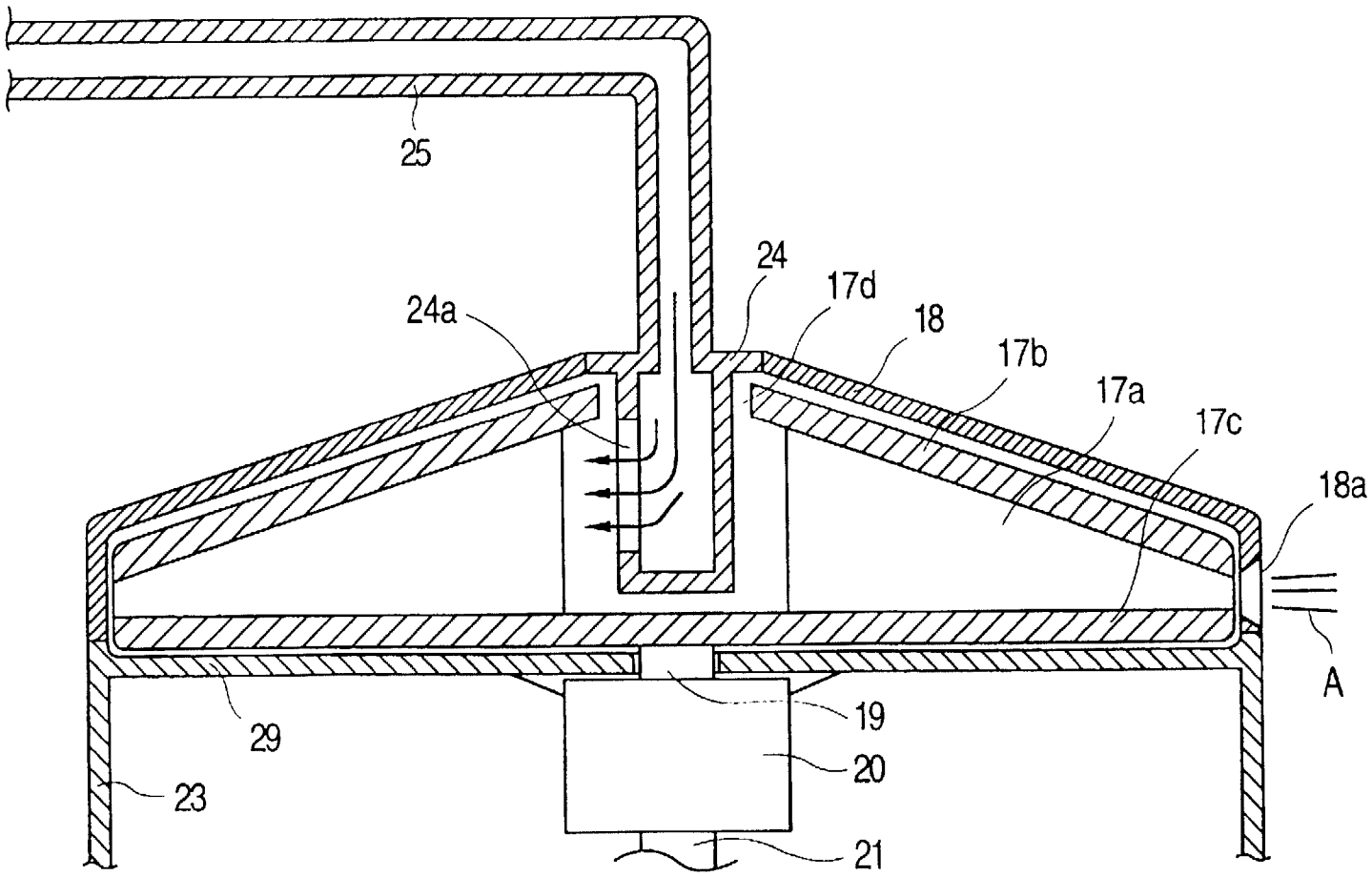
FIG. 4 is a cross sectional view showing an enlarged main portion of the tableware washing apparatus according to the first embodiment of the present invention.
Figure 5:
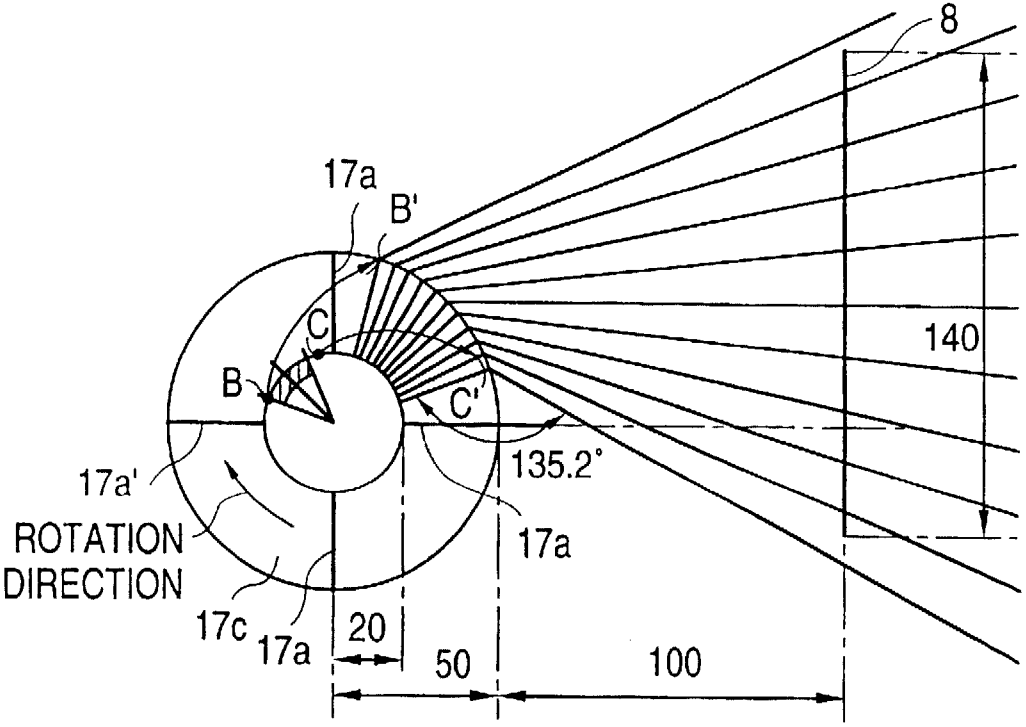
FIG. 5 is a diagram showing the top of a disk body for explaining the operation according to the first embodiment of the present invention.

FIG. 1 is a top view showing a washing apparatus according to a first embodiment of the present invention. In the first embodiment, the washing apparatus of the present invention is used as a tableware washing apparatus for washing tableware, for example. FIG. 2 is a perspective view showing how this tableware washing apparatus is arranged in a kitchen sink. FIG. 3 is a cross sectional view showing a construction of this tableware washing apparatus. FIG. 4 is a cross sectional view showing an enlarged main portion of this tableware washing apparatus. FIG. 5 is a top view of a disk body 17 for explaining the operation.

In the above-mentioned figures, a washing object 8 is a piece of tableware such as a plate, for example. A rotating object 17 is a disk body, for example, from which washing liquid is spouted toward the piece of tableware 8 in the form of high-speed jet liquid. The disk body 17 has a plurality of radial shape flow paths extending from the center to the circumference of the disk. These radial shape flow paths are constructed by a plurality of blades 17*a*, two discs 17*b*, 17*c* between which the blades 17*a* are placed, for example. An aperture 17*d* is provided on one of the disks, i.e. the disk 17*b* placed on the upper side, for receiving fresh water, for example, as washing liquid. In this embodiment, the height of the blades 17*a* measured vertically against the disk surface, is made higher in its central side than in its peripheral side. A first cover 18 covers the rotating disk body 17, and an aperture 18*a* is provided on the cover 18. Fresh water in the form of high-speed jet liquid through the aperture 18*a*. The aperture 18*a* is provided partially on the circumference of the first cover 18. A washing space is created in front of the aperture 18*a* of the cover 18.

A disk body rotation axis 19 is connected with the disk body 17. A coupling 20, a motor rotation axis 21, and a motor 22 generating a rotation force constitute a rotating means to rotate the disk body 17. The rotation force generated by the motor 22 is transmitted to the disk body rotation axis 19 via the motor rotation axis 21 and the coupling 20 to rotate the disk body 17. The lower cover 23 covers the coupling 20, the rotation axis 21, and the motor 22.

For example, fresh water is spouted as washing liquid from a liquid supplying portion 24 to the radial shape flow paths of the disk body 17. In this case, the liquid supplying portion 24 is a fresh water supplying portion to supply fresh water to the aperture 17*d* of the disk body. The fresh water supplying portion 24 is provided close to the aperture 17*d* of the disk body to prevent an unnecessary suction of air. The fresh water supplying portion 24 has a discharge aperture 24*a* of slit-shaped fresh water on one side thereof in order to supply fresh water only to a portion of the radial shape flow paths of the disk body 17.

The disk body 17 having a plurality of radial shape flow paths and the fresh water supplying portion 24 to inject fresh water to the radial shape flow paths constitute a high-speed jet stream spouting means for spouting fresh water in the form of high-speed jet liquid toward washing objects.

Washing liquid supplying means 25 is a water path connecting, for example, the fresh water supplying portion 24 and a water supply 16 such as a water supply tube or a faucet. In the middle of the path, a water quantity variable valve 26 is provided as a means for adjusting the quantity of liquid.

A pneumatic path 27 is connected with the water path 25. The end portion 27*a* is exposed to the atmosphere. In the middle, the pneumatic path 27 has an air quantity variable valve 28 as a means for adjusting the quantity of air.

A supplementary plate 29 is provided close to the bottom of the rotating disk body 17. It is extended to the first cover 18. The supplementary plate 29 receives fresh water failed to be spouted from the aperture 18*a* of the cover and supplies the water to the bottom portion of the disk body 17, and discharges the fresh water from the aperture 18*a* by the rotation force of the disk body 17.

In a kitchen sink 34, an adapter 35 connects the faucet, namely water supply 16, with the water path 25 to switch the fresh water from the faucet to the water path 25. Washing liquid A is spouted in the form of high-speed jet liquid.

The tableware washing apparatus constructed in the above-mentioned manner is placed inside the kitchen sink 34, or any vacant peripheral space of the kitchen sink 34. In this embodiment, it is placed obliquely in front of a user. The aperture 18*a* is arranged so that the high-speed jet liquid spouts out downwards in front of the user. For example, this aperture 18*a* has a slit like shape. The main frame of the washing apparatus is placed so that the longitudinal direction of the slit-shaped aperture becomes almost vertical. FIG. 1, FIG. 3, FIG. 4 show the main body of the apparatus looked at from the top.

The user holds a piece of tableware 8 by hand to place the piece of tableware 8 in the washing space created in front of the aperture 18*a* of the first cover 18 so that the surface of the piece of tableware 8, whose surface is going to be washed, faces against the aperture 18*a*.

The operation of this tableware washing apparatus is explained below. A switch of the motor 22 (not illustrated) is turned on to drive the motor 22. This operation is done before and after placing the piece of tableware 8 in the washing space. When the motor 22 is driven, the disk body 17 starts rotating. Fresh water is supplied from the water supply 16, via the water path 25 to the fresh water supplying portion 24, and supplied from the discharge aperture 24*a* to the aperture 17*d* in the center of the disk body 17*b*. Receiving a rotation force of the radial shape flow paths consisted of the blades 17*a*, the discs 17*b*, 17*c*, the flow of the fresh water is accelerated in the direction of the rotating circumference as well as the rotating periphery of the disk body 17. The fresh water is spouted from the aperture 18*a* of the first cover 18 toward the washing space created in front of the aperture 18*a*. At this time, the water quantity variable valve 26 shown in FIG. 3 is opened to supply fresh water, while the air quantity variable valve 28 is closed to intercept a pneumatic suction to the fresh water supplying portion 24.

The high-speed jet liquid supplying toward the washing space in front of the aperture 18*a* spouts out toward the piece of tableware 8. The dirt objects stuck to the piece of tableware 8 are washed down by the impact force given by the high-speed jet liquid and the drifting force given by the falling water, and in this manner the piece of tableware 8 is cleaned.

The intensity of the water jet to wash down the dirt on the piece of tableware 8 ranges around more than 2 kg f/cm$^2$ and less than 20 kg f/cm$^2$. This value is enough to obtain a satisfactory washing effect. Moreover, the user does not feel pain if jet stream liquid strikes his or her hand. It only takes 3 to 5 seconds to finish washing a piece of tableware. The quantity of liquid necessary for washing does not exceed the amount generally supplied from water line (less than 20 liter/minute). If it requires a large quantity of flow more than the water supplied from water line for washing, more water should be stored in a water tank, which makes it difficult to cause the size of the main body to be small. On the other hand, if the quantity of flow is as within that supplied from the water line as mentioned in the above, it does not limit the use of the washing apparatus. Accordingly, this enables a washing apparatus to operate continuously. Also, a water tank is not necessary to be equipped.

When a piece of tableware 8 is washed completely by jet stream liquid, the water quantity variable valve 26 is closed to stop supplying fresh water. Concurrently, the air quantity variable valve 28 is opened to supply air instead of fresh water to the fresh water supplying portion 24 as well as to the disk body 17 from the end portion 27*a* of the pneumatic path exposed to the atmosphere. In the same manner as fresh water, receiving a rotation force of the disk body 17, the flow of the supplied air is accelerated in the direction of the rotating circumference as well as the rotating radius of the disk body 17. The air is spouted from the aperture 18*a* of the first cover 18 toward the washing space in front of the aperture 18*a*. The air velocity necessary for drying a piece of tableware 8 is around 52 m/sec, for example, and air quantity sent is at the rate of more than 0.90 m$^3$min for example.

The air supplying toward the washing space in front of the aperture 18*a* strikes the piece of tableware 8, and drifts drops of water stuck on the piece of tableware 8 along its surface to its edge. Since the force of the spouted air overwhelms the surface tension of water at the edge of the piece of tableware 8, drops of water can be scattered, and the piece of tableware 8 can be dewatered. Some drops of water may be scattered only when they are just struck by jet air.

In this embodiment, fresh water continuously supplied from water supply 16 is accelerated by the high-speed jet stream spouting means. Fresh water is spouted toward the piece of tableware 8 placed in front of the aperture 18*a*. The dirt stuck to the piece of tableware 8 is washed down by the impact of the hygienic jet stream liquid, and drifted downwards by the water flow. Accordingly, a washing operation is completed in a short time. After these processing is completed, the tableware 8 is dewatered by blowing air from the blowing means toward the piece of tableware 8.

Furthermore, the tableware washing apparatus has a construction of a high-speed jet stream spouting means and a blowing means, and switches the washing state and the drying state by the water quantity variable valve 26 and the air quantity variable valve 28. This realizes a compact washing apparatus which washes off the dirt stuck to the piece of tableware 8 by the impact of the hygienic jet stream liquid, and drifts it downwards with the water flow, and dewateres the piece of tableware 8 by blowing air toward the piece of tableware 8 from the blowing means.

As shown in FIG. 4, the fresh water discharge aperture 24*a* of the fresh water supplying portion 24 is provided in a direction defined in relation to the direction of the opening of the aperture 18*a* of the first cover 18. In other words, the fresh liquid supplying portion 24 is arranged so that fresh water in the radial shape flow paths is accelerated by the rotation, and supplied to a radial shape flow path from which fresh water is spouted from the aperture 18*a* toward the desired washing space in the form of high-speed jet liquid. This is a result of considering the spatial relationship between the supplying point and the supplying point of the fresh water, when the fresh water supplied to the central portion of the disk body 17 is accelerated by receiving a rotation force from flow path walls, namely the blades 17*a*, and is spouted out from the periphery of the disk body 17 as well as from that of the blades 17*a*.

The above is explained below, referring to FIG. 5. FIG. 5 shows the disk body 17 with the bottom disk 17*c* and the blades 17*a* looked at from the top. For the sake of explanation, it is assumed that the number of the blades 17*a* radially arranged is four. As shown in FIG. 5, the diameter of the disk 17 is 100 mm, and each blade 17*a* is arranged toward the radius direction from the distance of 20 mm spaced from the center of the disk 17. If the direction of the rotation is clockwise, the fresh water supplied on the point B is accelerated, when the flow path wall, namely the blade 17*a*, comes to contact with the fresh water. The fresh water rotates approximately 90 degrees along with the flow path wall, i.e. the blades 17*a*', and is spouted out from the point B'. In the same manner, the fresh water supplied on the point C rotates approximately 90 degrees along with the flow path wall, i.e. the blade 17*a*', and is spouted out from the point C'. The direction where the fresh water is spouted is deviated by approximately 132.5 degrees to the normal line which connects the center of the disk body and the fresh water supplying point. The location relationship between the supplying point and the supplying point of fresh water as well as the direction of supplying fresh water depend on the shape of the blades 17*a* which constitutes a disk radius as well as a flow path wall, and the supplying point of the fresh water.

The acceleration, velocity and location of a mass point on the disk with blades are generally represented by the following equations:

Location (radius direction): $r(t)=(e^{\omega t}+e^{-\omega t})r_0/2$

Velocity (radius direction): $V_r(t)=\omega(e^{\omega t}-e^{-\omega t})r_0/2$

Velocity (peripheral direction): $V_t(t)=r\omega$

Composed velocity : $V=(v_r^2+v_t^2)^{0.5}$

Velocity direction : $\theta=ATAN(v_r/v_t)$

Acceleration (radius direction) : $\alpha_r(t)=\omega^2(e^{\omega t}+e^{-\omega t})r_0/2$ where, $\omega$ is an angular velocity, $r_o$ is an initial position in the direction of the radius.

Using above-mentioned equations, the velocity and the velocity direction of a mass point for the location of the radius of the disk body are calculated. Furthermore, it is possible to specify the spouting area of fresh water jet from the above calculated result. Adversely, since a radial shape flow path where fresh water is spouted toward the desired washing space can be specified from the calculated result, the discharge aperture 24*a* of the fresh water supplying portion 24 can be arranged so that fresh water is provided to the radial shape flow path.

Actually, when the water is supplied at the hatched range B~C on the circumference which radius is 20 mm from the center axis as shown in FIG. 5, the fresh water is spouted from the portion B'~C' on the disk periphery. The direction of the spouted jet stream liquid is shown by the straight lines depicted outside the disk body. By arranging the fresh water supplying portion 24 for supplying the fresh water and the fresh water discharge aperture 24*a*, the fresh water is supplied into the radial shape flow path from which fresh water is spouted toward the desired washing space. Therefore, the spouting area of jet stream liquid, namely the washing space, is appropriately determined. According to this embodiment, the 140 mm-wide washing space is created at the distance of 100 mm from the edge of the disk body 17 as shown in FIG. 5, which gives an enough space for washing a piece of tableware 8 at home.

The aperture 18*a* of the first cover 18 may be arranged in the range that the jet stream liquid can pass through, namely as close as the peripheral portion B'~C' of the disk. If water is supplied as such mentioned in this embodiment, it prevents a leakage of water which is not spouted directly from the aperture 18*a* of the first cover 18. Accordingly, fresh water is effectively used.

The discharge aperture 24*a* may be a single hole, or a plurality of holes, or a slitshaped hole constructed on the fresh water supplying portion 24. The fresh water is supplied to a portion of the radial shape flow path, namely only to the portion B~C shown in FIG. 5. Since the fresh water discharge aperture 24*a* supplies fresh water from the central portion of the disk body 17 toward the radius direction, the fresh water can be smoothly supplied to the radial shape flow paths.

As shown in FIG. 4, the supplementary plate 29 is provided close to the bottom of the rotating disk body 17. This supplementary plate 29 receives leaked water which is not directly spouted from the aperture 18*a* of the first cover 18. The fresh water received on the supplementary plate 29 is accelerated by the rotation force toward the periphery of the disk below the rotating disk body 17, and then finally spouted from the aperture 18*a*. Accordingly, the fresh water failing to pass the aperture 18*a* is not collected between the inner wall of the cover and the periphery of the disc body in the washing apparatus because the leaked fresh water is finally spouted from the aperture 18*a* toward the washing space.

Figure 6A:
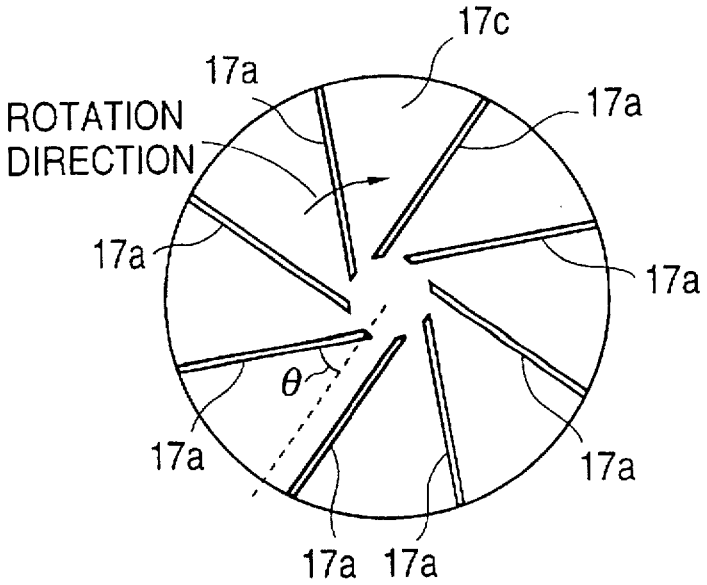
FIGS. 6A and 6B are a diagram showing a disk body according to the first embodiment of the present invention.
Figure 6B:
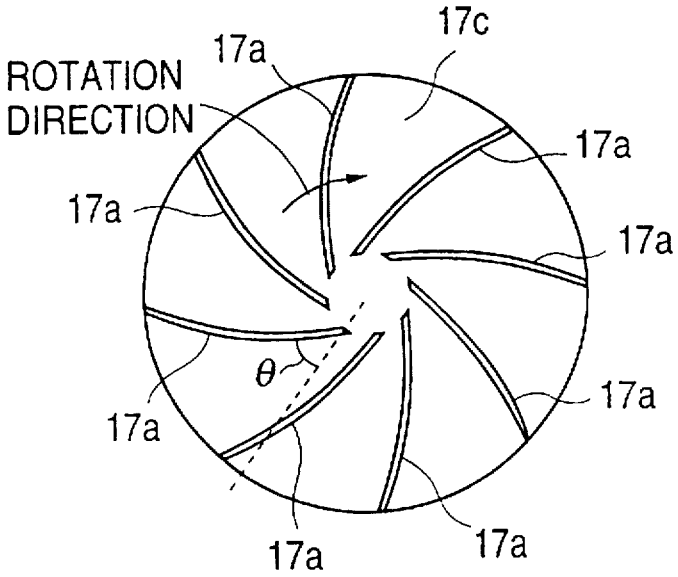
Figure 7:
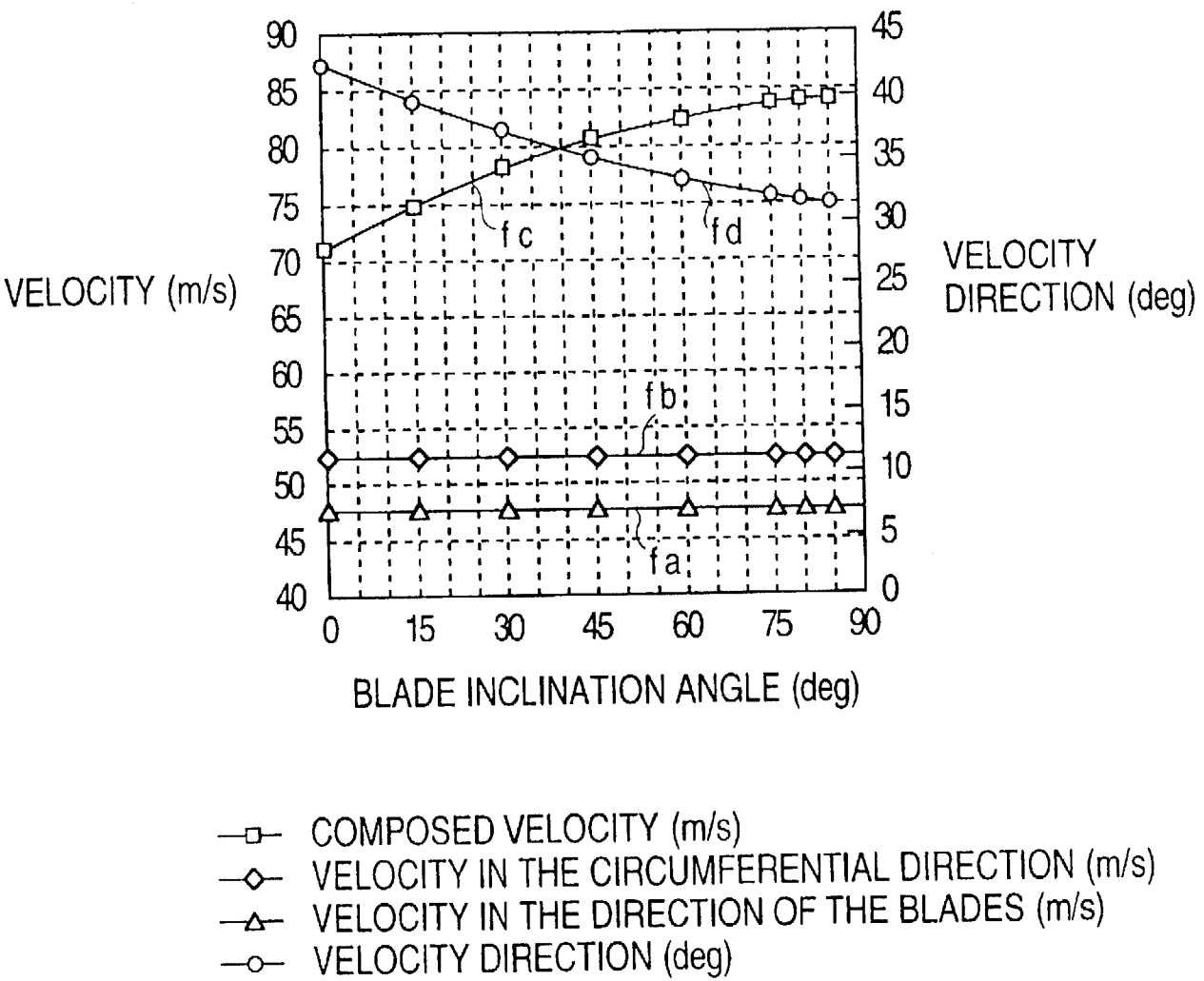
FIG. 7 shows a relationship between the velocity (m/s) and the velocity direction (deg) of the jet stream liquid in relation to the forward inclination angle$\theta$ (deg) of a blade 17*a* measured in the rotating direction of the disk body, according to the first embodiment of the present invention.

FIG. 6 (A) shows a disk body 17 used in this embodiment. FIGS. 6A and 6B show the disk body 17 with the blades 17*a* and the bottom disk 17*c* looked at from the top of the disk surface. FIG. 7 shows a relationship between the velocity (m/s) and the velocity direction (deg) of the jet stream liquid in relation to the forward inclination angle$\theta$ (deg) measured in the rotating direction of the disk body. Where, the forward inclination angle $\theta$ (deg) means an angle between the blades 17*a* and the straight line connecting the center of the disk body 17 and the end of the blades 17*a*.

In FIG. 7, fa denotes a velocity $v_r$ in the direction of the blade, fb is a velocity $v_t$ in the circumferential direction, fc is a composed velocity (m/s) of the velocity $v_r$ in the direction of the blades and the velocity $v_t$ in the circumferential direction and fd denotes a direction of the velocity. It is understood from the figure that the larger the forward inclination angle of the flow path wall is, the higher the velocity of the jet stream liquid gets. If the angle of forward inclination is 0 degree, namely the flow path wall is arranged along with the vertical line drawn from the center to the circumference, a velocity as much as 70 m/s can be obtained. This would be enough to obtain a satisfactory washing effect. It would be desirable however, if the forward inclination angle ranges around 75~80 degrees. A radial shape flow path having the inclination angle more than 90 degrees is hardly realized in terms of construction.

In FIG. 6B, a plurality of blades which constitutes the flow path wall are arranged radially from the center of the disk body, and curved and inclined forward in the direction of rotation. If each blade is arranged in this way, a certain degree of forward inclination angle is always maintained for the fresh water rotating in the radial shape flow paths. This extends the path where fresh water is accelerated. As a result, the velocity of the jet stream liquid is raised and the impact given to the tableware is strengthened. Accordingly, tableware is cleaned in a short time with a small quantity of fresh water, even if heavy dirt is clinging. In other words, by inclining the blades forward, namely inclining the flow path wall forward, it enables even a small disk body to generate a jet stream liquid strong enough to render a satisfactory washing effect.

A liquid particulate mechanism using a rotating disk for a general industrial use is applied mainly to making mists which are spouted from the peripheral of the disk after the liquid is well mixed with the air, as disclosed in pages 134~135 in the publication titled "mechanism of flows inside a container" by Masakazu, Tuji, published by Nikkan Kougyou Shinbun-sha. A liquid particulate mechanism using the general rotating disk is, however, the water supplied to the rotating disk is slipping on its surface, and therefore it fails to receive an enough rotation force from the rotating disk. Therefore, it generates a jet mist consisting of small particles with a low velocity. On this account, this mechanism hardly generates a jet stream having an impact strong enough for cleaning. On the other hand, the high-speed jet stream spouting means using a disk body according to this embodiment has a flow path wall for constituting a plurality of radial shape flow paths to prevent fresh water from slipping off the surface, which may obtain a high-speed jet stream.

According to this embodiment, since the fresh water is intermittently supplied to the rotating radial shape flow paths, a jet flow becomes also an intermittent flow. Since particles of the water constituting this intermittent flow are not so smaller than the abovementioned jet mist, the velocity of the water is not so small even after the liquid is spouted. Accordingly, a jet stream having an impact strong enough for cleaning is obtained. Furthermore, the intermittent flow consisting of particles renders a superior washing effect than the continuous flow.

According to this embodiment, the height of the blades 17*a* at the central portion is higher than that of the peripheral portion when measured vertically against the disk surface. In other words, the cross section area of the blades vertically standing on the radial shape flow paths at the central portion is larger than that of the peripheral portion. Therefore, it is possible to supply the amount of liquid necessary for washing to the aperture 17*d* without overflowing, when generating a jet stream liquid by accelerating the liquid in the radial shape flow paths in the disk body. Moreover, the spouting velocity gets faster because the fresh water is supplied from the larger cross section portion to the smaller cross section portion.

If the height of the blades 17*a* is made the same, a cross section area standing vertically against the radial shape flow paths in the center portion becomes larger than that of in the peripheral portion of the disk, by making the horizontal width of the radial shape flow path in the central portion is larger than that in the peripheral portion.

In the above-mentioned embodiment, the fresh water is used as washing liquid. However, it may be substituted by industrial water, pure water, or a liquid detergent of alternate flon system. A liquid detergent of alcohol system or that of terpene system, for example, are used as the liquid detergent of non-flon system.

As the blowing means, a pump and so on can be used which presses and exhausts the air, instead of using a blower blade. The blowing means may be also constructed to exhaust other gas instead of air.

The washing apparatus may be constructed only by the washing means without a blowing means, if drying process is not necessary, or a separate drying washing apparatus is used. As described above, the washing apparatus of the present embodiment is constructed so that a disk body has a plurality of radial shape flow paths which rotate to generate high-speed jet liquid spouted toward a washing object, it is possible to obtain a compact washing apparatus doing a complete hygienic washing without using any detergent. Accordingly, the above-mentioned washing apparatus is able to reduce the washing time, the amount of water and the electric power necessary for washing.

A high-speed jet stream spouting means may be constructed so that washing liquid is pressed by using a pump and so on,to obtain high-speed jet liquid, instead of rotating the disk body having a plurality of radial shape flow path.

If a fresh water supplying portion is covered to shut off the entrance of air when a jet stream liquid is generated, the rotation force of the disk body is exclusively used for accelerating fresh water. This increases the speed of the jet stream liquid and restrains the noise which originates from pneumatic oscillation.

The speed of the jet stream liquid is adjusted depending on the dirt on the tableware, by changing the rotating speed of the disk body.

Moreover, the washing apparatus is easy to use because it is compactly made. A user can place the washing apparatus in a vacant place of the kitchen sink, while it is used.

Embodiment 2.

Figure 8:
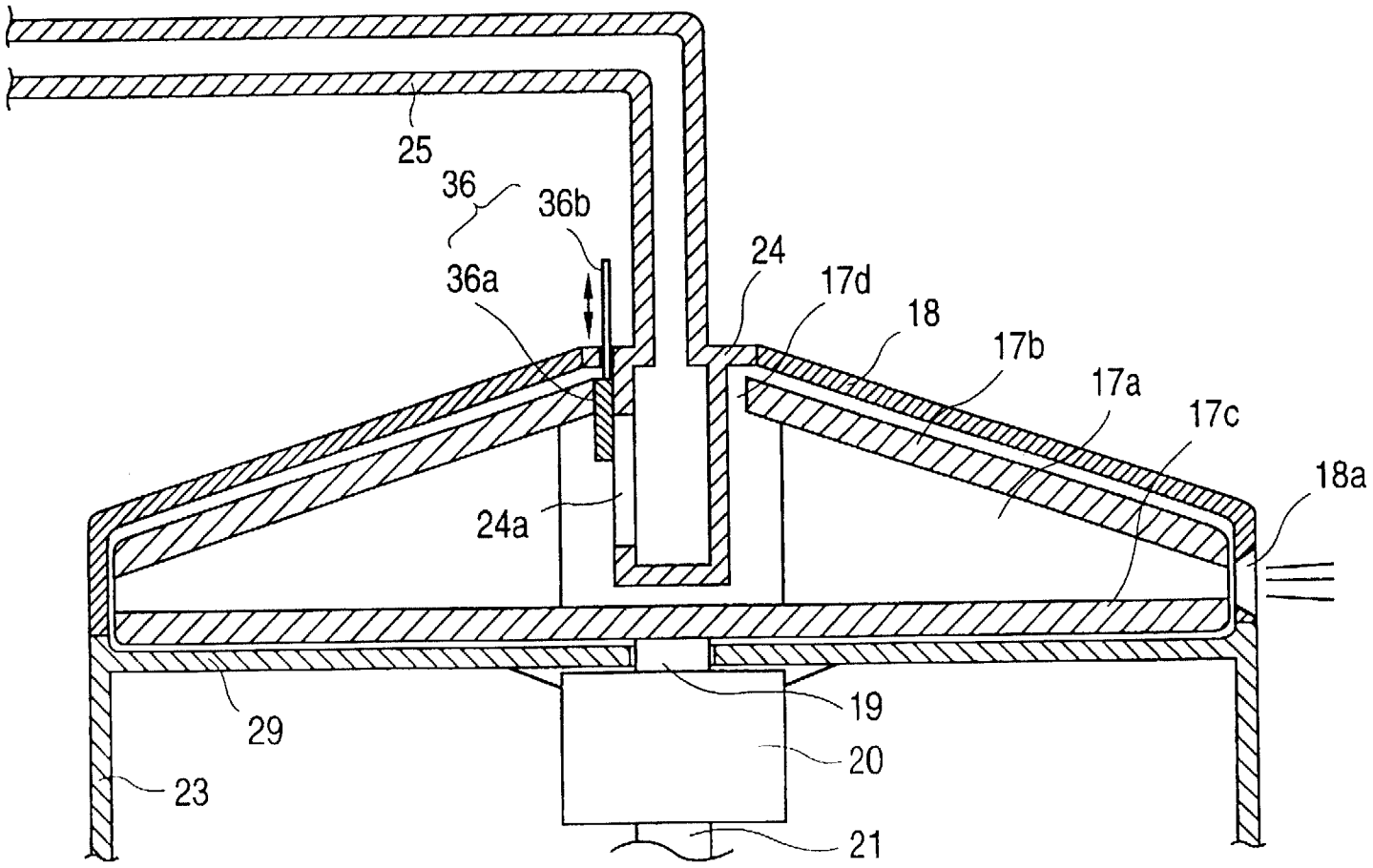
FIG. 8 is a cross sectional view showing an enlarged main portion of a tableware washing apparatus according to a second embodiment of the present invention.

FIG. 8 is a cross sectional view showing an enlarged main portion of a tableware washing apparatus according to a second embodiment of the present invention. An adjusting means 36 adjusts a quantity of washing liquid supplied to the radial shape flow path. The adjusting means 36 comprises a discharge aperture area adjusting means, for example. This discharge aperture area adjusting means 36 is provided at the discharge aperture 24*a*, which comprises a single hole, a plurality of holes or a slit-shaped hole from which the fresh water is discharged. The discharge aperture area adjusting means 36 comprises a board member 36*a* for blocking up the discharge aperture 24*a*, and a stick member 36*b* for moving the board member 36*a* in the direction of the arrow shown in the figure. If the stick member 36*b* is pressed toward the disk body 17, a quantity of fresh water supplied to the radial shape flow path is reduced. If the stick member 36*b* is drawn from the disk body 17, a quantity of fresh water supplied to the radial shape flow path is increased.

When a piece of tableware 8 is not so dirty, the stick member 36*b* is pressed toward the disk body 17 to reduce the supply of fresh water. Otherwise, the stick member 36*b* is drawn from the disk body 17 to increase the supply of fresh water. Accordingly, by adjusting the supply of fresh water to the radial shape flow paths, the quantity of fresh water is appropriately adjusted depending on the dirt. This reduces the amount of water used while washing.

Embodiment 3.

Figure 9:
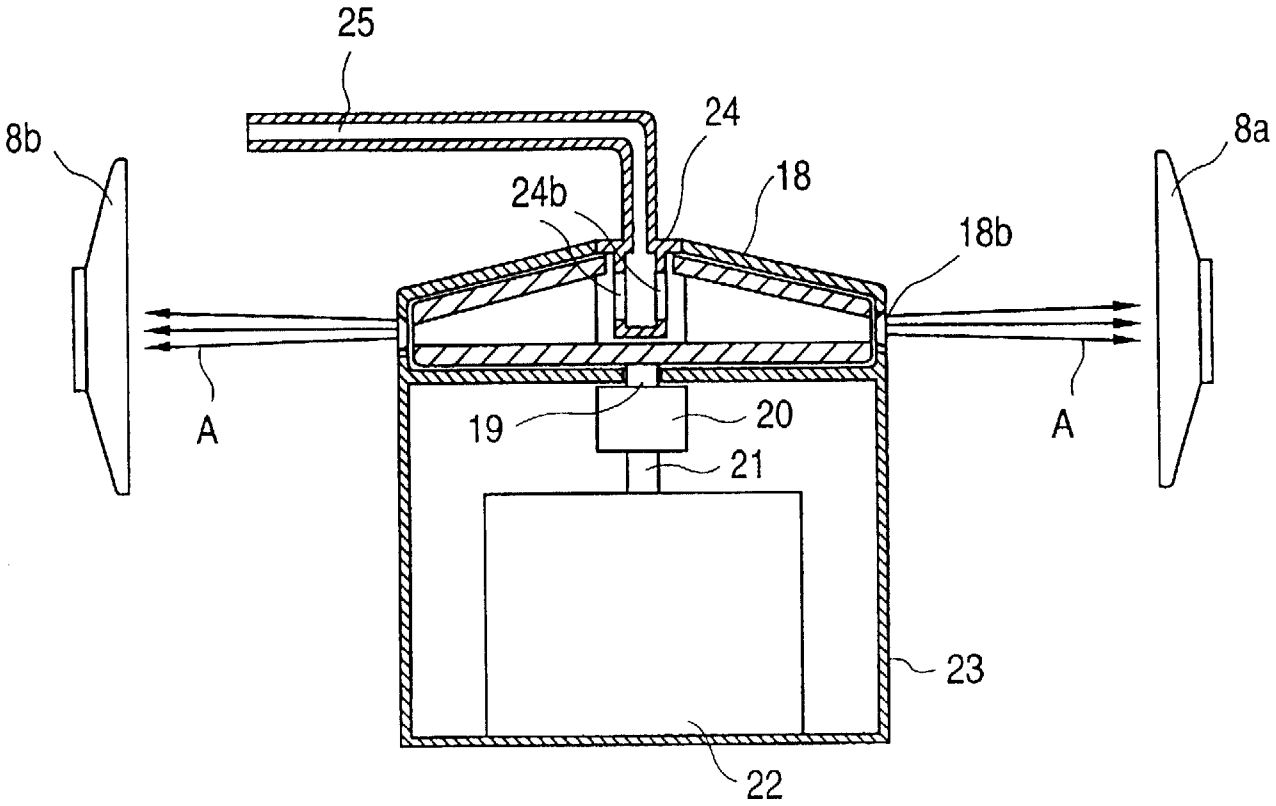
FIG. 9 is a cross sectional view showing a tableware washing apparatus according to a third embodiment of the present invention.

FIG. 9 is a cross sectional view showing a tableware washing apparatus according to a third embodiment of the present invention. The direction of the top and the bottom in the figure corresponds to the vertical direction of the washing apparatus. In the same manner as above-mentioned embodiments, a tableware washing apparatus in this embodiment generates a jet stream liquid by accelerating fresh water supplied continuously from the water supply using a rotation force generated from the flow paths of the rotating disk body 17. In FIG. 9, a single aperture 18*b* is provided all over the circumference of the first cover 18. A fresh water discharge aperture 24*b* provided on the fresh water supplying portion 24 is constructed so that fresh water is supplied to all of the radial shape flow paths. For example, the fresh water discharge aperture 24b comprises a plurality of holes or a slit-shaped hole provided all over the circumference of the fresh water supplying portion 24.

In this embodiment, the high-speed jet liquid spouts out from all the circumference of the first cover 18. A plurality of pieces of tableware 8a, 8b is placed in front of the aperture 18b. The high-speed jet liquid is spouted toward the tableware to wash down the dirt stuck to tableware 8a, 8b by the impact of hygienic jet stream liquid. The flow of the fresh water pushes the dirt downwards. Accordingly, it takes only a short time to complete washing.

If a supporting jig is used to fix a plurality of pieces of tableware 8, it is possible to obtain a compact washing apparatus by which many pieces of tableware are cleaned at the same time.

According to this embodiment, if a washing space is extended by constructing the washing apparatus so that the high-speed jet stream is spouted from all the circumference of the first cover 18, a large washing object, objects inside the cylinder, or a plurality of washing objects can be washed out.

In this embodiment, a single aperture 18b is provided all over the circumference of the first cover 18, but this aperture 18b may be of plural, unevenly distributed, or equally distributed on the circumference of the first cover 18 depending on the shape of the object washed by the washing apparatus.

Embodiment 4.

Figure 10:
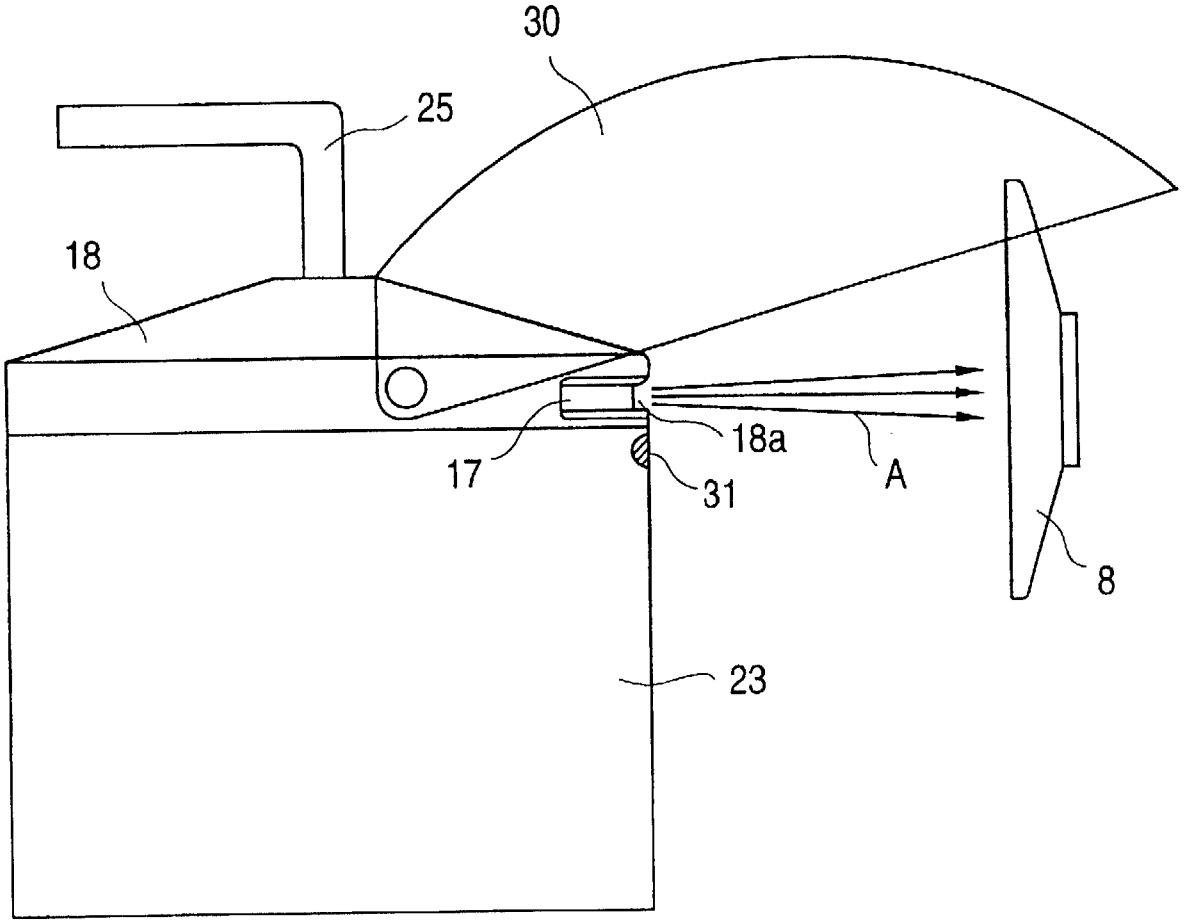
FIG. 10 is a diagram showing a tableware washing apparatus according to the a embodiment of the present invention.

FIG. 10 shows a tableware washing apparatus according to a fourth embodiment of the present invention. The direction of the top and the bottom in the figure corresponds to the vertical direction of the washing apparatus. In the same manner as the above-mentioned embodiments, a tableware washing apparatus in this embodiment generates a jet stream liquid A by accelerating fresh water supplied continuously from the water supply using a rotation force generated from the flow paths of the rotating disk body 17. In FIG. 10, a jet mist scattering protection means 30 is a cover for shutting out the scattering jet mist, made of a solid transparent material such as plastics. It covers the washing space extending from the aperture 18a to tableware 8. The jet mist scattering protection cover 30 is a flexible or removable cover. A sensor 31 detects the piece of tableware 8 placed in the washing space. Receiving a detecting signal from the sensor 31, the washing apparatus starts its operation.

Since high-speed jet liquid A is spouted from the aperture 18a to the piece of tableware 8, jet mist is generated when the jet stream liquid A strikes the piece of tableware 8, which is scattered around the washing space by a certain degree of velocity. According to this embodiment, the jet mist scattering protection cover 30 prevents the jet mist from scattering outside the washing space when the jet stream liquid A strikes the piece of tableware 8. Accordingly, the cover protects the surroundings of the washing apparatus including the user from damping by the scattering jet mist containing dirt. Therefore the washing apparatus gives the user convenient usage, pleasant feeling and hygienical washing.

Embodiment 5.

Figure 11:
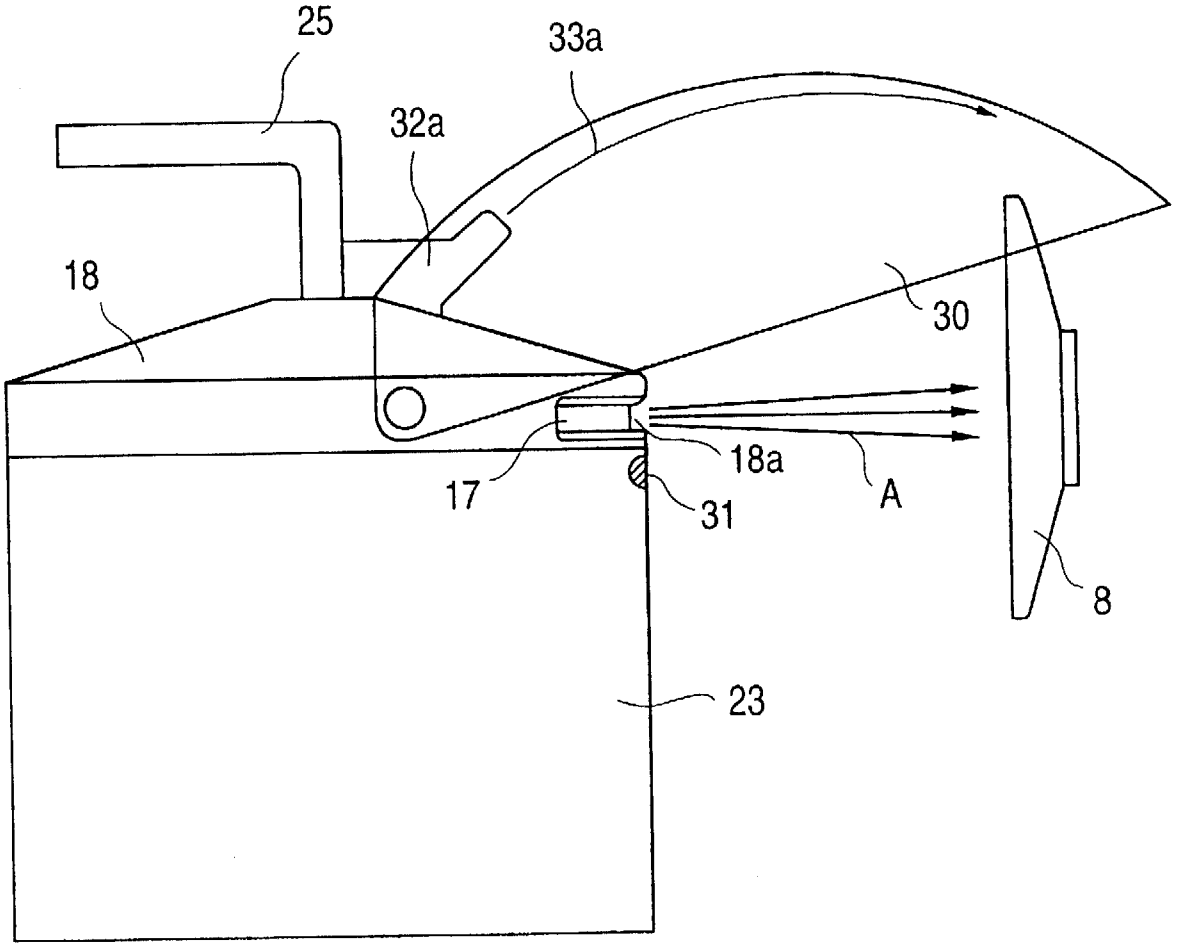
FIG. 11 is a diagram showing a tableware washing apparatus according to a fifth embodiment of the present invention.

FIG. 11 shows a tableware washing apparatus according to a fifth embodiment of the present invention. In the same manner as the fourth embodiment, the jet mist scattering protection cover 30 is provided to cover the washing space extending from the aperture 18a to the tableware 8. A dirt protection means 32a comprises a fresh water exit provided inside the jet mist scattering protection cover 30, for example. Fresh water 33a is provided from the fresh water exit.

In this embodiment, a portion of fresh water which is supplied from the water supply via the water path 25, is received and supplied from the fresh water exit 32a toward the inside wall of the jet mist scattering protection cover 30 facing the washing space. The jet mist is generated when the jet stream liquid A spouted out from the aperture 18a strikes the piece of tableware 8. Fresh water is supplied when the jet mist scattering protection cover 30 shuts out the scattering jet mist. The fresh water protects the inside wall of the jet mist scattering protection cover 30 facing the washing space from the jet mist containing dirt. Accordingly, it enables the user to do the washing hygienically, without any unpleasant feeling given by the dirty water which dampens the user as well as the surroundings of the washing apparatus. Moreover, the fresh water eliminates the trouble to periodically wash the jet mist scattering protection cover 30.

The above-mentioned dirt protection means for supplying fresh water from the fresh water exit 32a toward the inside wall of the jet mist scattering protection cover 30 facing the washing space may be substituted by other means. For example, it is substituted by a mechanism like a wiper periodically going forward and backward on the inside wall of the jet mist scattering protection cover 30 facing the washing space.

Embodiment 6.

Figure 12:
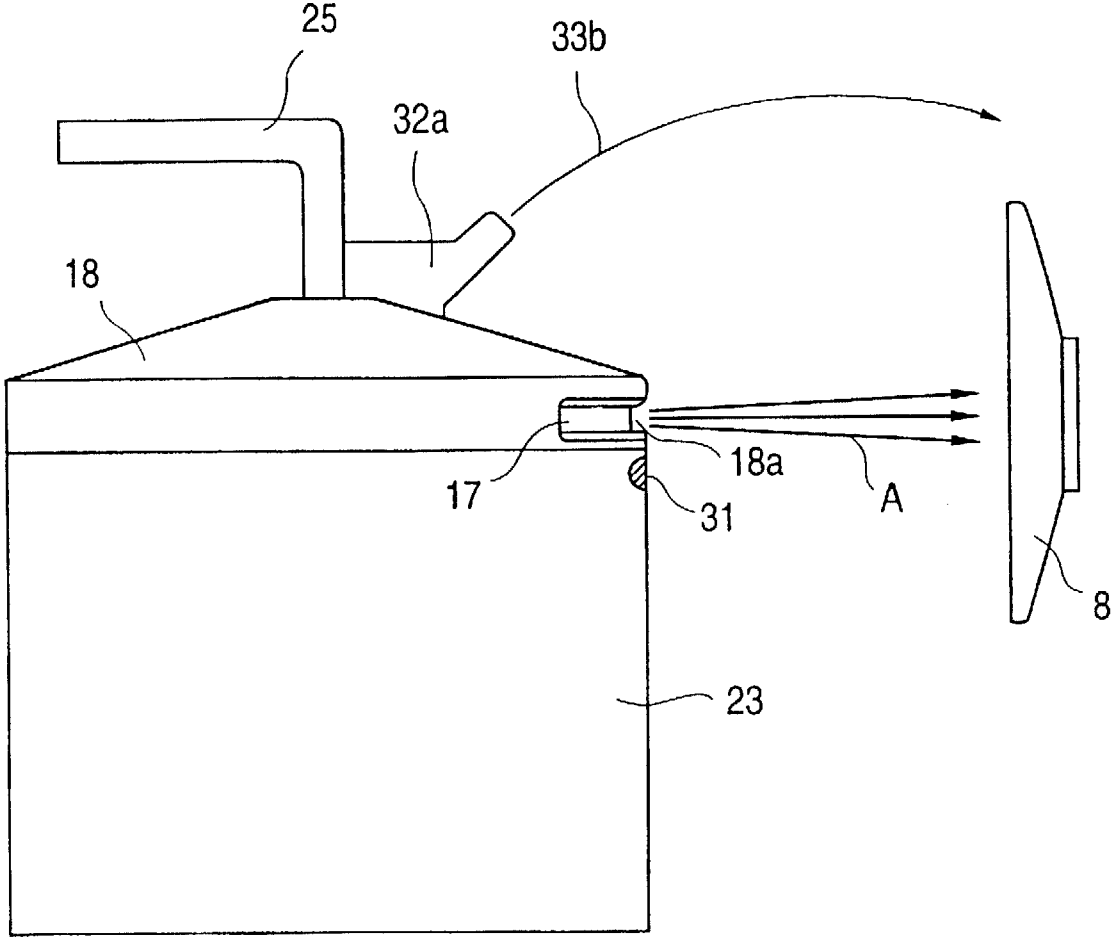
FIG. 12 is a diagram showing a tableware washing apparatus according to a sixth embodiment of the present invention.

FIG. 12 shows a tableware washing apparatus according to a sixth embodiment of the present invention. The direction of the top and the bottom in the figure corresponds to the vertical direction of the washing apparatus. In this embodiment, a fluid portion covering the washing space, namely the water wall 33b, for example, is provided as a jet mist scattering protection means.

A portion of fresh water, supplied from the water supply via the water path 25, is received and discharged from the fresh water exit 32a. The fresh water is discharged so that the washing space extending from the aperture 18a to a piece of tableware 8 is covered, and the water wall 33b is created.

The jet mist generated when the jet stream liquid A strikes the piece of tableware 8 is caught by the fresh water wall 33b, and pushes the liquid A downward by the water flow. In the same way as the fourth embodiment, the water wall 33 protects the surroundings of the washing apparatus including the user from damping with the scattering jet mist containing dirt. Accordingly, the water wall prevents the jet mist containing dirt from scattering around the washing space, and enables the user to do the washing hygienically, without any unpleasant feeling given by the dirty water which dampens the user as well as the surroundings of the washing apparatus.

In this embodiment, instead of a dirt protection means as mentioned in the fifth embodiment, the scattering jet mist is shut off by a simple mechanism.

Instead of liquid, gas, air flow, for example, may constitutes this fluid portion covering the washing space.

Embodiment 7.

Figure 13:
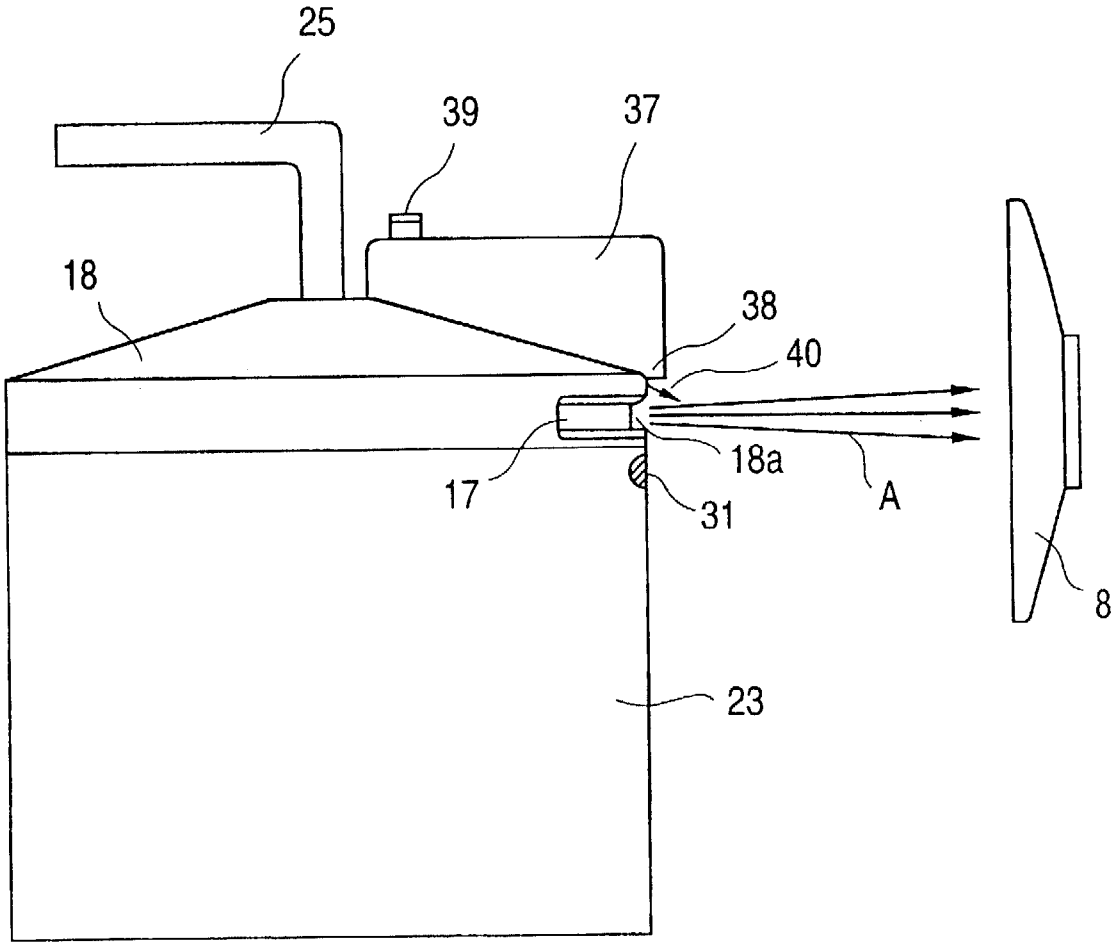
FIG. 13 is a diagram showing a tableware washing apparatus according to a seventh embodiment of the present invention.

FIG. 13 shows a tableware washing apparatus according to a seventh embodiment of the present invention. In FIG. 13, a detergent container 37 contains a liquid or powdered detergent. The detergent container 37, and a detergent discharge aperture 38 comprises a detergent mixing means for mixing fresh water with the detergent supplied from a detergent supplying port 39. The detergent 40 is discharged from the detergent discharge aperture 38.

The tableware washing apparatus constructed in this way mixes the detergent 40 into the jet stream liquid A at the location close to the aperture 18*a*. On this account, a washing effect is enhanced by the power of the detergent in addition to the impact given by the jet stream liquid A. Accordingly, even the dirt heavily clinging to the piece of tableware 8 can be washed down.

After a piece of tableware 8 is cleaned by the jet stream liquid A including detergent, it is recommended to stop supplying detergent, and rinse the piece of tableware 8 with fresh water so as not to contain the detergent for a few seconds.

Embodiment 8.

Figure 14:
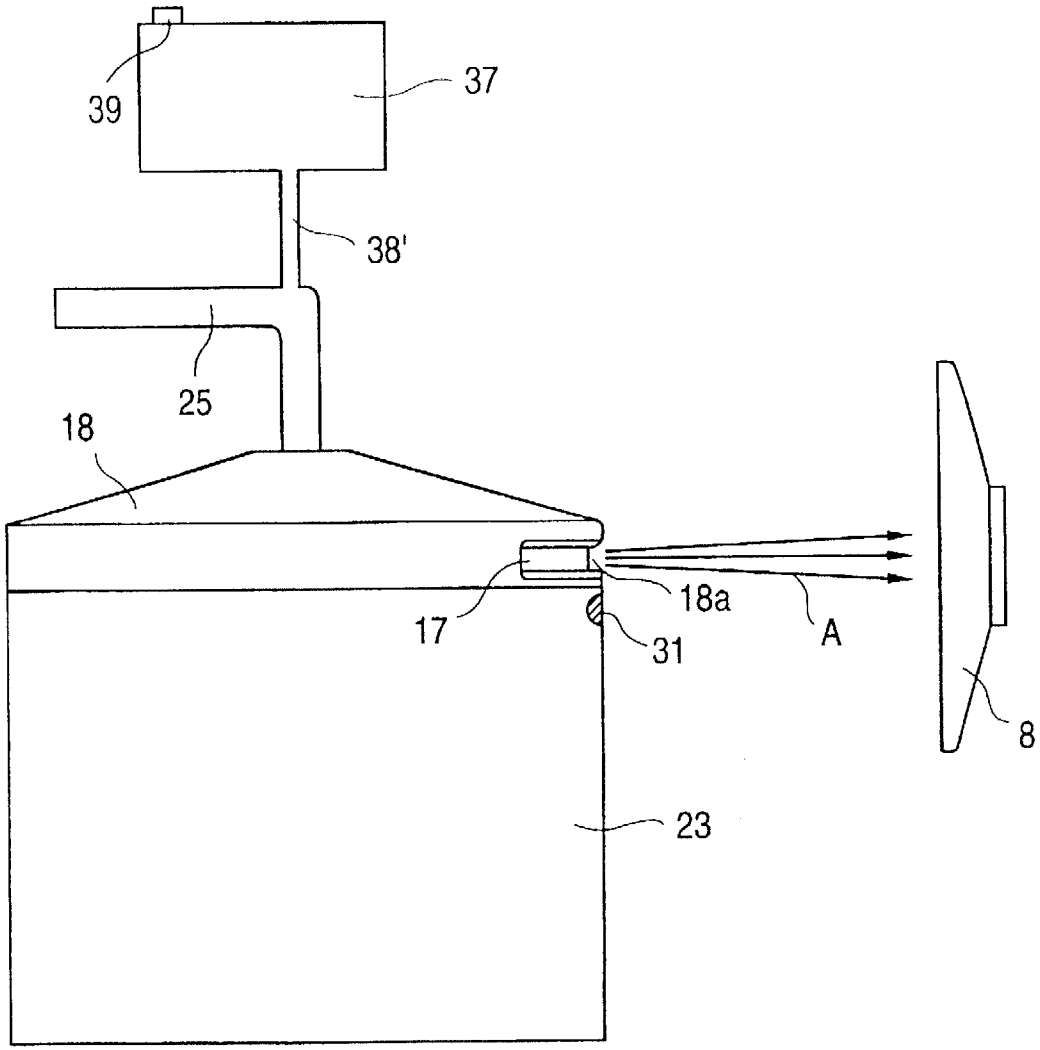
FIG. 14 is a diagram showing a tableware washing apparatus according to an eighth embodiment of the present invention.

FIG. 14 shows a tableware washing apparatus according to an eighth embodiment of the present invention. In the same manner as the seventh embodiment, a detergent mixing means is provided. In this embodiment, the washing apparatus comprises a detergent container 37 for containing a liquid or powdered detergent, and detergent path 38' for mingling a liquid or powdered detergent into the fresh water in the water path 25. A detergent supplying port 39 is provided on the detergent container 37.

According to this embodiment, fresh water is supplied from the water path 25. The detergent stored in the detergent container 37 is mixed from the detergent path 38' before fresh water is flowing into the first cover 18. The fresh water including the detergent flows into the first cover 18. It is accelerated by the disk body 17, and spouted as a jet stream liquid A to the piece of tableware 8 from the aperture 18*a*.

In the same way as the seventh embodiment, a washing effect is enhanced by the power of the detergent in addition to the impact given by the jet stream liquid A. Accordingly, even the dirt heavily clinging to the piece of tableware 8 is washed down.

After a piece of tableware 8 is cleaned by the jet stream liquid A including detergent, it is also recommended in this embodiment too, to stop supplying detergent, and rinse the piece of tableware 8 with fresh water so as not to contain the detergent for a few seconds.

Embodiment 9.

Figure 15:
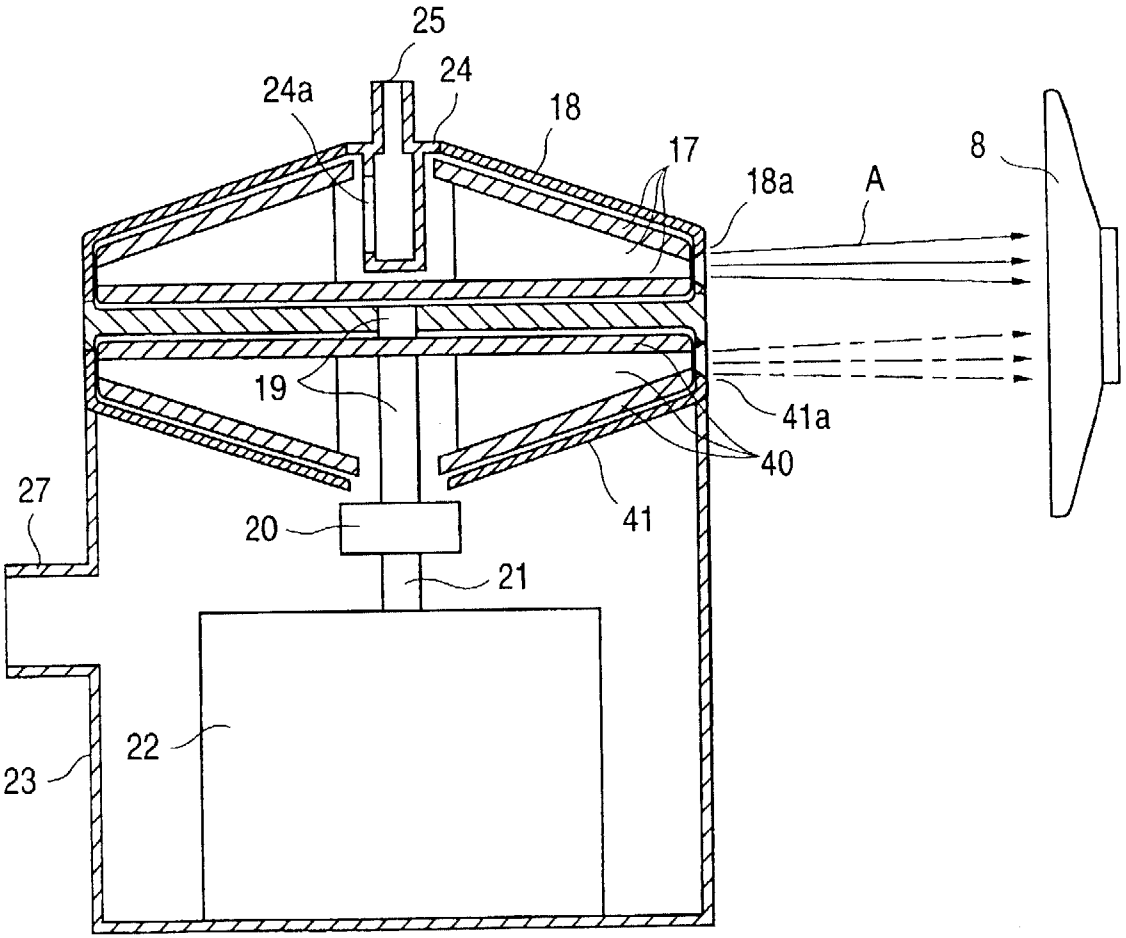
FIG. 15 is a cross sectional view showing a tableware washing apparatus according to a ninth embodiment of the present invention.

FIG. 15 is a cross sectional view showing a tableware washing apparatus according to a ninth embodiment of the present invention. In FIG. 15, a blowing means 40 having blower blades, for example, provided in parallel with the disk body 17. The second cover 41 covers the blower blades 40. A second cover 41 has an aperture 41*a* facing the piece of tableware 8. From this aperture 41*a*, gas, air flow, for example, is spouted to the piece of tableware 8. The blower blades 40 generates air flow with a velocity and a quantity strong enough to blow off the drops of water stuck to the piece of tableware 8, which is spouted to the piece of tableware 8.

The disk body 17 and the blower blades 40 are coupled by a single rotation axis 19 via the rotation axis 21 of the motor 22. The second cover 41 covering the blower blades 40 comprises an aperture 41*a* which air flow from the blower blades 40 passes through, and a pneumatic path 27 for supplying the air to the blower blades 40, which concurrently operates to intercept the fresh water. The end portion of this pneumatic path 27 is exposed to the atmosphere. An air quantity adjustment means is provided anywhere in the pneumatic path 27 for supplying or shutting out the air.

The tableware washing apparatus constructed in the above-mentioned manner spouts out high-speed jet liquid A from the aperture 18*a* of the first cover 18 toward the washing space in front of the aperture 18*a* in the same manner as the first embodiment.

The high-speed jet liquid supplying toward the washing space in front of the aperture 18*a* spouts out toward the piece of tableware 8. The dirt objects stuck to the piece of tableware 8 are washed down by the impact force given by the high-speed jet liquid and the drifting force given by the falling water, and in this manner the piece of tableware 8 is cleaned.

At this time, the water quantity variable valve (not illustrated) is opened for supplying fresh water, while the air quantity variable valve (not illustrated) is closed, which shuts the suction of air to the blower blades 40. When a piece of tableware 8 is washed completely by jet stream liquid, the water quantity variable valve is closed to stop supplying fresh water. Concurrently, the air quantity variable valve is opened to supply the air from the pneumatic path 27 exposed to the atmosphere to the blower blades 40.

The supplied air is exhausted from the aperture 41*a* of the second cover 41 toward the washing space in front of the aperture 41*a*. The air spouted toward the washing space strikes the piece of tableware 8, drifts drops of water stuck to the piece of tableware 8 along its surface to the edge. The exhausted pneumatic power on the edge of the piece of tableware 8 overwhelms the surface tension of water. On this account, drops of water are scattered, and a piece of tableware 8 is dewatered. Some drops of water may be scattered when a piece of tableware 8 is just struck by jet air.

In this way, the dirt stuck to the piece of tableware 8 is washed down by the impact of the hygienic jet stream liquid, and drifted downwards by the water flow. Afterwards, the tableware 8 is dewatered by blowing air to the tableware 8 from the blower blades 40.

In this embodiment, a high-speed jet stream spouting means and a blowing means consisting of the blower blades are coupled by an axis. The disk body and the blower blades are rotated by the same rotating means 21, 22. In this way, a washing apparatus which is of simple construction and small size is obtained.

Embodiment 10.

Figure 16:
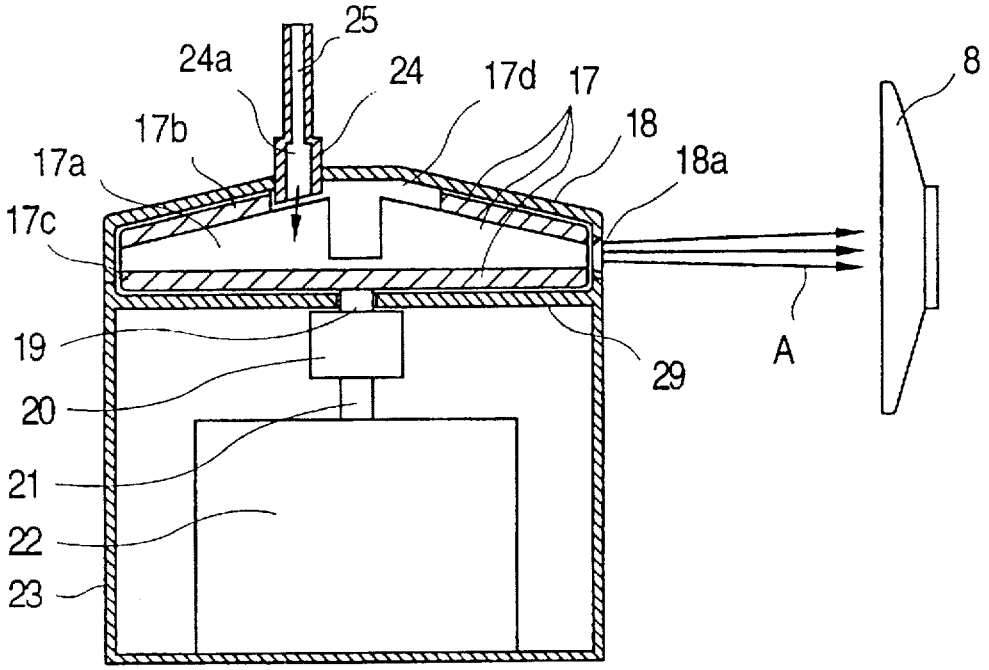
FIG. 16 is a cross sectional view showing a tableware washing apparatus according to a tenth embodiment of the present invention.

FIG. 16 is a cross sectional view showing a tableware washing apparatus according to a tenth embodiment of the present invention. In FIG. 16, the same reference numbers as those in the first embodiment show the same or corresponding portions as those in the first embodiment.

In the same manner as the first embodiment, the fresh water supplying portion 24 is provided at a location close to the aperture 17*d* of the disk body. It shuts off the unnecessary air, when fresh water is supplied to the aperture 17*d* of the disk body. The discharge aperture 24*a* of the fresh water supplying portion 24 is provided to a location close to the central portion of the disk body 17 in the first embodiment. On the other hand, the fresh water is provided at a location close to the side of the disk body 17 in this embodiment, so that fresh water is spouted vertically to the flow on the radial shape flow paths.

In this embodiment, the washing operation is the same as that of the first embodiment. A switch of the motor 22 (not illustrated) is turned on to drive the motor 22. This operation is done before and after placing a piece of tableware 8 in the washing space. When the motor 22 is driven, the disk body 17 starts rotating. Then the fresh water is supplied from water supply via the water path 25 to the fresh water supplying portion 24, and supplied from the discharge aperture 24*a* to the aperture 17*d* in the center of the disk body 17*b*. When receiving a rotation force at the radial shape flow paths consisted of the blades 17*a*, the discs 17*b*, 17*c*, the fresh water is accelerated in the direction of the rotating circumference as well as the rotating periphery of the disk body 17. The fresh water is spouted from the aperture 18*a* of the first cover 18 toward the washing space created in front of the aperture 18*a*.

The high-speed jet liquid supplying toward the washing space in front of the aperture 18*a* of the first cover 18 spouts out toward the piece of tableware 8. The dirt objects stuck to the piece of tableware 8 are washed down by the impact force given by the high-speed jet liquid and the drifting force given by the falling water, and in this manner the piece of tableware 8 is cleaned.

If the fresh water supplying portion 24 is constructed as mentioned in this embodiment, the radial shape flow paths is constructed close to the central portion of the disk body 17. Accordingly, since this extends the section where fresh water is accelerated, a stronger jet stream liquid A can be spouted out from the aperture 18*a*.

According to the rotation mechanism, some structures need to be constructed around the central portion of the disk body 17. In that case, the fresh water supplying portion 24 is arranged close to the side of the disk body 17 to supply fresh water vertically to the flow on the radial shape flow paths, which is able to obtain a jet stream liquid A strong enough for washing using a limited space effectively.

Embodiment 11.

Figure 17:
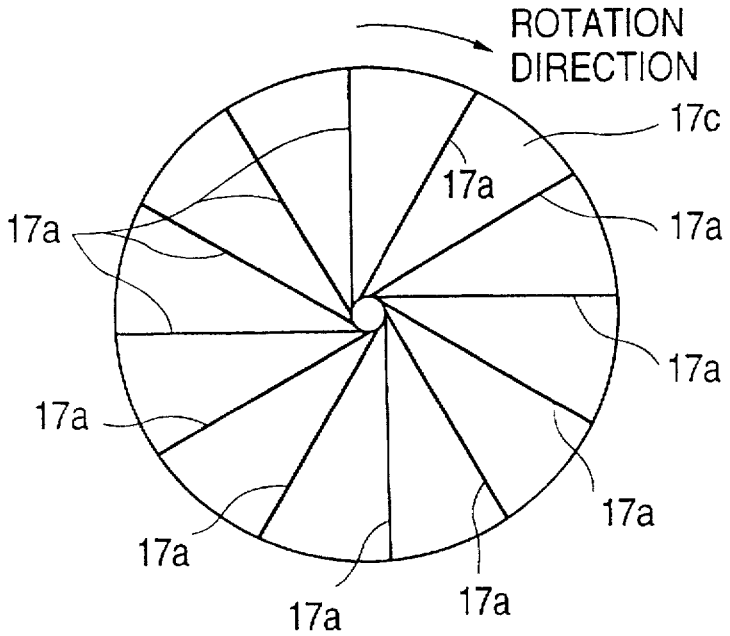
FIG. 17 is a diagram for explaining the disk body according to an eleventh embodiment of the present invention.

FIG. 17 shows a disk body 17 according to an eleventh embodiment of the present invention. FIG. 17 shows the disk body 17 looked at from the top of the disk surface, with the blades 17*a* and the bottom disk 17*c*. In this embodiment, a plurality of blades 17*a* which constitute the flow path walls are provided radially from the center of the disk body 17, and are inclining forward in the direction of the rotation. An arrow in FIG. 17 shows the rotating direction of the disk body 17.

In the same manner as the first embodiment, by inclining the blades forward, namely inclining the flow path wall forward, the velocity of the jet stream liquid is raised and the impact given to the tableware is strengthened. Accordingly, tableware is cleaned in a short time with a small quantity of fresh water, even if heavy dirt is clinging. Moreover, by inclining the blades 17*a* forward, it enables even a small disk body to generate a jet stream liquid strong enough to render a satisfactory washing effect.

According to this embodiment, since the radial shape flow paths are constructed on the central portion of the disk body 17, the section where fresh water is accelerated can be extended. As a result, the velocity of the jet stream liquid is raised.

In this embodiment, the fresh water supplying portion is constructed such as the fresh water is supplied vertically to the flow on the radial shape flow paths, as shown in the tenth embodiment, which is able to supply the fresh water from the discharge aperture into the radial shape flow paths smoothly.

Embodiment 12.

Figure 18:
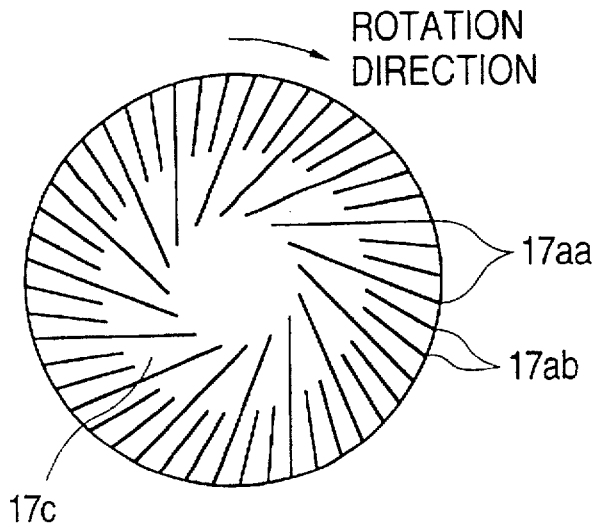
FIG. 18 is a diagram for explaining the disk body according to a twelfth embodiment of the present invention.

FIG. 18 shows a disk body 17 according to a twelfth embodiment of the present invention. FIG. 18 shows the disk body 17 looked at from the top of the disk surface, with the blades 17*aa* and 17*ab* and the bottom disk 17*c*. In this embodiment, a plurality of blades 17*aa* and 17*ab* which constitute the flow path walls are provided radially from the center of the disk body 17, and are inclining forward in the direction of the rotation. An arrow in FIG. 18 shows the rotating direction of the disk body 17.

In the same manner as the first embodiment, by inclining the blades forward, namely inclining the flow path wall forward, the velocity of the jet stream liquid is raised and the impact given to the tableware is strengthened. Accordingly, tableware is cleaned in a short time with a small quantity of fresh water, even if heavy dirt is clinging. Moreover, by inclining the blades 17*aa* and 17*ab* forward, it enables even a small disk body to generate a jet stream liquid strong enough to render a satisfactory washing effect.

According to this embodiment, a plurality of main stream paths are constructed in the central portion by the blades 17*aa* while a plurality of supplementary stream paths more than the main stream paths are constructed by the blades 17*ab*. The fresh water is supplied smoothly since the number of the flow path walls in the peripheral portion is larger than those in the central portion. Accordingly, a jet stream liquid is generated effectively.

Embodiment 13.

Figure 19:
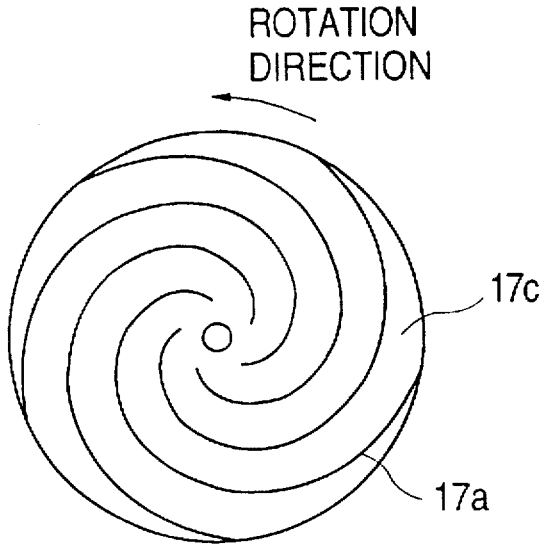
FIG. 19 is a diagram for explaining the disk body according to a thirteenth embodiment of the present invention.

FIG. 19 shows a disk body 17 according to a thirteenth embodiment of the present invention. FIG. 19 shows the disk body 17 looked at from the top of the disk surface, with the blades 17*a* and the bottom disk 17*c*. In this embodiment, a plurality of blades 17*a* which constitute the flow path walls are provided radially from the center of the disk body 17, and are inclining forward with curvature in the direction of the rotation. An arrow in FIG. 19 shows the rotating direction of the disk body 17.

In the same manner as the first embodiment, by inclining the blades forward, namely inclining the flow path wall forward, the velocity of the jet stream liquid is raised and the impact given to the tableware is strengthened. Accordingly, tableware is cleaned in a short time with a small quantity of fresh water, even if heavy dirt is clinging. Moreover, by inclining the blades 17*a* forward, it enables even a small disk body to generate a jet stream liquid strong enough to render a satisfactory washing effect.

The forward inclination angle of the fresh water in the flow paths has a less acute forward inclination angle near the circumferential portion of the disk body 17 than near the portion closer to the center of the disk, in case of the blades inclining forward straightly. In other words, the closer it comes to the circumference of the disk, the less acute the forward inclination angle becomes.

On the other hand, according to this embodiment, the blades are inclining forward with curvature. If each blades is arranged in this way, a certain degree of forward inclination angle is always maintained with regard to the fresh water rotating in the radial shape flow paths. This generates a jet stream liquid effectively, since the speed in the direction of the radius obtained by acceleration of the flow paths is compounded with the speed in the direction of the circumference obtained by the rotation of the disk body 17, while the fresh water passes through the flow paths according to the rotation of the disk body. In this embodiment, the fresh water supplying portion is constructed such as the fresh water is supplied vertically to the flow on the radial shape flow paths, as shown in the tenth embodiment, which is able to supply the fresh water from the discharge aperture into the radial shape flow paths smoothly.

Embodiment 14.

Figure 20A:
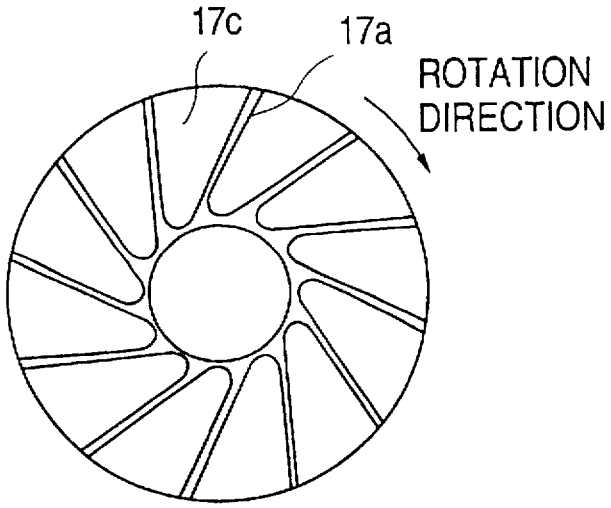
FIGS. 20A and 20B are a diagram for explaining the disk body according to a fourteenth embodiment of the present invention.
Figure 20B:
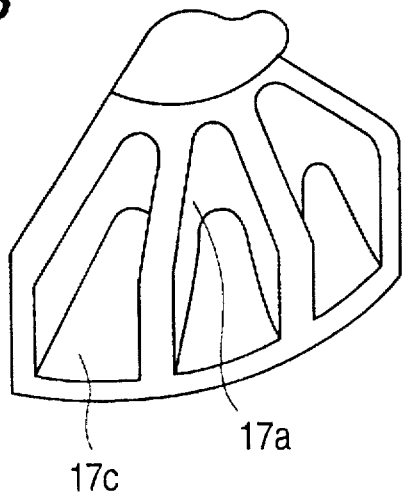

FIGS. 20A and 20B show a disk body 17 according to a fourteenth embodiment of the present invention. FIG. 20A shows the disk body 17 looked at from the top of the disk surface, with the blades 17*a* and the bottom disk 17*c*. FIG. 20B shows a portion of the disk body 17 looked at obliquely. In this embodiment, a plurality of blades 17*a* which constitute the flow path walls are provided radially from the center of the disk body 17, and are inclining forward in the direction of the rotation. An arrow in FIG. 20*a* shows the rotating direction of the disk body 17.

In the same manner as the first embodiment, by inclining the blades forward, namely inclining the flow path wall forward, the velocity of the jet stream liquid is raised and the impact given to the tableware is strengthened. Accordingly, tableware is cleaned in a short time with a small quantity of fresh water, even if heavy dirt is clinging. Moreover, by inclining the blades 17*a* forward, it enables even a small disk body to generate a jet stream liquid strong enough to render a satisfactory washing effect.

The fresh water supplying portion used in this embodiment supplies fresh water vertically to the direction of the flow on the radial shape flow paths as the tenth embodiment. It is possible to arrange an axis in its central portion.

Embodiment 15.

Figure 21:
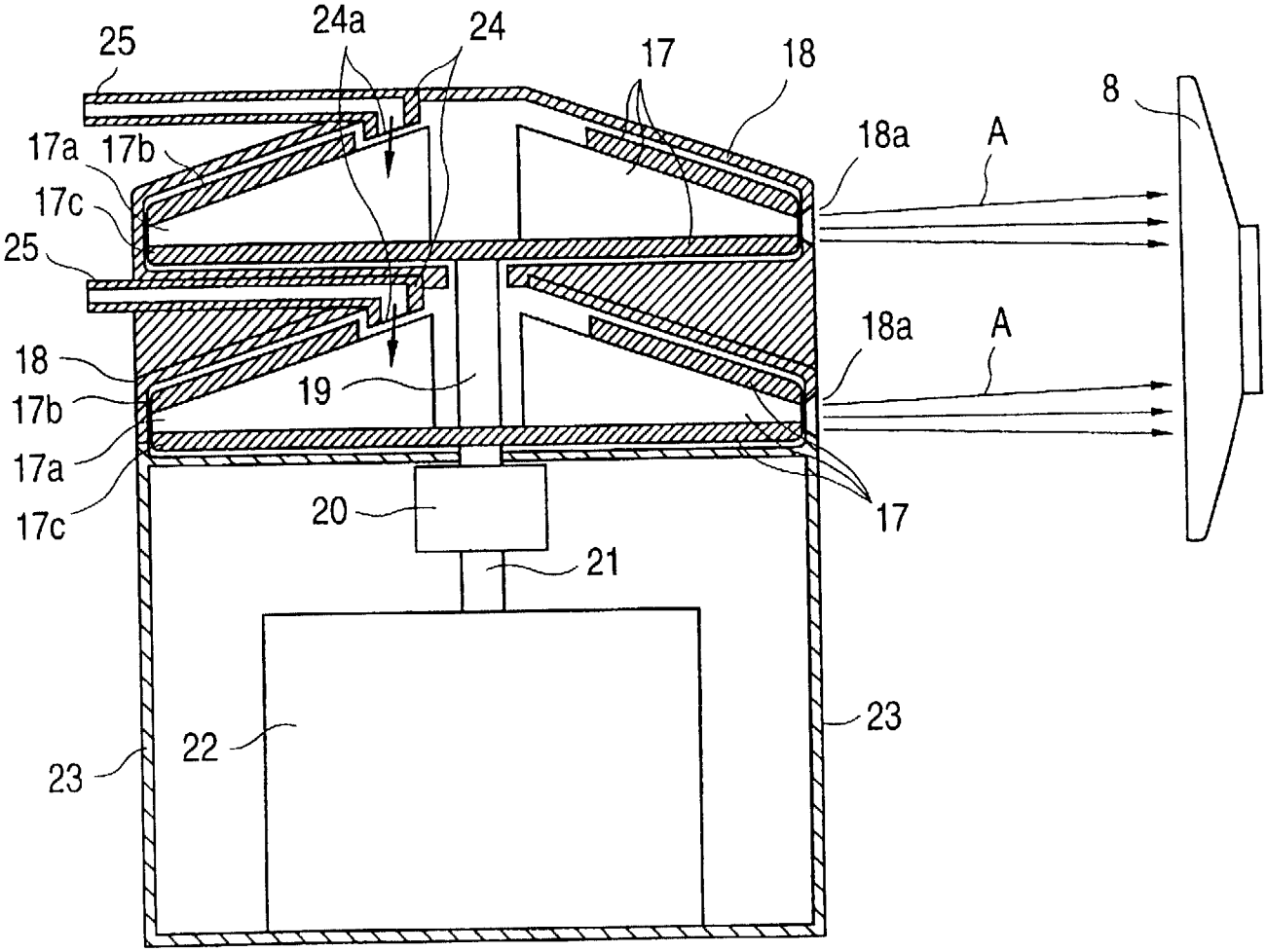
FIG. 21 is a cross sectional view showing a tableware washing apparatus according to a fifteenth embodiment of the present invention.

FIG. 21 is a cross sectional view showing a tableware washing apparatus according to a fifteenth embodiment of the present invention. In FIG. 21, the same reference numbers as those in the first embodiment show the same or corresponding portions as those in the first embodiment.

In this embodiment, two disk bodies 17, for example, having a plurality of radial shape flow paths, are provided in parallel in the direction of the rotation axis as a high-speed jet stream spouting means. Each discharge aperture 24*a* is arranged at the radial shape flow paths of each disk body 17 to supply the fresh water from the fresh water supplying means 25 via the fresh water supplying portion 24.

In this embodiment, even though the washing apparatus operates in the same manner as the first embodiment, a large amount of high-speed jet liquid is obtained widely from the two apertures 18*a*, since a plurality of disk bodies 17 are arranged. The dirt stuck to the piece of tableware 8 is washed down by the impact given by the high-speed jet liquid and the drifting force by the falling water, and in this manner the piece of tableware 8 is cleaned in a short time. Accordingly, it is possible to wash a large washing object.

This embodiment arranges two fresh water supplying means 25 which supply the fresh water from each fresh water supplying means 25 to the respective radial shape flow paths of the two disk bodies 17. But the washing apparatus can be constructed so that fresh water is supplied from a single fresh water supplying means 25 to the radial shape flow paths of the two disc bodies 17. For example, a penetration aperture is arranged on the first cover 18 separating the two disk bodies 17 so that fresh water is supplied from the disk body 17 of the top layer to the disc body 17 of the bottom layer to use the fresh water effectively as washing liquid. It is also possible to arrange more than two disk bodies 17 in the washing apparatus.

Embodiment 16.

Figure 22:
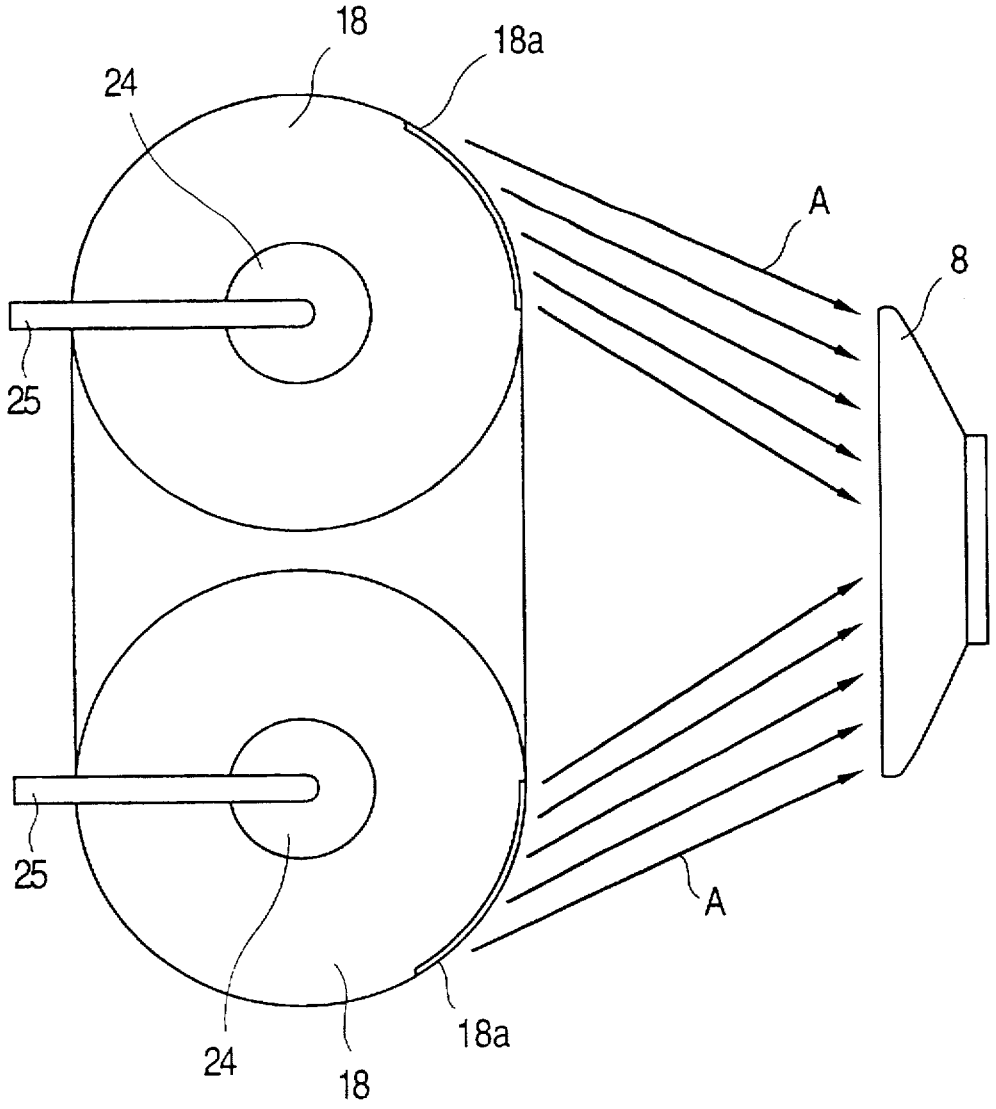
FIG. 22 is a top view showing a tableware washing apparatus according to a sixteenth embodiment of the present invention.

FIG. 22 is a top view showing a tableware washing apparatus according to a sixteenth embodiment of the present invention. In FIG. 22, the same reference numbers as those in the first embodiment show the same or corresponding portions as those in the first embodiment.

In this embodiment, two disk bodies 17, for example, having a plurality of radial shape flow paths are provided in parallel in the direction of the radius as high-speed jet stream spouting means. A discharge aperture (not shown in the figure) is arranged to the radial shape flow paths of each disk body 17 which supplies fresh water from the fresh water supplying means 25 via the fresh water supplying portion 24.

In this embodiment, although the washing apparatus operates in the same manner as the first embodiment, a large amount of high-speed jet liquid is obtained from the two apertures 18*a*, since a plurality of disk bodies 17 are provided. The dirt stuck to the piece of tableware 8 is washed down by the impact given by the high-speed jet liquid and the drifting force by the falling water, and in this manner the piece of tableware 8 is cleaned in a short time.

If the washing apparatus is constructed as mentioned, it is possible to secure the washing space widely for washing a big washing object.

It is also possible to provide the washing apparatus with more than two disk bodies 17.

Embodiment 17.

Figure 23:
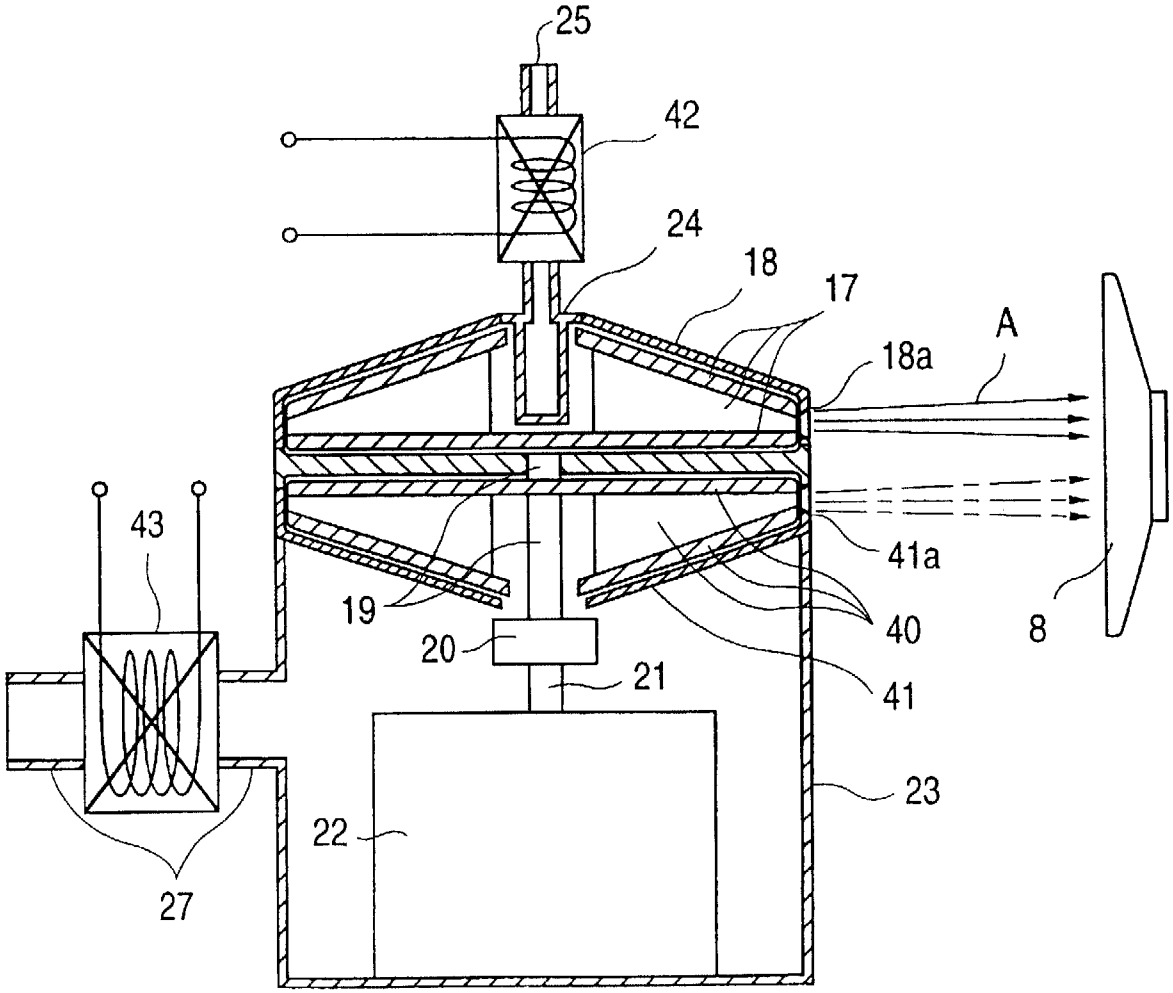
FIG. 23 is a cross sectional view showing tableware washing apparatus according to a seventeenth embodiment of this invention.

FIG. 23 is a cross sectional view showing tableware washing apparatus according to a seventeenth embodiment of this invention. In FIG. 23, the same reference numbers as those in the first embodiment show the same or corresponding portions as those in the first embodiment. In FIG. 23, a blowing means 40 for sending gas is comprised of a plurality of blower blades for sending air, for example. An aperture 41*a* is arranged to the second cover 41 which air flow from the blower blades 40 passes through. Washing liquid heating means 42 comprises a heater, for example, for heating the fresh water which is spouted to the piece of tableware 8. A gas heating means 43 comprises a heater, for example, for heating the air which is spouted to the piece of tableware 8.

The blower blades 40 generates air flow having a velocity and a quantity enough to blow off drops of water stuck to the piece of tableware 8, and spouts it to the piece of tableware 8. This blower blades 40 is arranged in parallel with the disk body 17. The disk body 17 and the blower blades 40 are coupled to the motor 22 by a single rotation axis 19.

An air adjusting means (not illustrated) is provided so that air is supplied or shut off to the blower blades 40. This air introduction and shutoff are concurrently carry out with respective introduction and shutoff of the fresh water to the disk body 17. A pneumatic path 27 comprises a gas supplying means, and its end portion is exposed to the atmosphere. A heater 43 is constructed so that this pneumatic path 27 is covered, which heats the air passing inside the pneumatic path 27. The heated air is exhausted from the aperture 41*a*. In the same manner, a heater 42 is constructed so that a water path 25 is covered, which supplies the heated water from the aperture 18*a*.

The tableware washing apparatus constructed in the above-mentioned manner spouts out high-speed jet liquid A from the aperture 18*a* toward the washing space by means of the disk body 17, in the same manner as the first embodiment. This high-speed jet liquid A strikes the piece of tableware 8. The dirt stuck to the piece of tableware 8 is washed down by the impact given by the high-speed jet liquid and the drifting force by the falling water, and in this manner the piece of tableware 8 is cleaned.

After the washing is completed, the high-speed air spouted from the aperture 41*a* by means of the blower blades 40 toward the washing space strikes the piece of tableware 8. By this air function, the piece of tableware 8 is dewatered. According to this embodiment, the time for dewatering the table ware 8 is reduced by enhancing the drying effect by using the heated air blown toward the piece of tableware 8.

In this embodiment, the heaters 42, 43 are provided with the water and pneumatic paths 25, 27 respectively. However, the both heaters are not necessarily provided with. It is possible to provide a heater with any one of the paths. In case the configuration in which the two paths are arranged to be in parallel, both the fresh water and the air are heated using a single heater.

Fresh water or air is not necessarily heated in the supplying paths. They can be heated anywhere before they are spouted from the aperture 18*a*, 41*a*, respectively.

Embodiment 18.

Figure 24:
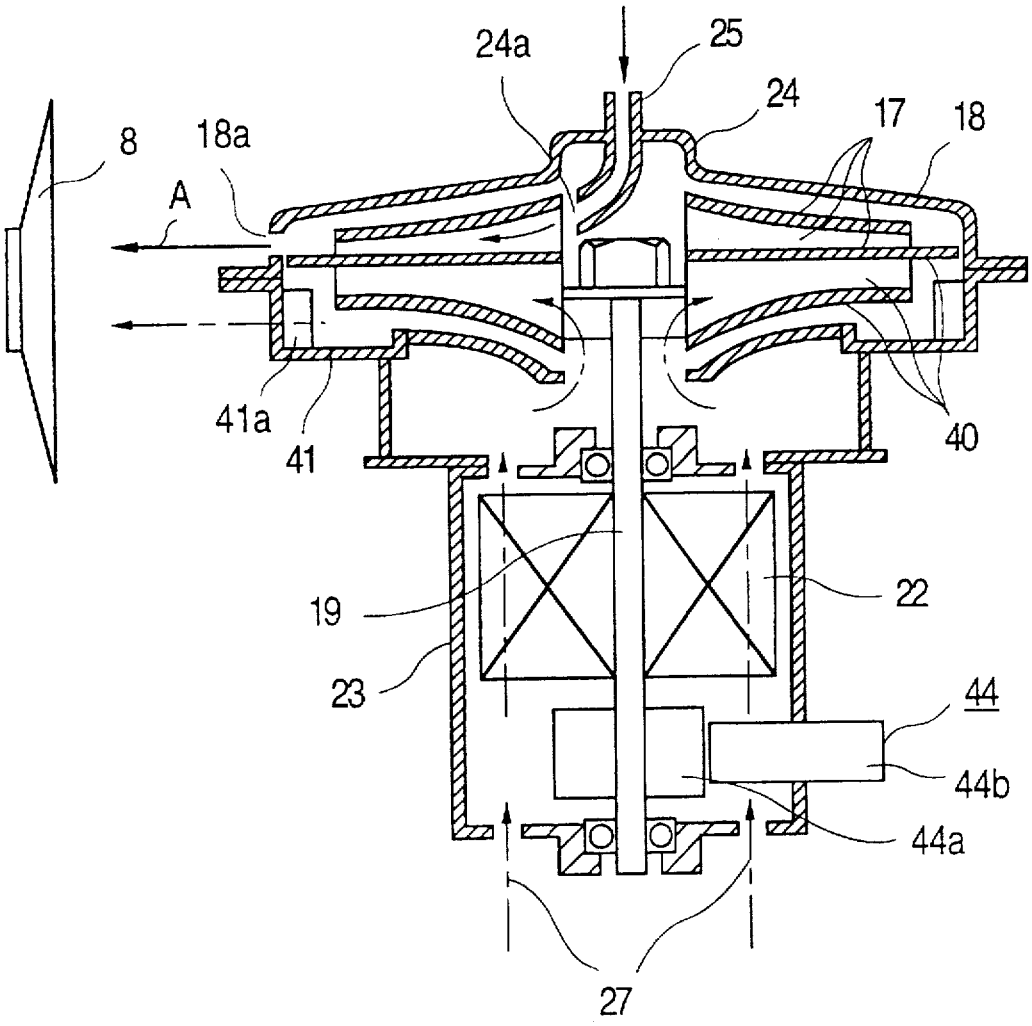
FIG. 24 is a cross sectional view showing tableware washing apparatus according to an eighteenth embodiment of this invention.
Figure 25:
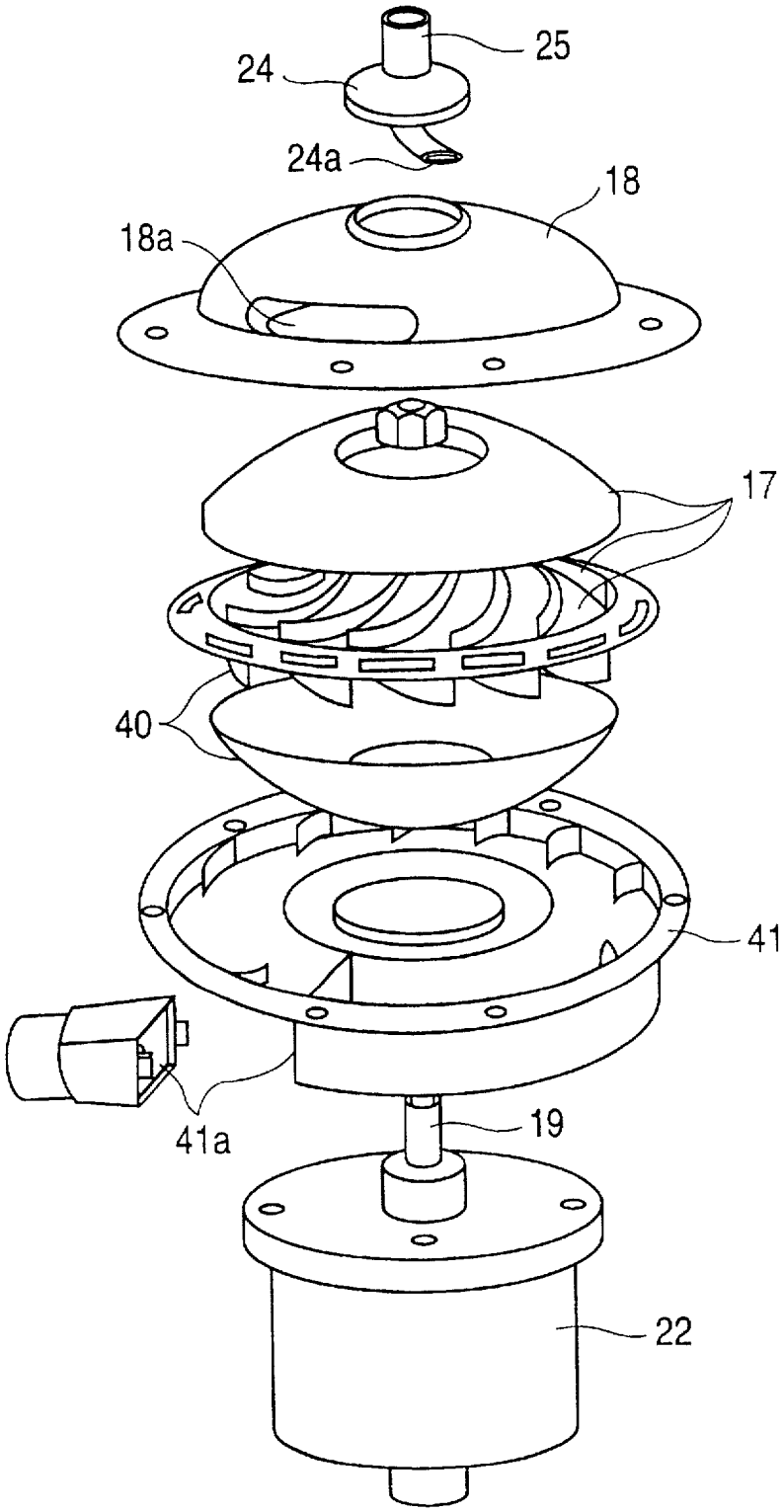
FIG. 25 is a perspective view showing each parts of the washing apparatus looked at obliquely according to the eighteenth embodiment of this invention.

FIG. 24 is a cross sectional view showing tableware washing apparatus according to an eighteenth embodiment of this invention. FIG. 25 shows each parts of the washing apparatus looked at obliquely. In FIGS. 24 and 25, the same reference numbers as those in the first embodiment show the same or corresponding portions as those in the first embodiment. In this embodiment, blower blades 40 are provided as a blowing means with the disk body 17 and a high-speed jet stream spouting means. The blower blades 40 generates air flow with a velocity and a quantity enough to blow off the drops of water stuck to the piece of tableware 8, and spouts it to the piece of tableware 8.

The disk body 17 having a plurality of radial shape flow paths and the blower blades 40 are provided respectively on each side of a single disk body, and coupled with the motor 22 by means of a single rotation axis 19.

In FIG. 24, a rotation speed detecting means 44 detects the rotation speed of the disk body 17, the blower blades 40 and the motor rotation axis 19. For example, a rotating body 44*a* is installed on the rotation axis 19, and the reflection coefficient of light on its side portion is partially changed. A photoelectric type rotation detector 44*b* is provided, facing this rotating body 44*a* to detect a change of the reflection light thereon for measuring the rotation speed. As an alternative rotation speed detecting means 44, a rotating body 44*a* is replaced by a gear made of magnetic body, and the photoelectric type rotation detector 44*b* is replaced by an electromagnetic type rotation detector 44*b*.

The tableware washing apparatus constructed as mentioned spouts out high-speed jet liquid from the aperture 18*a* of the first cover 18 toward the washing space, in the same manner as the first embodiment. This high-speed jet liquid strikes the piece of tableware 8. The dirt stuck to the piece of tableware 8 is washed down by the impact given by the high-speed jet liquid and the drifting force by the falling water, and in this manner the piece of tableware 8 is cleaned. At this time, the water quantity variable valve (not illustrated) is opened for supplying fresh water, while the air quantity variable valve (not illustrated) is closed, which shuts off the suction of air to the blower blades 40.

The rotation of the motor is controlled to an appropriate speed for supplying a jet stream liquid by detecting the rotation speed of the disk body 17 and the motor rotation axis 19 by the rotation speed detecting means 44 while the washing apparatus is supplying a jet stream liquid. In this embodiment, the number of rotation is controlled to be around 10,000 rpm, for example.

When a piece of tableware 8 is washed completely by jet stream liquid, the water quantity variable valve is closed to stop supplying fresh water. Concurrently, the air quantity variable valve is opened to supply air to the blower blades 40 from the pneumatic path exposed to the atmosphere. The supplied air is spouted to the washing space from the aperture 41*a* of the second cover 41. The air spouted toward the washing space strikes the piece of tableware 8, drifts drops of water stuck to the piece of tableware 8 along its surface to the edge. The spouted pneumatic power on the edge of the piece of tableware 8 overwhelms the surface tension of water. On this account, drops of water is scattered, and a piece of tableware 8 is dewatered. Some drops of water may be scattered when just struck by jet air.

The rotation speed detecting means 44 detects the rotation speed of the blower blades 40 and the motor rotation axis 19 during sending air, and it is possible to control the rotation of the motor to an appropriate speed for sending air. For example, in this embodiment, the rotation speed is controlled to be less than 30,000 rpm.

In this way, the dirt stuck to the piece of tableware 8 is washed down by the impact of the hygienic jet stream liquid, and drifted downwards by the water flow. Accordingly, a washing operation is completed in a short time. After these processing is completed, the tableware 8 is dewatered by blowing air toward the piece of tableware 8 from the blowing means.

According to this embodiment, the rotation speed detecting means 44 detects the rotation speed of the disc body 17, the blower blades 40, and the motor rotation axis 21. Since respective rotation speed of the rotating object 17 and the blower blades 40 are detectable during blowing the air, the rotation of the motor is controlled so that the rotating speed is to be appropriate for supplying a jet stream liquid and sending air. The rotating axis of the blower blades 40 is constructed so that it has the same axis as that of the disk body 17, and also coupled with the rotation axis 21 of the motor 22. It is not necessary therefore, to provide a separate motor nor a separate rotation axis for respective blower blades 40 and the disk body 17. Accordingly, this makes the configuration of the washing apparatus simple, and then a compact washing apparatus using less number of parts is obtained.

Embodiment 19.

Figure 26:
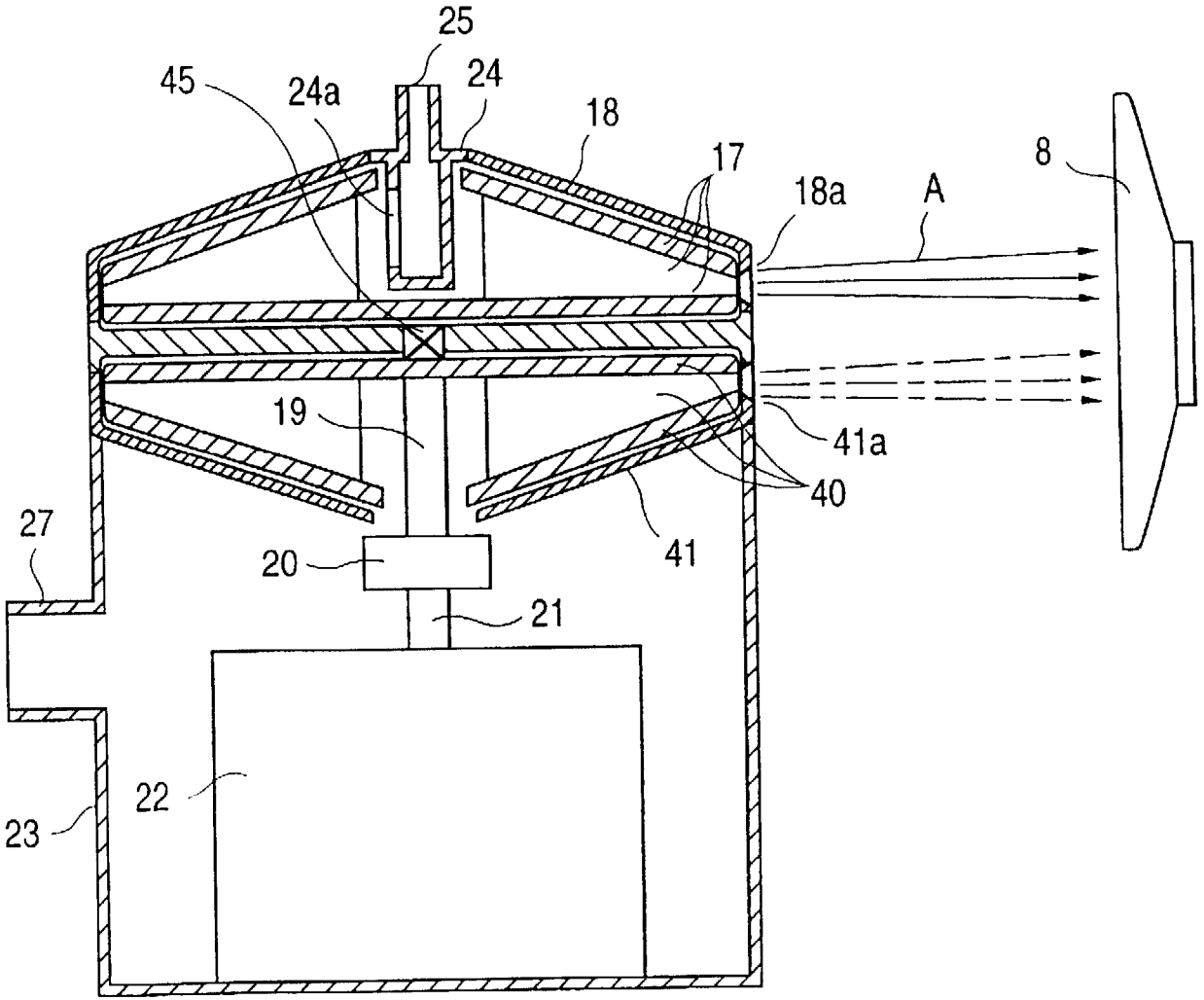
FIG. 26 is a cross sectional view showing tableware washing apparatus according to a nineteenth embodiment of the present invention.

FIG. 26 is a cross sectional view showing a tableware washing apparatus according to a nineteenth embodiment of the present invention. In FIG. 26, the same reference numbers as those in the first embodiment show the same or corresponding portions as those in the first embodiment. In the figure, a clutch 45 is provided to make the rotation axis of the blower blades 40 and that of the disk body 17 removable.

The tableware washing apparatus constructed as mentioned spouts out high-speed jet liquid from the aperture 18*a* of the first cover 18 toward the washing space, in the same manner as the eighteenth embodiment. This high-speed jet liquid strikes the piece of tableware 8 . The dirt stuck to the piece of tableware 8 is washed down by the impact given by the high-speed jet liquid and the drifting force by the falling water, and in this manner the piece of tableware 8 is cleaned. At this time, the water quantity variable valve (not illustrated) is opened for supplying fresh water, while the air quantity variable valve (not illustrated) is closed, which shuts off the suction of air to the blower blades 40.

At this time, the rotation axis of the blower blades 40 and that of the disk body 17 is connected with each other by means of the clutch 45.

When a piece of tableware 8 is washed completely by jet stream liquid, the rotation axis of the blower blades 40 and that of the disk body 17 are separated from each other by means of the clutch 45. Concurrently, the air quantity variable valve is opened to supply air to the blower blades 40 from the pneumatic path exposed to the atmosphere. The supplied air is spouted to the washing space from the aperture 41*a* of the second cover 41. The air spouted toward the washing space strikes the piece of tableware 8, drifts drops of water stuck to the piece of tableware 8 along its surface to the edge. The spouted pneumatic power on the edge of the piece of tableware 8 overwhelms the surface tension of water. On this account, drops of water is scattered, and a piece of tableware 8 is dewatered. Some drops of water may be scattered when just struck by jet air.

In this way, the dirt stuck to the piece of tableware 8 is washed down by the impact of the hygienic jet stream liquid, and drifted downwards by the water flow. Accordingly, a washing operation is completed in a short time. After these processing is completed, the tableware 8 is dewatered by blowing air toward the piece of tableware 8 from the blowing means.

According to the eighteenth embodiment, the rotating axis of the blower blades 40 is constructed so that it has the same axis as that of the disk body 17, and also coupled with the rotation axis 21 of the motor 22. Accordingly, both fresh water and air are supplied always because both the blower blades 40 and the disk body 17 are rotating during both the washing operation and the drying operation. On the other hand, the rotation axis of the blower blades 40 and that of the disk body 17 are made removable by means of the clutch 45 in this embodiment. Accordingly, both the blower blades 40 and the disk body 17 are rotating during the washing operation, while only the blower blade 40 is rotating during the drying operation. In general, the rotating speed around 10,000 rpm is necessary for washing, while the rotation speed less than 30,000 rpm is necessary for drying. If the disk body 17 is separated during drying, it reduces the load to the motor 22, and makes its rotation efficient.

The clutch 45 may be any configuration as long as it makes the rotating axes removable. For example, it may be a magnetic clutch which carries out the connection and the cutoff by means of electromagnetic force.

It is also possible to make the rotation axis of the blower blades 40 and that of the disk body 17 removable from the rotation axis 21 of the motor 22 so that the rotation axis 21 of the motor 22 is connected with the rotation axis of either the blower blades 40, or the disk body 17, when it becomes necessary, which reduces the load of the motor 22 during washing.

Embodiment 20.

Figure 27:
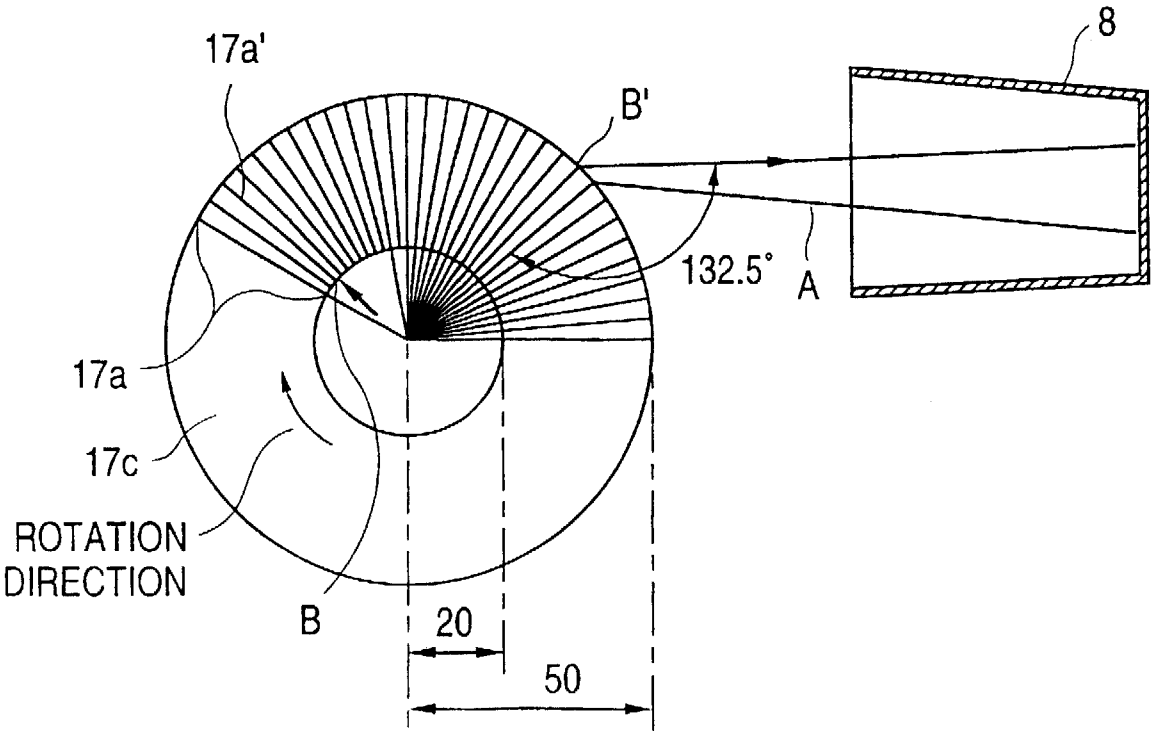
FIG. 27 is a diagram for explaining the disk body 17 according to a twentieth embodiment of the present invention.

FIG. 27 shows a disk body 17 according to a twentieth embodiment of the present invention. In FIG. 27, the same reference numbers as those in the first embodiment show the same or corresponding portions as those in the first embodiment. FIG. 27 shows the disk body 17 looked at from the top of the disk surface, with the radially arranged blades 17*a* and the bottom disk 17*c*. The diameter of the disk body 17 is 100 mm and the blades 17*a* are provided from 20 mm off the center of the disk along with the direction of the radius. Although the blades 17*a* are provided all over the circumference of the bottom disk 17*c*, only a portion of them is shown in FIG. 27.

If the direction of the rotation is clockwise, the fresh water supplied on the point B is accelerated, when the flow path wall, namely the blade 17*a*, comes to contact with the fresh water. The fresh water rotates approximately 90 degrees along with the flow path wall, i.e. the blades 17*a*', and is spouted out from the point B'. The fresh water is spouted in the direction approximately 132.5 degrees deviated from the normal line connecting the center of the disk body and the fresh water supplying point. The spatial relationship between the supplying point B and the spouting point B' of fresh water as well as the direction of supplying fresh water is decided according to the equations mentioned in the first embodiment, taking into account the shape of the blades which constitutes a disk radius as well as a flow path wall, and the supplying point of fresh water.

In this embodiment, since fresh water is supplied only to the point B, which is 20 mm off the center of the disk, fresh water is spouted out from the limited range B' of the circumference of the disk. The jet stream liquid A spouted out makes a sector with a relatively narrow angle. Accordingly, it is suitable for washing the bottom of a piece of tableware 8 like a glass, which has a large depth. The aperture 18*a* of the first cover 18 may be arranged at the range where the jet stream liquid passes through. In other words, the aperture is arranged near the portion B' on the circumference of the disk.

Embodiment 21.

Figure 28:
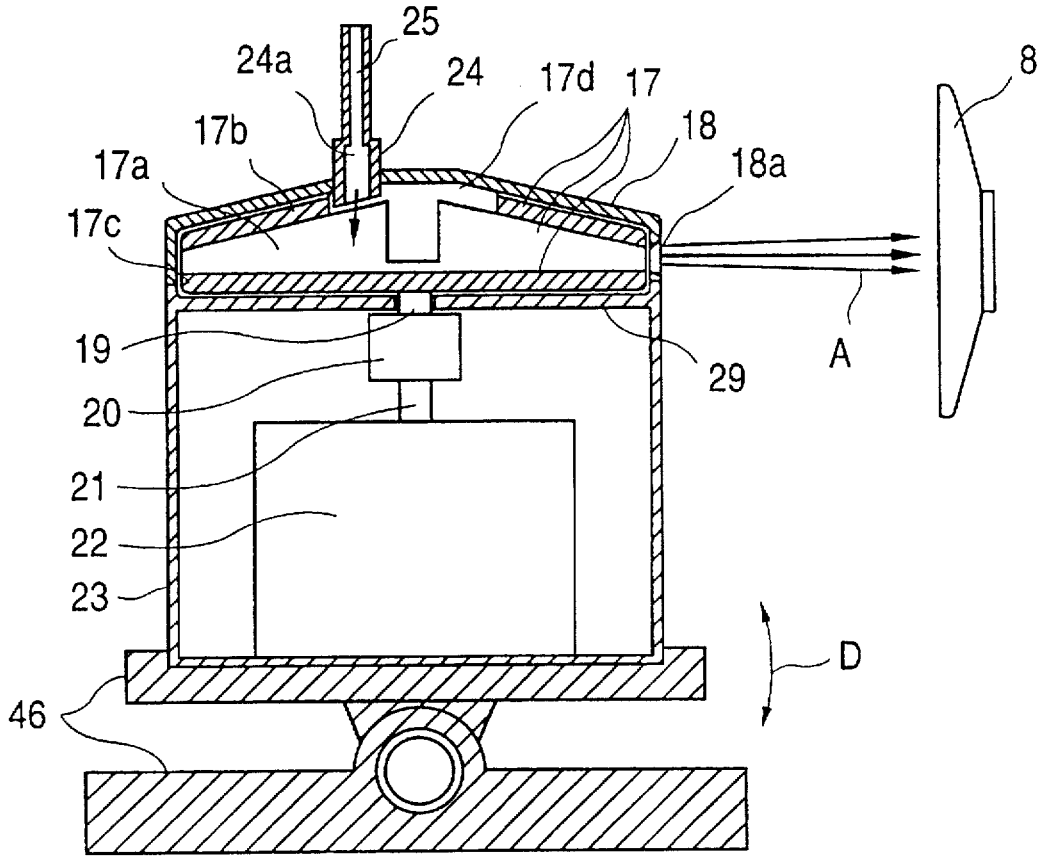
FIG. 28 is a cross sectional view showing tableware washing apparatus according to a twenty first embodiment of the present invention.

FIG. 28 is a cross sectional view showing tableware washing apparatus according to a twenty first embodiment of the present invention. In FIG. 28, the same reference numbers as those in the first embodiment show the same or corresponding portions as those in the first embodiment. A jet stream rocking means 46 changes the area where fluid spouts out from the aperture 18*a* to the washing object, namely the piece of tableware 8. In this embodiment, the jet stream rocking means 46 comprises a jet stream rocking means for rocking the high-speed jet liquid and air flow spouted from the main frame of the washing apparatus. This jet stream rocking means 46 puts the main frame on the apparatus, and nods up and down in the direction D.

The area available as a washing space is extended if the main body of the washing apparatus is rocked in the direction D (up and downwards) by the jet stream rocking means 46 during washing. If the amplitude of rock is around 8 cm, for example, a plate of approximately 14 cm in diameter can be washable by the washing apparatus. The dirt stuck to the piece of tableware 8 is washed down by the impact of the hygienic, widely-spreading jet stream liquid, and drifted downwards by the water flow. Accordingly, a washing operation is completed in a short time.

After these processing is completed, the tableware 8 is dewatered by rocking the main body of the washing apparatus by the jet stream rocking means 46 in the direction D. Accordingly, the dewatering time is reduced by widely blowing the air flow from the blowing means toward the tableware.

Moreover, it does not take the trouble to put the tableware held by the hand of the user thoroughly to the jet stream liquid as well as air flow. Accordingly, this reduces the operation for moving the plate in the washing, and makes the washing apparatus easier to use.

Embodiment 22.

Figure 29:
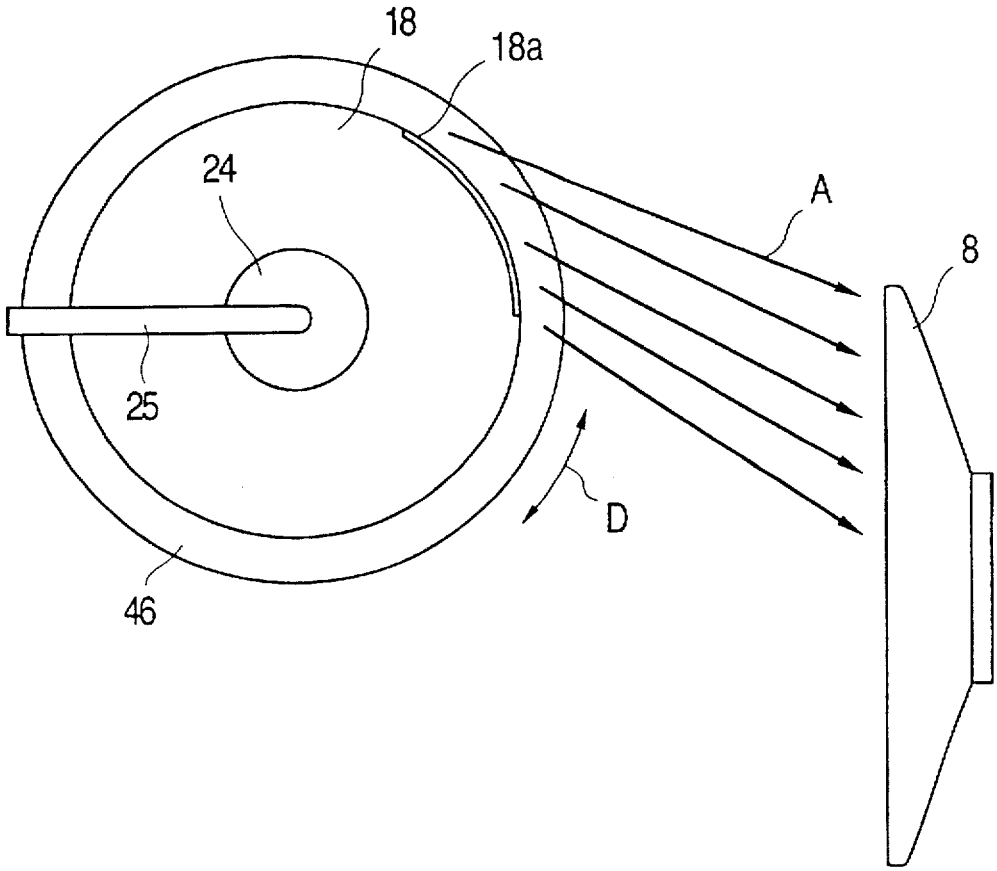
FIG. 29 is a top view showing a tableware washing apparatus according to a twenty second embodiment of the present invention.

FIG. 29 is a top view showing a tableware washing apparatus according to a twenty second embodiment of the present invention. In FIG. 29, the same reference numbers as those in the first embodiment show the same or corresponding portions as those in the first embodiment.

The jet stream rocking means 46 is constructed so that high-speed jet liquid from the main frame of the washing apparatus and air flow are rocked in the direction D. The jet stream rocking means, for example, puts the main frame of the apparatus thereon, and horizontally rotating the main frame forward and backward.

The area available as a washing space is extended if the main body of the washing apparatus is rocked during washing in the direction D (up and downwards) by the jet stream rocking means 46. The dirt stuck to the piece of tableware 8 is washed down by the impact of the hygienic, widely-spreading jet stream liquid, and drifted downwards by the water flow. Accordingly, a washing operation is completed in a short time.

After these processing is completed, the tableware 8 is dewatered by rocking the main body of the washing apparatus by the jet stream rocking means 46 in the direction D. Accordingly, the dewatering time is reduced by widely blowing the air flow from the blowing means toward the tableware.

Moreover, it does not take the trouble to put the tableware held by the hand of the user thoroughly to the jet stream liquid as well as air flow. Accordingly, this reduces the operation for moving the plate in the washing, and makes the washing apparatus easier to use.

The jet stream liquid and air flow can be spouted more widely, if the twenty first embodiment and the twenty second embodiment are combined.

Embodiment 23.

Figure 30:
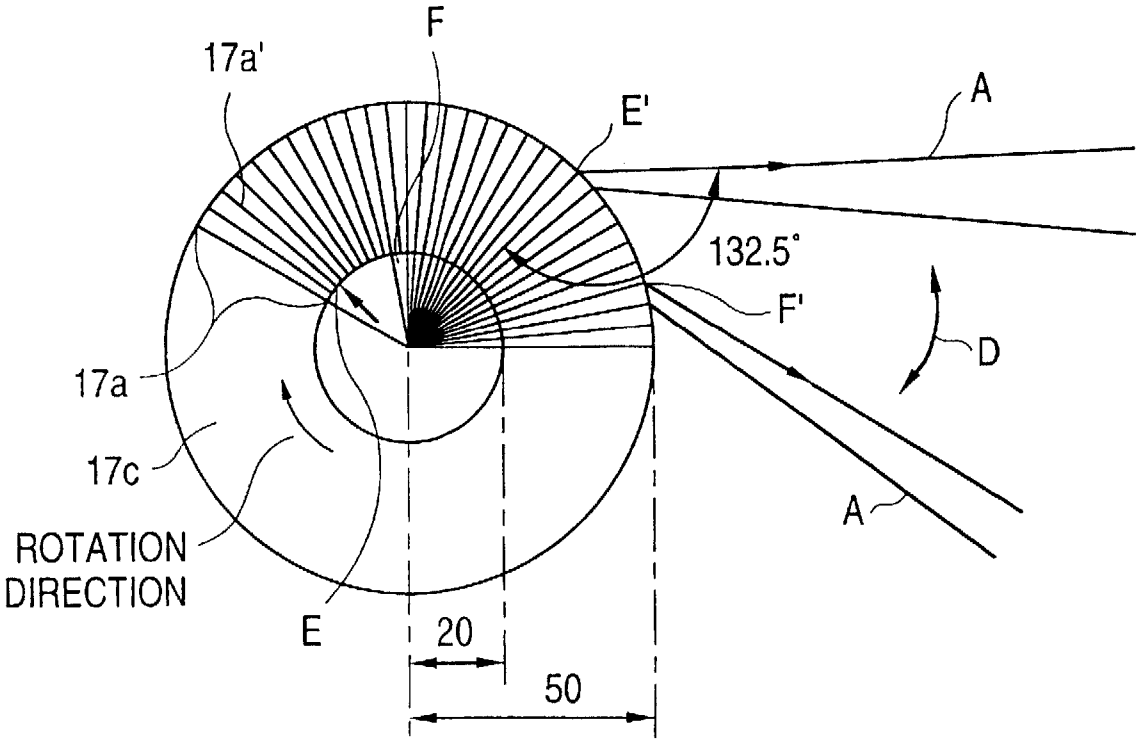
FIG. 30 is a diagram for explaining the operation of the disk body according to a twenty third embodiment of the present invention.

FIG. 30 shows an operation of the disk body used in the tableware washing apparatus according to a twenty third embodiment of the present invention. This embodiment shows another example of washing apparatus comprised so that the high-speed jet liquid and the air flow spouting out from the main frame of the washing apparatus is rocked in the direction D. By changing the supplying point when supplying fresh water into the radial shape flow paths of the disc body 17, a jet stream rocking means of this embodiment changes the area on the tableware toward which fresh water is spouted out from the aperture.

In FIG. 30, the same reference numbers as those in the first embodiment show the same or corresponding portions as those in the first embodiment. FIG. 30 shows the disk body 17 looked at from the top of the disk surface, with the radially arranged blades 17*a* and the bottom disk 17*c*. The diameter of the disk body 17 is 100 mm and the blades 17*a* are provided from 20 mm off the center of the disk along with the direction of the radius. Although, the blades 17*a* are provided all over the circumference of the bottom disk 17*c*, only a portion of them is shown in FIG. 30.

If the direction of the rotation is clockwise, the fresh water supplied on the point E is accelerated, when the flow path walls, namely the blades 17*a*', starts rotating and come to contact with fresh water. The fresh water rotates approximately 90 degrees along with the flow path walls, i.e. the blades 17*a*', and spouted out from the point E'. The fresh water is spouted in the direction approximately 132.5 degrees deviated from the normal line connecting the center of the disk body and the fresh water supplying point. The spatial relationship between the supplying point and the spouting point of fresh water as well as the direction of supplying fresh water depends on the radius of the disk 17*c*, the shape of the blades 17*a* which constitutes a flow path wall, and the supplying point of fresh water. Since fresh water is supplied only to the point E, which is 20 mm off the center of the disk 17*c*, fresh water is spouted out from the limited range E' of the circumference of the disk.

If the fresh water supplying portion shifts from the point E to the point F, the spouting point of fresh water also shifts from E' to F'. If the fresh water supplying portion rocks within the range from the point E to the point F by the forward-backward movement, the spouting point of the high-speed jet liquid rocks within the range from the point E' and to the point F'. Accordingly, the jet stream liquid can be rocked in the direction D using a jet stream rocking means which changes the fresh water supplying portion, which extends the area available as the washing space. The dirt stuck to the piece of tableware 8 is washed down by the impact of the hygienic, widely-spreading jet stream liquid, and drifted downwards by the water flow. Accordingly, a washing operation is completed in a short time.

After these processing is completed, the tableware 8 is dewatered by rocking the main body of the washing apparatus in the direction D, in the same manner. Accordingly, the dewatering time can be reduced by widely blowing the air flow from the blowing means toward the tableware.

Moreover, it does not take the trouble to put the tableware held by the hand of the user thoroughly to the jet stream liquid as well as air flow. Accordingly, this reduces the operation for moving the plate in the washing, and makes the washing apparatus easier to use.

The jet stream liquid and air flow can be more widely spouted, if the twenty first embodiment and the twenty second embodiment are combined.

In the twenty first~twenty third embodiments, the washing apparatus is able to wash a large object by rocking the jet forward and backward so that a large washing space is obtained, after the washing apparatus is adjusted to wash the tableware such as a glass as shown in the twentieth embodiment.

Embodiment 24.

Figure 31A:
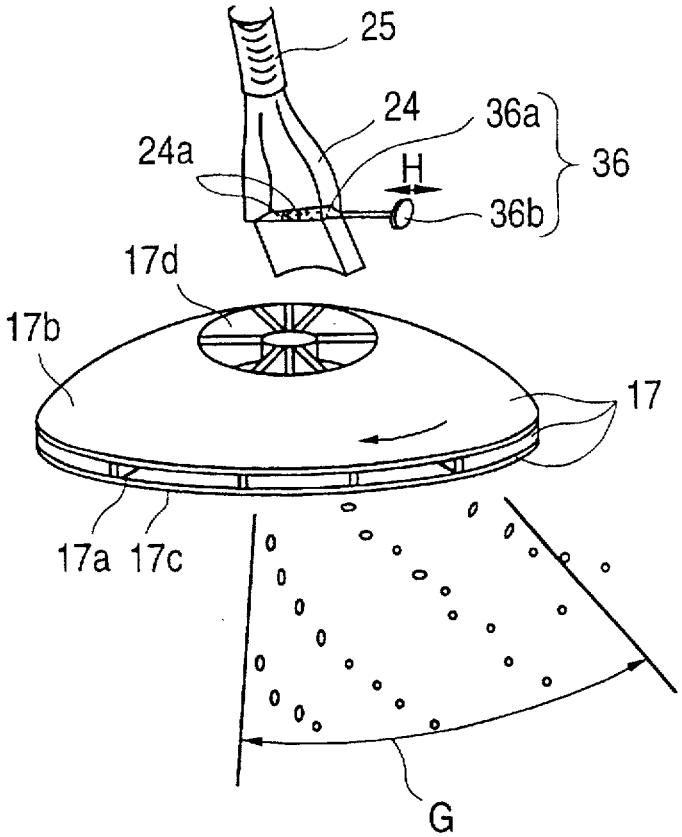
FIGS. 31A and 31B are a diagram for explaining the operation of the disk body according to a twenty fourth embodiment of the present invention.
Figure 31B:
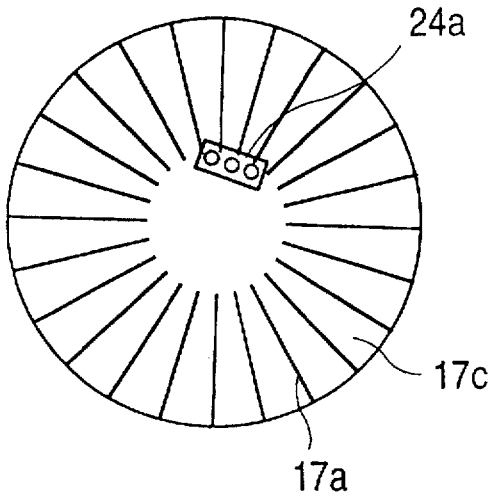

FIG. 31A shows an operation of the disk body used in the tableware washing apparatus according to a twenty fourth embodiment of the present invention. In this embodiment, the discharge aperture 24*a* on the fresh water supplying portion 24 comprises a plurality of holes or a slit-shaped hole. A adjusting means 36 is arranged for adjusting the number of the radial shape flow paths from which washing liquid is supplied. The adjusting means 36 comprises a board member 36*a* for blocking the discharge aperture 24*a*, and a stick member 36*b* for moving the board member 36*a* in the direction of the arrow H. The spacial relationship between the plurality of radial shape flow paths and the discharge aperture 24*a* is shown in FIG. 31B. As shown in FIG. 31B, the discharge aperture 24*a* is arranged over a plurality of the radial shape flow paths.

The operation of the washing apparatus is explained below. If the stick member 36*b* is pushed toward the disk body 17, the board member 36*a* covers a portion of the discharge aperture 24*a*, and the number of the radial shape flow paths from which washing liquid is supplied is decreased. On the other hand, if the stick member 36*b* is pulled from the disk body 17, the board member 36*a* releases a portion of the discharge aperture 24*a*, and the number of the radial shape flow paths from which washing liquid is supplied is increased. In other words, fresh water supplying portion is changed by the adjusting means 36, and the range from which fresh water is discharged varies within the angle G.

The adjusting means 36 adjusts the number of the radial shape flow paths supplying washing liquid. For tableware which has a depth like a glass, a jet stream liquid is spouted in the form of a sector with a narrow angle so that the bottom of the glass is washed easily. For tableware which is shallow in depth but has a wide area like a plate, a jet stream liquid is spouted in the form of a sector with a broad angle so that the wide area is washed easily.

Embodiment 25.

Figure 32:
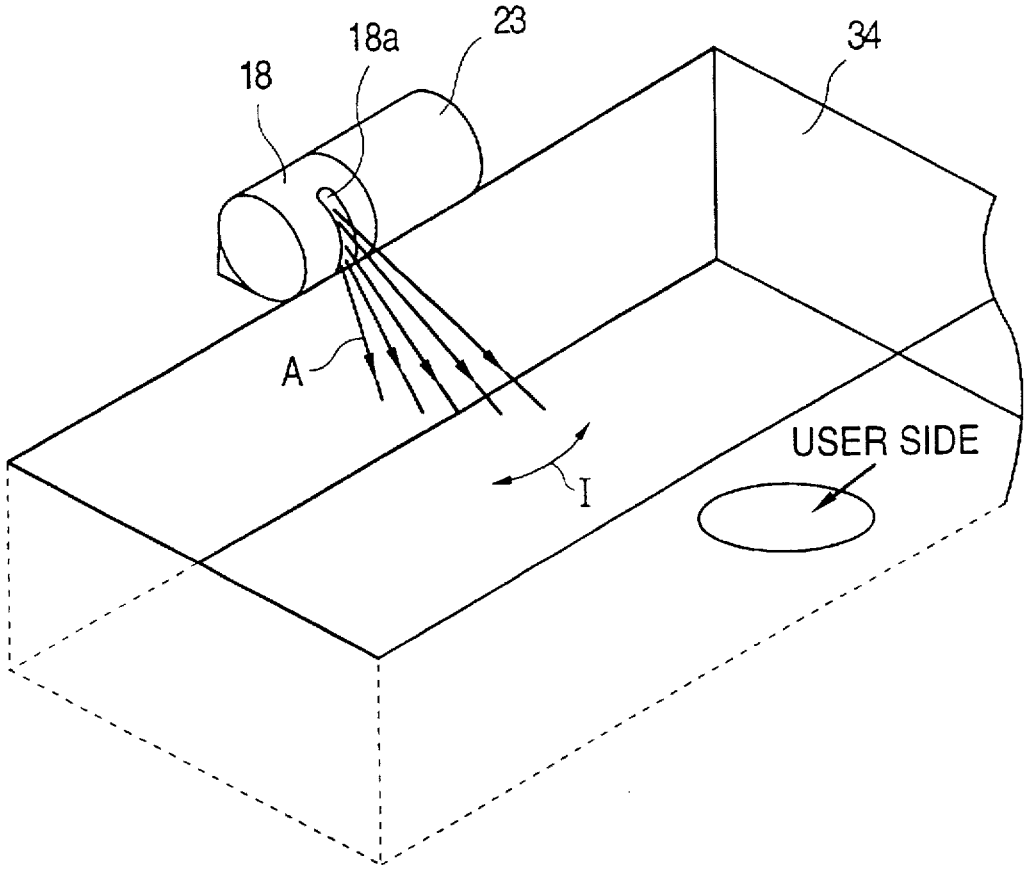
FIG. 32 is a perspective view showing the spacial relationship of a tableware washing apparatus and a kitchen sink according to a twenty fifth embodiment of the present invention.
Figure 33:
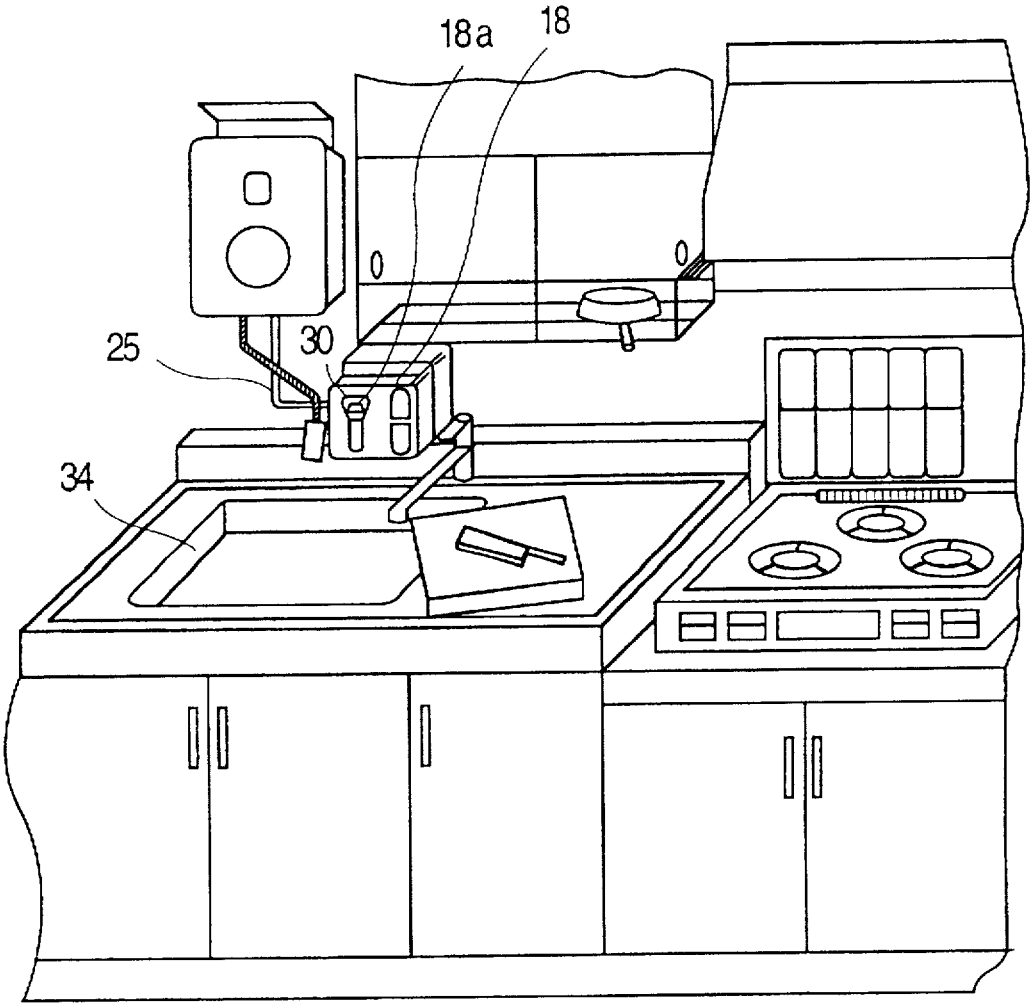
FIG. 33 is a perspective view showing a tableware washing apparatus placed in a kitchen according to the twenty fifth embodiment of the present invention.
Figure 34:
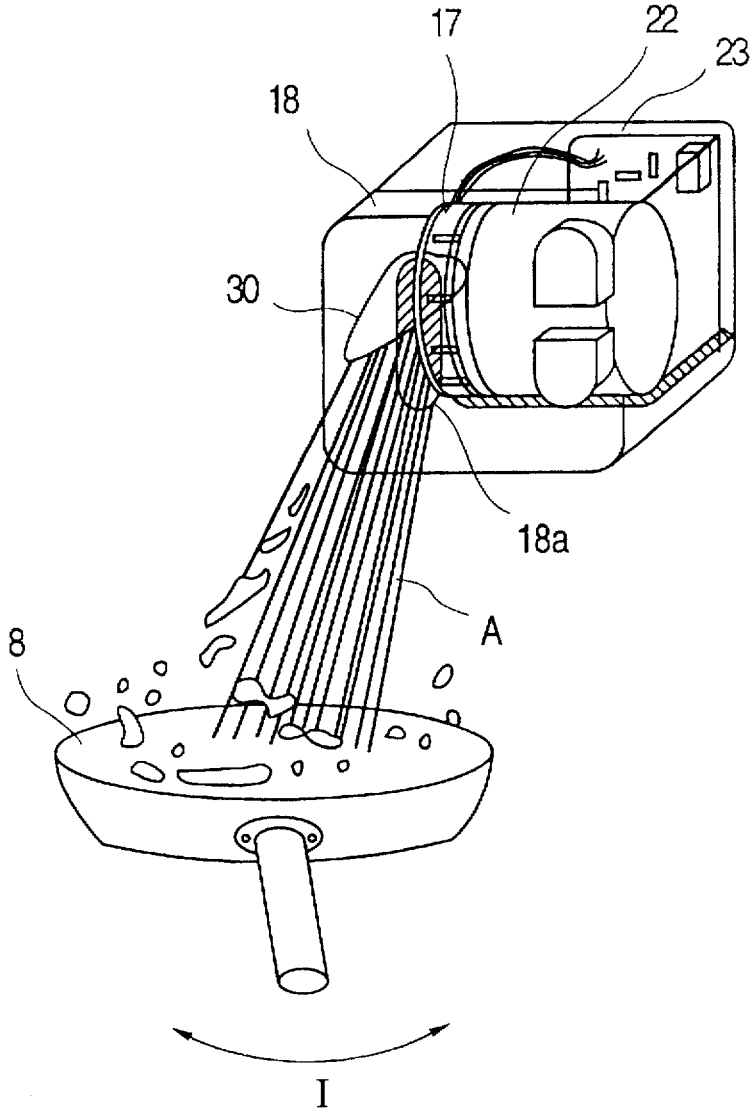
FIG. 34 is a diagram showing how the tableware washing apparatus is used according to the twenty fifth embodiment of the present invention.

FIG. 32 is a perspective view showing a spacial relationship of a tableware washing apparatus and a kitchen sink according to a twenty fifth embodiment of the present invention. FIG. 33 is a perspective view showing a tableware washing apparatus placed in a kitchen. FIG. 34 shows how the tableware washing apparatus is used. As shown in FIG. 32 and FIG. 33, the main body of the washing apparatus is placed in a vacant space around the kitchen sink 34. The aperture 18*a* is of slit-shaped. A high-jet stream liquid A is spouted out obliquely downward in front of the user. The main body is placed so that the supplying area makes a sector extending vertically.

As shown in FIG. 34, the user holds the piece of tableware 8 by hand to place its surface which is going to be washed against the aperture 18*a* in the washing space in front of the aperture 18*a* of the first cover 18. By moving the piece of tableware 8 in the direction I, namely left and right, the whole surface of the piece of tableware 8 is cleaned.

If the tableware washing apparatus is placed in a vacant space around the kitchen sink 34, and the high-speed jet liquid for washing is used, it enables the user to wash down completely the dirt stuck to the tableware in a short time without using any detergent and with a little of water.

Since the supplying area extends vertically in the form of a sector, most of the jet mist generated in the washing space when the high-speed jet liquid A strikes the piece of tableware 8 scatters in the vertical direction against the sector-shaped surface. In other words, this direction corresponds to the horizontal direction of the user, and the jet mist does not scatter much toward the user.

Embodiment 26.

Figure 35:
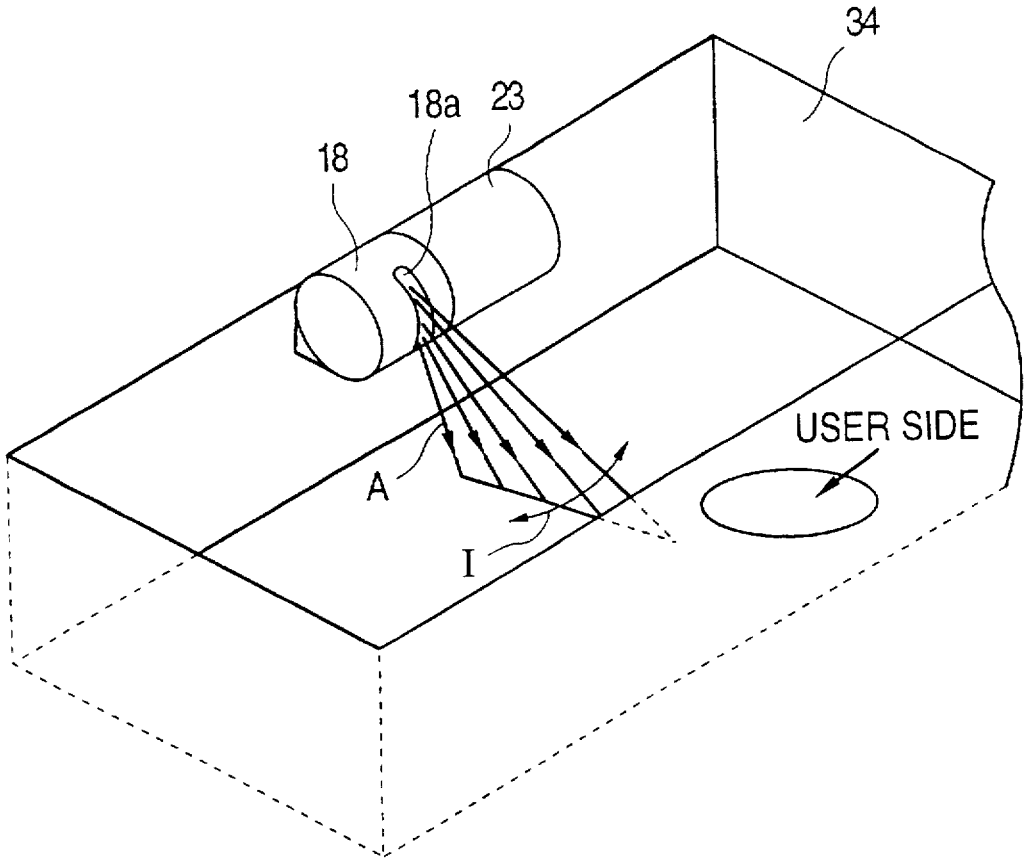
FIG. 35 is a perspective view showing the spacial relationship of a tableware washing apparatus and a kitchen sink according to a twenty sixth embodiment of the present invention.

FIG. 35 is a perspective view showing the spacial relationship of a tableware washing apparatus and a kitchen sink according to a twenty sixth embodiment of the present invention. In this embodiment, the main body of the tableware washing apparatus is placed inside the kitchen sink 34 on the opposite side of the user. The aperture 18*a* of this embodiment is of slit-shaped. The main body of the tableware washing apparatus is placed so that a jet stream liquid extends from the front to the rear portion of the sink in front of the user.

In the same manner as the twenty fifth embodiment, the user holds the piece of tableware 8 by hand to place the surface which is going to be washed against the aperture 18*a* in the washing space in front of the aperture 18*a* of the first cover 18. By moving the piece of tableware 8 in the direction I, namely left and right, the whole surface of the piece of tableware 8 is cleaned.

According to this embodiment, the tableware washing apparatus can be used even if there is no large vacant space around the kitchen sink 34, in addition to the same effect as the twenty fifth embodiment. If the washing apparatus is placed inside the kitchen sink 34, and high-speed jet liquid is used for washing, it enables the user to wash down completely the dirt stuck to the tableware in a short time without using any detergent and with a little of water.

Embodiment 27.

Figure 36:
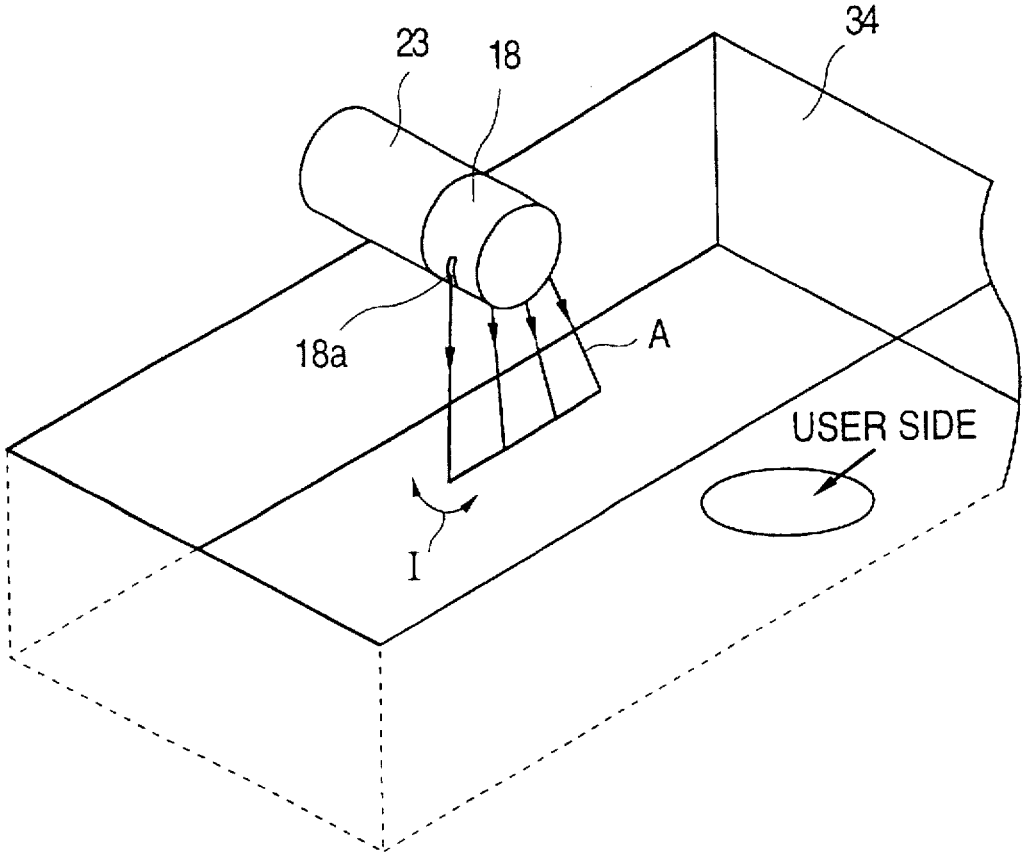
FIG. 36 is a perspective view showing the spacial relationship of a tableware washing apparatus and a kitchen sink according to a twenty seventh embodiment of the present invention.
Figure 37:
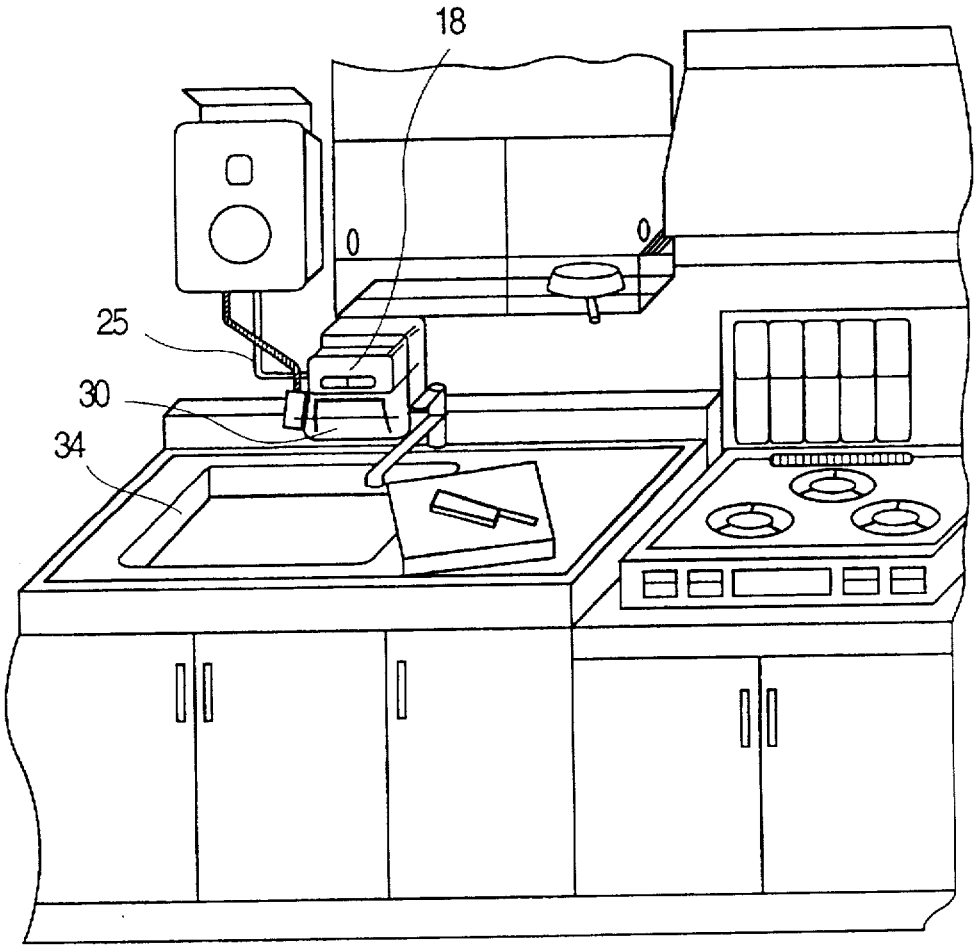
FIG. 37 is a perspective view showing a tableware washing apparatus placed in a kitchen according to a twenty seventh embodiment of the present invention.
Figure 38:
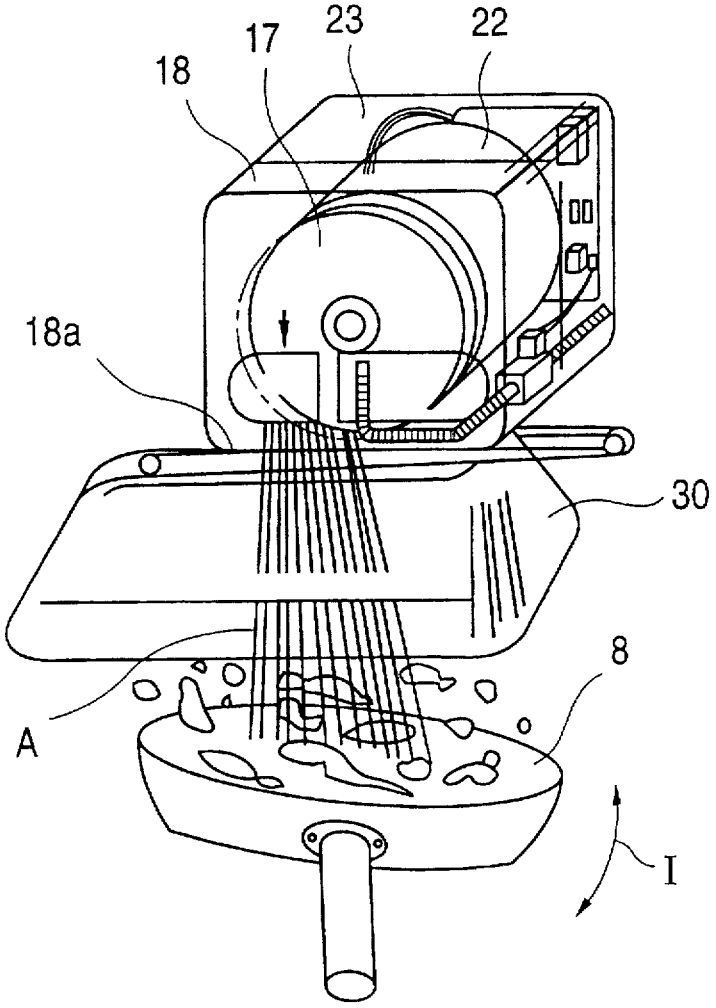
FIG. 38 is a diagram showing how the tableware washing apparatus is used according to the twenty seventh embodiment of the present invention.

FIG. 36 is a perspective view showing the spacial relationship of a tableware washing apparatus and a kitchen sink according to a twenty seventh embodiment of the present invention. FIG. 37 is a perspective view showing a tableware washing apparatus placed in a kitchen. FIG. 38 shows how the tableware washing apparatus is used. As shown in FIG. 36 and FIG. 37, the main body of the washing apparatus is placed in a vacant space around the kitchen sink 34 on the side facing the user. The aperture 18*a* is of slit-shaped. A high-jet stream liquid A is spouted out downward in front of the user. The main body is placed so that the supplying area makes a sector extending horizontally.

As shown in FIG. 38, the user holds the piece of tableware 8 by hand to place its surface which is going to be washed against the aperture 18*a* in the washing space in front of the aperture 18*a* of the first cover 18. By moving the piece of tableware 8 in the direction I, namely forward and backward, the whole surface of the piece of tableware 8 is cleaned.

If the tableware washing apparatus is placed in a vacant space around the kitchen sink 34, and high-speed jet liquid for washing is used, it enables the user to wash down completely the dirt stuck to the tableware in a short time without using any detergent and with a little amount of water.

Since the supplying area extends horizontally in the form of a sector, most of the jet mist generated in the washing space when the high-speed jet liquid A strikes the piece of tableware 8 scatters in the vertical direction against the sector-shaped surface. In other words, this direction corresponds to the vertical direction of the user, and the jet mist may be scattered toward the user. Accordingly, a cover 30 is provided as a jet mist scatter protection means.

Embodiment 28.

Figure 39:
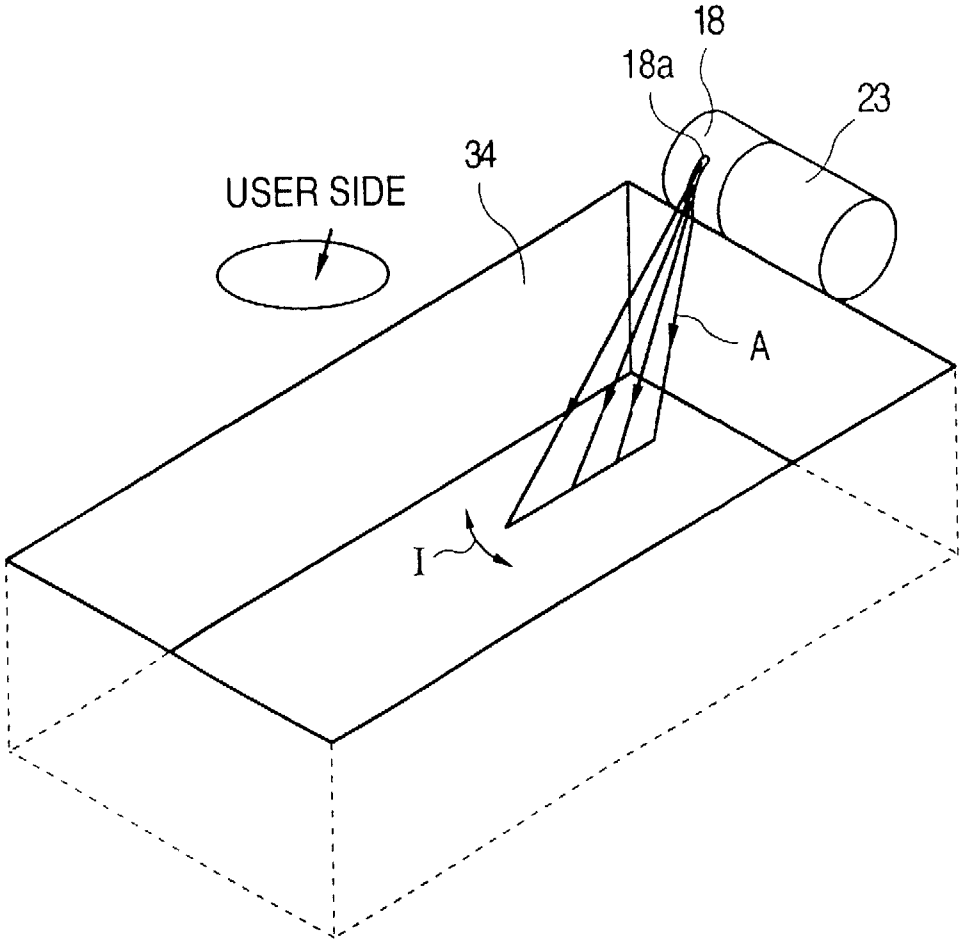
FIG. 39 is a perspective view showing the spacial relationship of a tableware washing apparatus and a kitchen sink according to a twenty eighth embodiment of the present invention.
Figure 40:
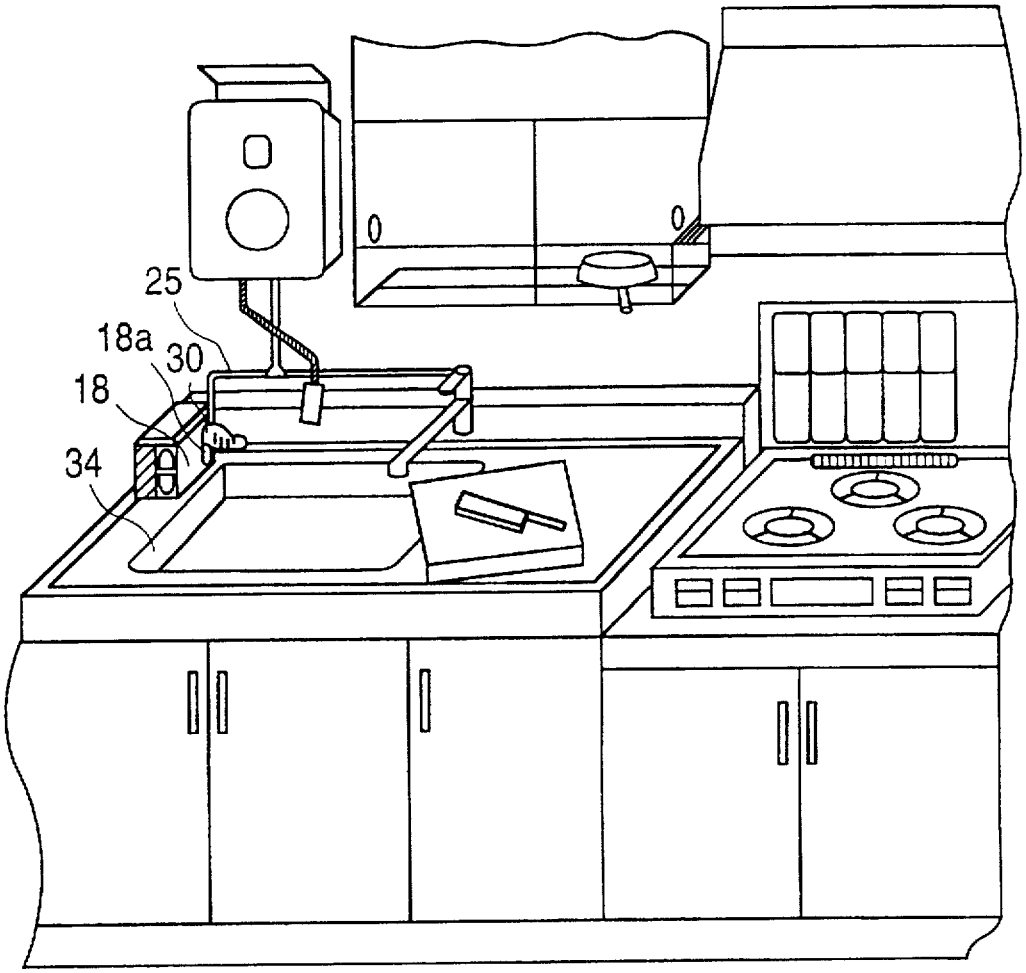
FIG. 40 is a perspective view showing a tableware washing apparatus placed in a kitchen according to the twenty eighth embodiment of the present invention.
Figure 41:
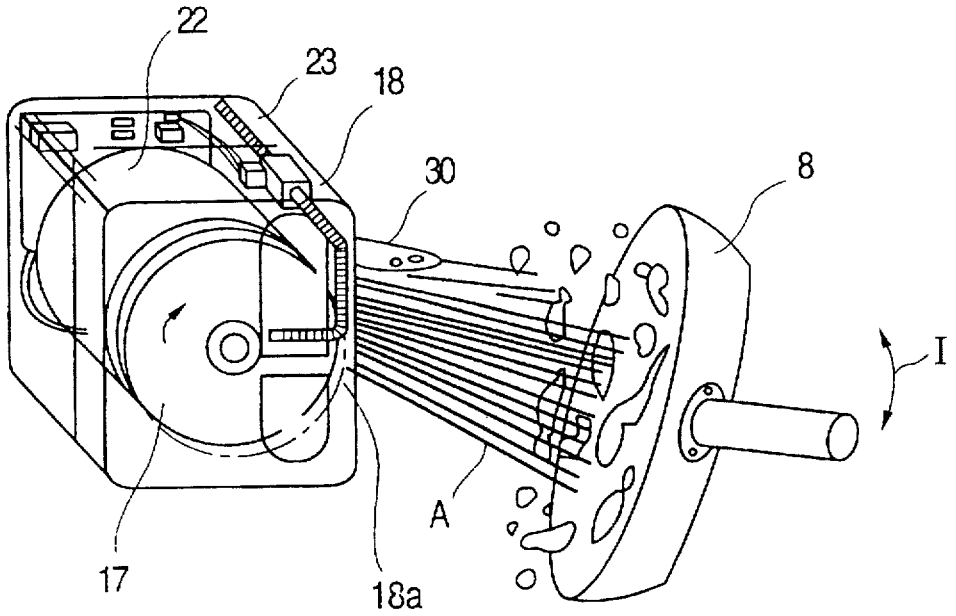
FIG. 41 is a diagram showing how the tableware washing apparatus is used according to the twenty eighth embodiment of the present invention.

FIG. 39 is a perspective view showing the spacial relationship of a tableware washing apparatus and a kitchen sink according to a twenty eighth embodiment of the present invention. FIG. 40 is a perspective view showing a tableware washing apparatus placed in a kitchen. FIG. 41 shows how the tableware washing apparatus is used. As shown in FIG. 39 and FIG. 40, the main body of the washing apparatus is placed in a vacant space around the kitchen sink 34 obliquely in front of the user. The aperture 18*a* is of slit-shaped. High-speed jet liquid A is spouted out downward in front of the user. The main body is placed so that the supplying area makes a sector extending horizontally.

As shown in FIG. 41, the user holds the piece of tableware 8 by hand to place its surface which is going to be washed against the aperture 18*a* in the washing space in front of the aperture 18*a* of the first cover 18. By moving the piece of tableware 8 in the direction I, namely forward and backward, the whole surface of the piece of tableware 8 is cleaned.

If the tableware washing apparatus is placed in a vacant space around the kitchen sink 34 and the high-speed jet liquid for washing is used, it enables the user to wash down completely the dirt stuck to the tableware in a short time without using any detergent with a little of water.

Since the supplying area extends horizontally in the form of a sector, most of the jet mist generated in the washing space when the high-speed jet liquid A strikes the piece of tableware 8 scatters in the vertical direction against the sector-shaped surface. In other words, this direction corresponds to the vertical direction of the user, and the jet mist may be scattered toward the user. However most of the jet mist is blocked by the surface of the tableware facing toward it for washing. In this embodiment, it is assumed that most of the user are right-handed and the user uses the washing apparatus by holding the tableware by the right hand. Accordingly, the user can handle the tableware without trouble, and controls it easily so that the surface is facing toward the jet stream flow.

Embodiment 29.

Figure 42:
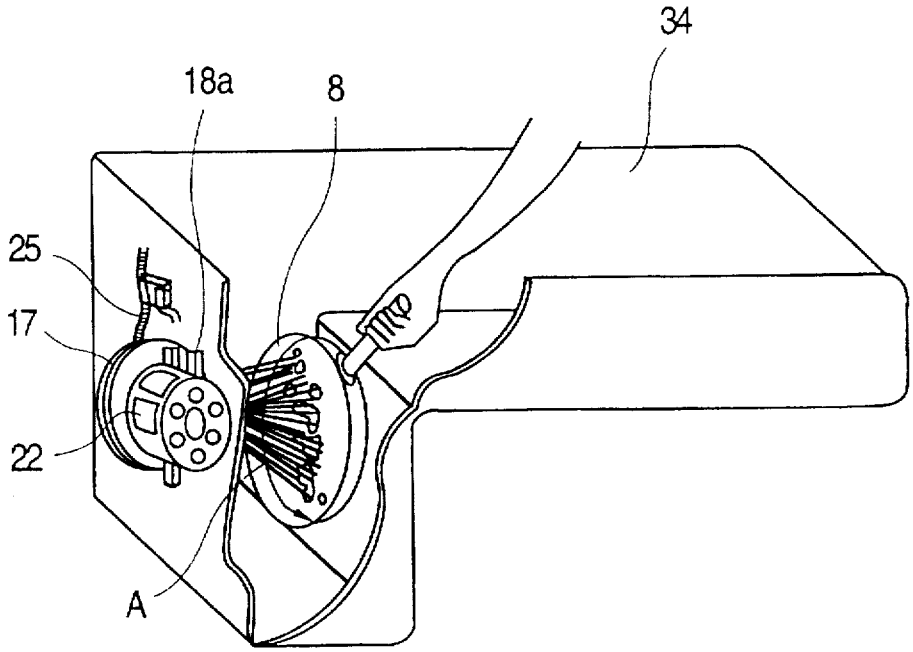
FIG. 42 is a diagram showing how the tableware washing apparatus is used according to a twenty ninth embodiment of the present invention.

FIG. 42 shows how the tableware washing apparatus is used according to a twenty ninth embodiment of the present invention. In FIG. 42, the cover of the main body of the tableware washing apparatus is taken off. The main body of the washing apparatus is placed in an outside space around the kitchen sink 34 obliquely in front of the user. The kitchen sink 34 needs a portion which is deep enough to create the washing space. In this embodiment, the corresponding portion of the kitchen sink 34 where the tableware washing apparatus is placed is made deeper than the other portion of the sink 34.

The aperture 18*a* is of slit-shaped, and provided on the side wall of the kitchen sink 34. The main body is placed so that the supplying area makes a sector extending vertically.

As shown in FIG. 42, the user holds the piece of tableware 8 by hand to place its surface which is going to be washed against the aperture 18*a* in the washing space in front of the aperture 18*a* of the first cover 18. By moving the piece of tableware 8 forward and backward, the whole surface of the piece of tableware 8 is cleaned.

If the tableware washing apparatus is placed on the side wall of the kitchen sink 34 and the high-speed jet liquid for washing is used, it enables the user to wash down completely the dirt stuck to the tableware in a short time without using any detergent and with a little of water.

Since the step-shaped wall made inside the kitchen sink 34 receives the highspeed jet liquid, it is possible to prevent the jet mist from scattering widely to the surroundings. This construction of the washing apparatus can be implemented in the component kitchen compactly. The depth of the kitchen sink 34 may be equally deepened for all sink.

Embodiment 30.

Figure 43:
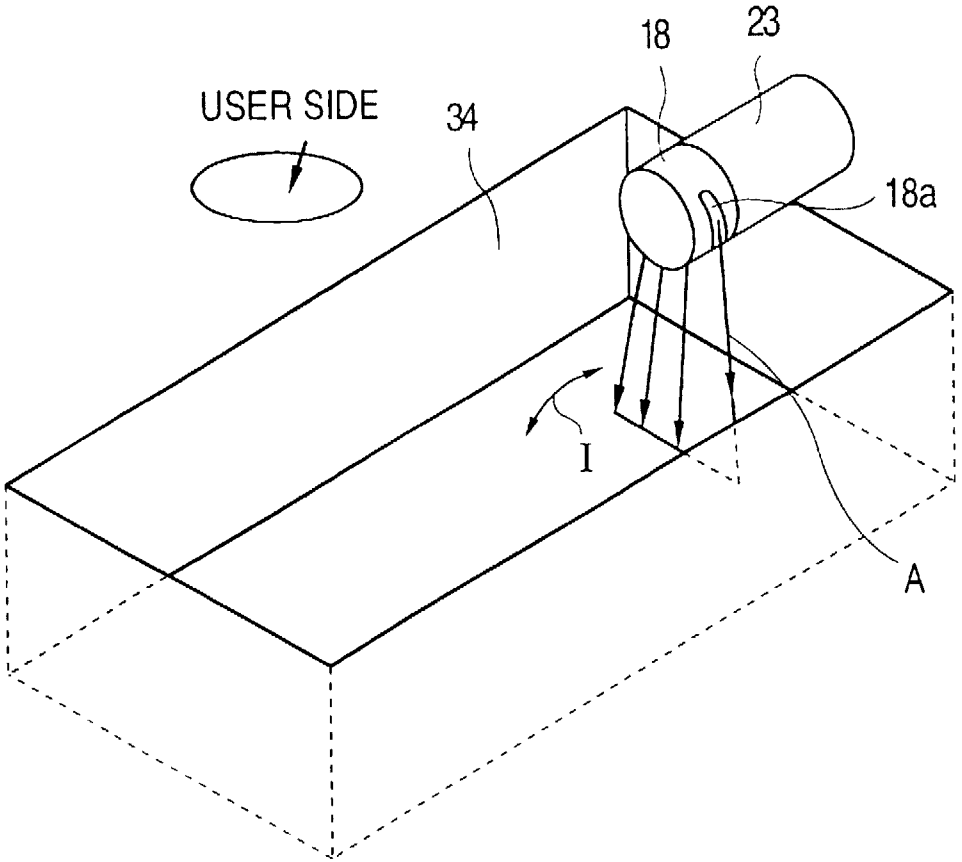
FIG. 43 is a perspective view showing the spacial relationship of a tableware washing apparatus and a kitchen sink according to the thirtieth embodiment of the present invention.

FIG. 43 is a perspective view showing the spacial relationship of a tableware washing apparatus and a kitchen sink according to a thirtieth embodiment of the present invention. The main body of the washing apparatus is placed in a vacant space around the kitchen sink 34 obliquely in front of the user. The aperture 18*a* is of slit-shaped. High-speed jet liquid A is spouted out downward in front of the user. The main body is placed so that the supplying area makes a sector extending forward and backward.

As shown in FIG. 43, the user holds the piece of tableware 8 by hand to place its surface which is going to be washed against the aperture 18*a* in the washing space in front of the aperture 18*a* of the first cover 18. By moving the piece of tableware 8 in the direction I, namely left and right, the whole surface of the piece of tableware 8 is cleaned.

If the tableware washing apparatus is placed in a vacant space around the kitchen sink 34 and the high-speed jet liquid for washing is used, it enables the user to wash down completely the dirt stuck to the tableware in a short time without using any detergent and with a little of water.

Since the supplying area extends vertically in the form of a sector, a certain amount of the jet mist can be prevented from scattering toward the user. Furthermore, it is assumed that most of the user are right-handed and the user holds the tableware by the right hand while washing. Accordingly, the user can handle the tableware without trouble, and controls it easily so that the surface is facing toward the jet stream flow.

Embodiment 31.

Figure 44:
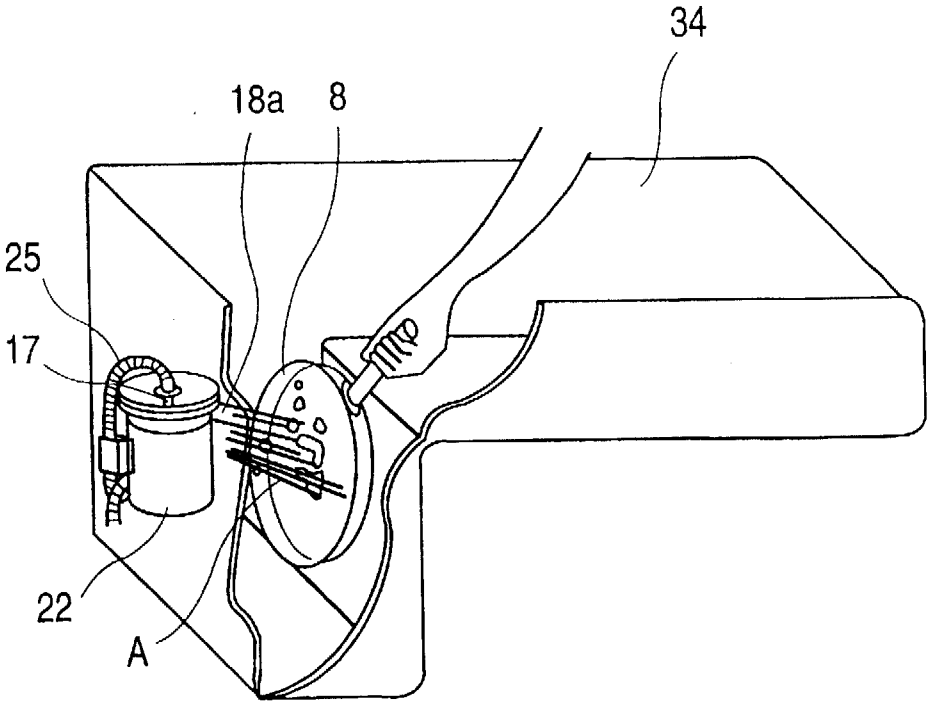
FIG. 44 is a diagram showing how the tableware washing apparatus is used according to the thirty first embodiment of the present invention.

FIG. 44 shows how the tableware washing apparatus is used according to a thirty first embodiment of the present invention. In FIG. 44, the cover of the main body of the tableware washing apparatus is taken off. The main body of the washing apparatus is placed in an outside space around the kitchen sink 34 obliquely in front of the user. The kitchen sink 34 needs a portion which is deep enough to create the washing space. In this embodiment, the corresponding portion of the kitchen sink 34 where the tableware washing apparatus is placed is made deeper than the other portion of the sink 34.

The aperture 18*a* is of slit-shaped, and provided on the side wall of the kitchen sink 34. The main body is placed so that a high-speed washing liquid A is spouted out downward in front of the user and the supplying area makes a sector extending forward and backward.

As shown in FIG. 44, the user holds the piece of tableware 8 by hand to place its surface which is going to be washed against the aperture 18*a* in the washing space in front of the aperture 18*a* of the first cover 18. By moving the piece of tableware 8 up and down, the whole surface of the piece of tableware 8 is cleaned.

If the tableware washing apparatus is placed on the side wall of the kitchen sink 34 and the high-speed jet liquid for washing is used, it enables the user to wash down completely the dirt stuck to the tableware in a short time without using any detergent and with a little of water.

The step-shaped wall made inside the kitchen sink 34 receives the high-speed jet liquid and prevents the jet mist from scattering widely to the surroundings.

Such structure is compactly embedded in a component kitchen. The depth of the kitchen sink 34 may be equally deepened for all sink.

The twenty fifth~thirty first embodiments refer to washing tableware. In case these embodiments include drying function, since air flow is exhausted obliquely downward from the aperture 18*a* in front of the user, as mentioned above, the tableware can be dried conveniently and rapidly.

The twenty fifth~thirty first embodiments also refer to examples in which tableware washing apparatus is placed in many different places. But, the washing apparatus may be placed any places other than the places referred in these embodiments. Since the tableware washing apparatus is constructed compactly, it enables the user to place it anywhere the user wants to place.

Embodiment 32.

Figure 45:
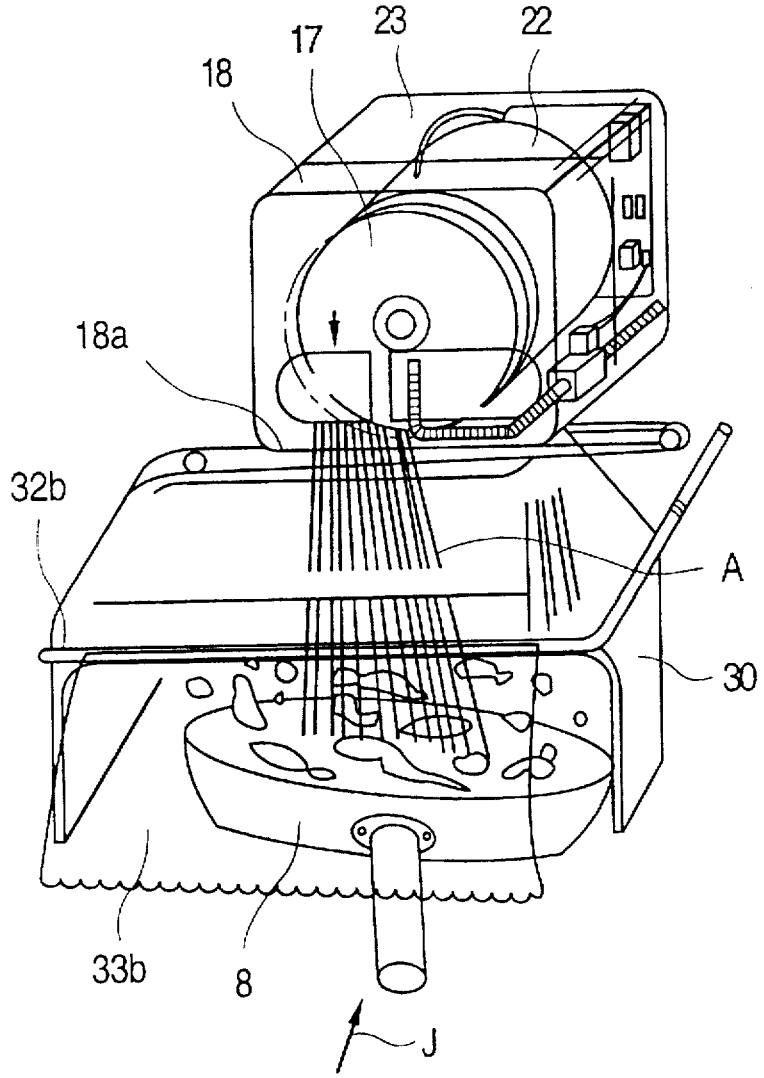
FIG. 45 is a diagram showing how the tableware washing apparatus is used according to the thirty second embodiment of the present invention.

FIG. 45 shows how the tableware washing apparatus is used according to a thirty second embodiment of the present invention. In FIG. 45, the cover of the main body of the tableware washing apparatus is transparent to see the inside. In this embodiment, a solid cover 30 and a liquid cover 33*b* are provided as a jet mist scattering protection means. The washing space extended from the aperture 18*a* of the first cover to the tableware is covered by these two kinds of covers.

For example, the user stands in the foreground in the figure. The user holds a piece of tableware 8 in the direction J, and puts the tableware in and out of the washing space. The liquid cover 33b is a jet mist scattering protection means covering this portion where the user put the tableware in and out. The other side portions are covered by a solid cover 30 made of plastics. The liquid cover 33b is formed by a fluid tube which is connected to water service, and supplies water from a water supplying means 32b, having a slit where the liquid cover 33b is formed.

In case of using the washing apparatus, the user puts a piece of tableware 8 in the direction J from the entrance portion. Water is supplied from the water supplying means 32b to form a liquid cover 33b. The water supplying means 32b requires 2~3 litters of water per minute. A high-speed jet stream spouting means is driven to spout out a highspeed jet stream A from the aperture 18a. The high-speed jet stream spouting means requires 5~6 litters of water per minute. The user holds the piece of tableware 8 by hand to place the surface which is going to be washed against the aperture 18a so that the surface is washed by the high-speed jet stream A. By moving the piece of tableware 8 forward and backward, the whole surface of the piece of tableware 8 is cleaned.

The jet mist generated and scattered when the high-speed jet liquid A strikes the piece of tableware 8 is received by the solid cover 30, and the liquid cover 33b provided as a jet mist scattering protection means. The mist is drifted downward with the water flow of the water wall, or along the surface of the solid wall. Accordingly, it prevents the jet mist containing dirt from scattering around the washing space, and enables the user to do the washing hygienically, without any unpleasant feeling given by the dirty water damping the user as well as the surroundings of the washing apparatus.

Since the liquid cover 33b in front of the user is a water wall, even if this liquid cover 33b is formed when a piece of tableware 8 is put in and out of the washing space, it is possible to put in and out the tableware smoothly. Therefore, the user is not troubled with undesired operations when putting the tableware in and out. The tableware washing apparatus can be maintained hygienically if the solid cover 30 is attached removable to the main body of the washing apparatus so that the cover is washable whenever it gets dirty.

In case this tableware washing apparatus may include drying function, air flow is spouted after water supply is stopped from the water supplying means 32b so that the liquid cover 33b is not formed.

If the tableware washing apparatus is placed on the side wall of the kitchen sink 34, and the high-speed jet liquid for washing is used, it enables the user to wash down completely the dirt stuck to the tableware in a short time without using any detergent and with a little of water.

Embodiment 33.

Figure 46:
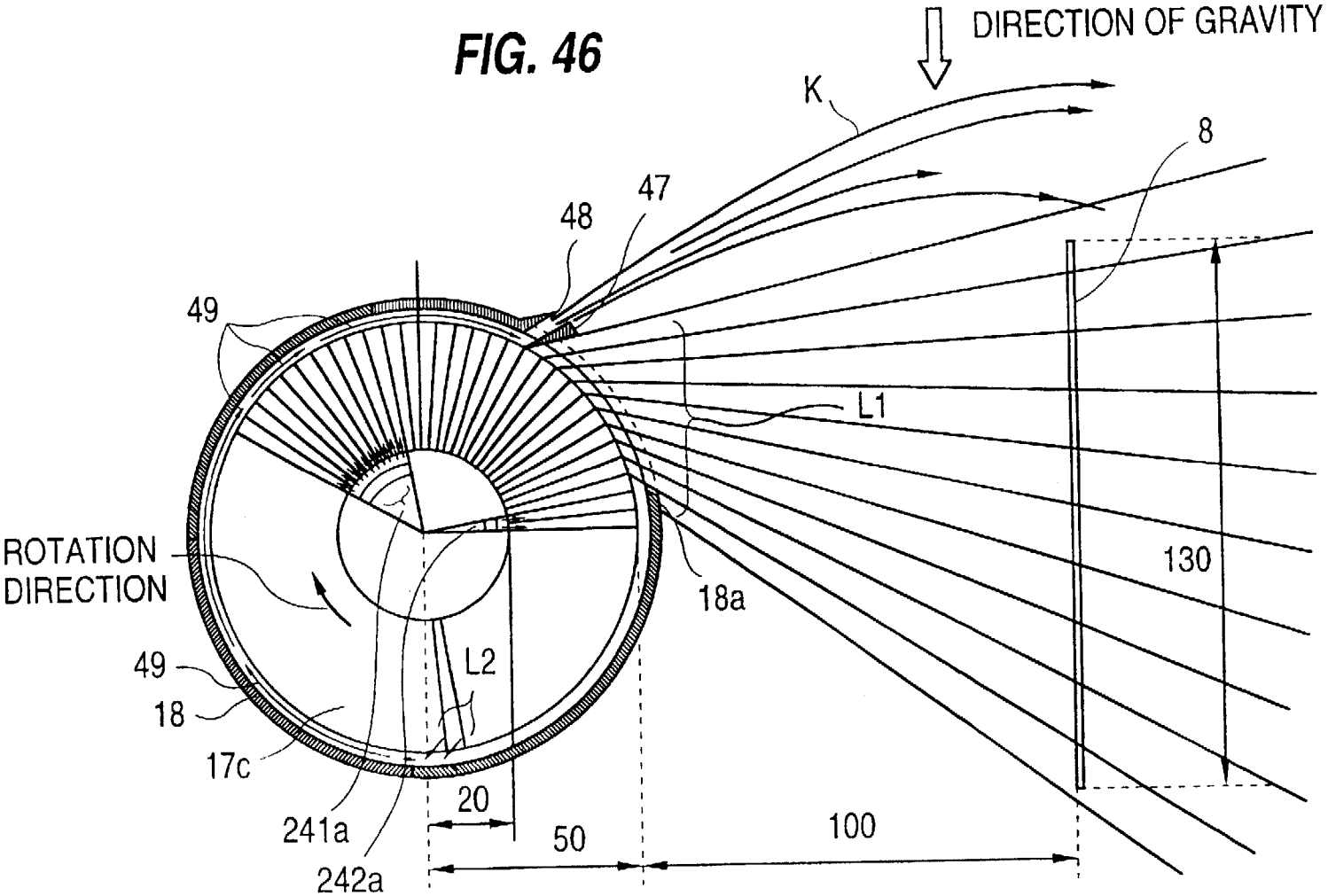
FIG. 46 is a diagram for explaining the operation of the disk body used in the tableware washing apparatus according to the thirty third embodiment of the present invention.

FIG. 46 shows an operation of the disk body used in the tableware washing apparatus according to a thirty third embodiment of the present invention. The direction of gravity is shown by an arrow in FIG. 46. FIG. 46 shows the disk body 17 looked at vertically toward the disk surface, with the radially arranged blades 17a and the bottom disk 17c. In FIG. 46, the same reference numbers as those in the first embodiment show the same or corresponding portions as those in the first embodiment, and detailed explanation on these portions is omitted.

The diameter of the disk body 17 is 100 mm and the blades 17a are provided from 20 mm off the center of the disk along with the direction of the radius. Although, the blades 17a are provided all over the circumference of the bottom disk 17c, only a portion of them is shown in FIG. 46.

A branching means 47 is provided for branching a high-speed jet stream flow. It is a partition plate, for example, placed to constitute a branch flow path from which jet spouts out smoothly to the washing space. An aperture 48 is placed before the aperture 18a in the direction of the rotation, and constitutes a flow path from which the liquid separately supplied by the branching means 47 is spouted out. The washing liquid 49 is flowing along the circumferential wall of the disk body 17.

The discharge apertures of the fresh water supplying portion 241a, 242a constitute portions from which fresh water is spouted to the two radial shape flow paths. Water is supplied from the discharge aperture 241a arranged at the location which is in the opposite rotating direction from the aperture 18a along a predetermined angle. Highspeed jet liquid is spouted out from the aperture 18a as mentioned in the first embodiment. In this embodiment, the predetermined angle is around 90 degrees, and 5~6 litters of water is spouted per minute.

On the other hand, water is supplied from the discharge aperture 242a to the radial shape flow paths which are placed near the rear portion of the aperture 18a. In this case, about one litter of water is supplied per minute.

When the direction of the rotation is clockwise, the fresh water supplied from the discharge aperture 241a is accelerated after the flow path walls, namely the blades 17a, are rotating and come to contact with the fresh water. The fresh water rotates approximately 90 degrees along with the flow path walls, i.e. the blades 17a, and spouts out from the aperture 18a of the first cover 18, namely from the portion L1 as shown in FIG. 46. The jet stream liquid spouted out from the portion L1 is a high-speed jet stream used for cleaning tableware 8.

On the other hand, the fresh water supplied from the discharge aperture 242a is accelerated after the flow path walls, namely the blades 17a, are rotating and come to contact with fresh water. The fresh water rotates approximately 90 degrees along with the flow path walls, i.e. the blades 17a, and spouts out from the portion L2 shown in FIG. 46 toward the inside wall of the first cover 18. The jet stream liquid spouted out from the portion L2 flows along the inside wall of the first cover 18 in the direction of the arrow 49 in FIG. 46, and loses its speed to a certain degree. The jet stream liquid is spouted out from the aperture 48 which is branched from the aperture 18a along the branching means 47. Since the jet stream liquid is small in amount, and loses its speed because it strikes the inside wall of the first cover 18, it gives a low-speed jet stream liquid K which is spouted out from the aperture 48 placed just before the portion 18a for spouting out the high-speed jet liquid A in the rotating direction. If the tableware washing apparatus is placed in the direction of the gravity shown in this figure, the lowspeed jet stream liquid K is spouted out so that it covers the high-speed jet liquid A.

As described above, a large quantity of high-speed jet liquid A and a little amount of low-speed jet stream liquid K are spouted out simultaneously from the aperture 18a, 48 of the first cover 18, respectively. At this time, the jet mist generated and scattered when the high-speed jet liquid A strikes the tableware is caught by the water wall made of the low-speed jet stream liquid K, and drifted downward with the water flow. Accordingly, it prevents the jet mist containing dirt from scattering around the washing space, and enables the user to do the washing hygienically without any unpleasant feeling, since the user as well as the surroundings of the washing apparatus can be prevented from the dirty water.

The tableware washing apparatus may be constructed without a partition plate 47 so that both the high-speed jet liquid A and the low-speed jet stream liquid K are mixed and the mixed jet stream liquid having a velocity distribution is spouted out from the aperture 18*a*. In this case, by changing the location of the piece of tableware 8, a jet stream liquid having an appropriate spouting speed can be available for washing according to the degree of dirt stuck on the piece of tableware 8.

Even if the discharge aperture 242*a* is not provided, if the partition plate 47 is placed before the aperture 18*a* in the direction of the rotation, the fresh water supplied from the discharge aperture 241*a* and failing to spout out from the aperture 18*a* flows along the inside wall of the first cover 18 in the direction of the arrow 49, and spouts out from the aperture 48. This jet stream liquid may be used for other purposes.

Embodiment 34.

Figure 47:
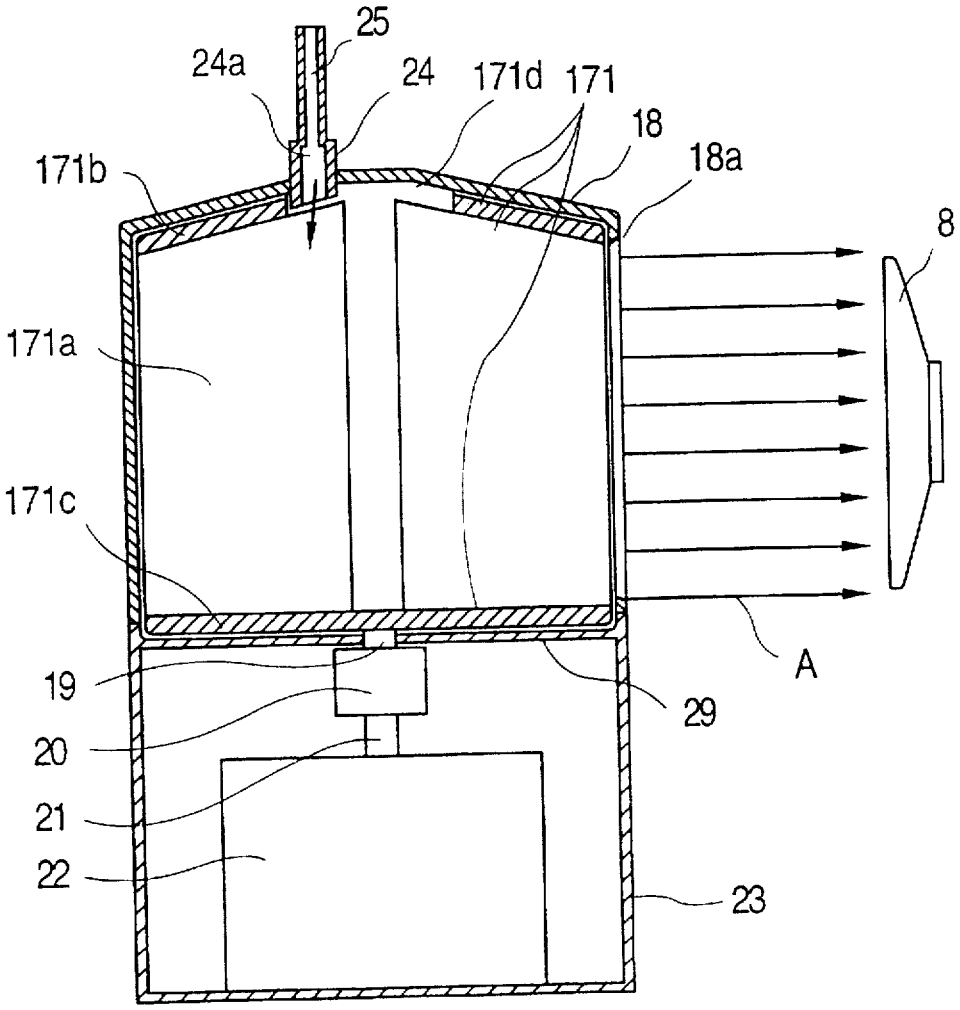
FIG. 47 is a cross sectional view showing a tableware washing apparatus as a washing apparatus according to the thirty fourth embodiment of the present invention.

FIG. 47 is a cross sectional view showing a tableware washing apparatus as a washing apparatus according to a thirty fourth embodiment of the present invention. In FIG. 47, the same reference numbers as those in the first embodiment show the same or corresponding portions as those in the first embodiment. In FIG. 47, a rotating object 171 is a rotating cylinder, for example. In this embodiment, a plurality of radial shape flow paths are consisted of a plurality of blades 171*a* and the two disks 171*b*, 171*c* catching the blades 171*a* between them. An aperture 171*d* is provided on the upper side on the disks 171*b* for receiving fresh water. A cover 18 covers the rotating cylinder 171. An aperture 18*a* is provided on a portion of the circumference of the first cover 18 which the spouted fresh water passes through. A washing space is created in front of the aperture 18*a* of the cover 18.

A cylinder rotation axis 19 is coupled to the cylinder 171. The rotation force generated by the motor 22 is transmitted to the cylinder rotation axis 19 via the motor rotation axis 21 and the coupling 20 to rotate the cylinder 171. The lower cover 23 covers the coupling 20, the rotation axis 21 and the motor 22.

Washing liquid, namely, for example, fresh water is supplied from the fresh water supplying portion 24 to the aperture 171*d*. In this case, the fresh water supplying portion 24 is arranged near the aperture 171*d* of the cylinder 171 to prevent an undesired air from mixing when fresh water is supplied to the aperture 171*d* of the cylinder. The fresh water supplying portion 24 has a discharge aperture 24*a* for supplying fresh water.

The rotating object is a cylinder of about 15 cm in height. On the other hand, the disk body 17 in the first embodiment is less than 1 cm in height.

The operation of the tableware washing apparatus constructed in this manner is explained below. A switch of the motor 22 (not illustrated) is turned on to drive the motor 22. This operation is done before and after placing a piece of tableware 8 in the washing space. When the motor 22 is driven, the cylinder 171 starts rotating. Fresh water is supplied from water supply 16, via the water path 25 to the fresh water supplying portion 24, and supplied from the discharge aperture 24*a* to the aperture 171*d* in the central of the disk 171*b*. Receiving a rotation force of the radial shape flow paths consisted of the blades 171*a*, the discs 171*b*, 171*c*, the fresh water is accelerated in the direction of the rotating circumference as well as the rotating radius of the cylinder 171. Fresh water is spouted from the aperture 18*a* of the first cover 18 toward the washing space created in front of the aperture 18*a*.

The high-speed jet liquid spouted toward the washing space in front of the aperture 18*a* strikes the piece of tableware 8. The dirt struck the piece of tableware 8 is washed down by the impact given by the high-speed jet liquid and the drifting force by the falling water, and in this manner the piece of tableware 8 is cleaned.

Compared with the first embodiment, width of spouting high-speed jet liquid can be made larger in this embodiment. On this account, the jet stream liquid is extending on the piece of tableware 8 widely, and the dirt stuck to the piece of tableware 8 is washed down by the impact of the hygienic jet stream liquid, and drifted downwards by the water flow. Accordingly, a washing operation is completed in a short time.

The height of the rotating object 171 may be varied in any height other than that of the example in this embodiment in accordance with the washing object. A desired width for supplying the high-speed jet liquid is obtained by appropriately setting the height of the rotating object. Accordingly, the use of the washing apparatus is not limited to washing tableware. The user can use the washing apparatus for washing any objects which may be larger, or more fragile than tableware.

Embodiment 35.

Figure 48:
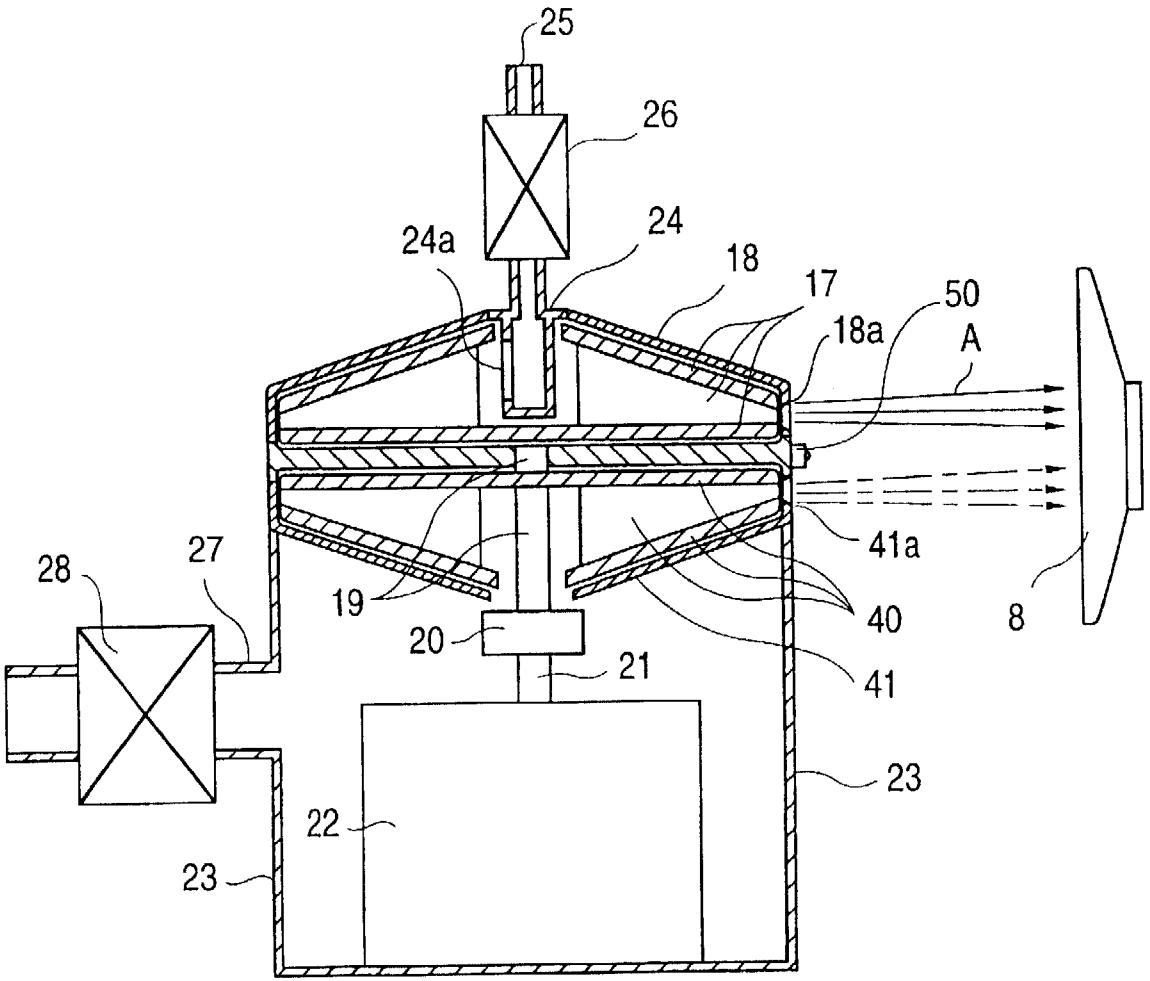
FIG. 48 is a cross sectional view showing a tableware washing apparatus according to the thirty fifth embodiment of the present invention.
Figure 49:
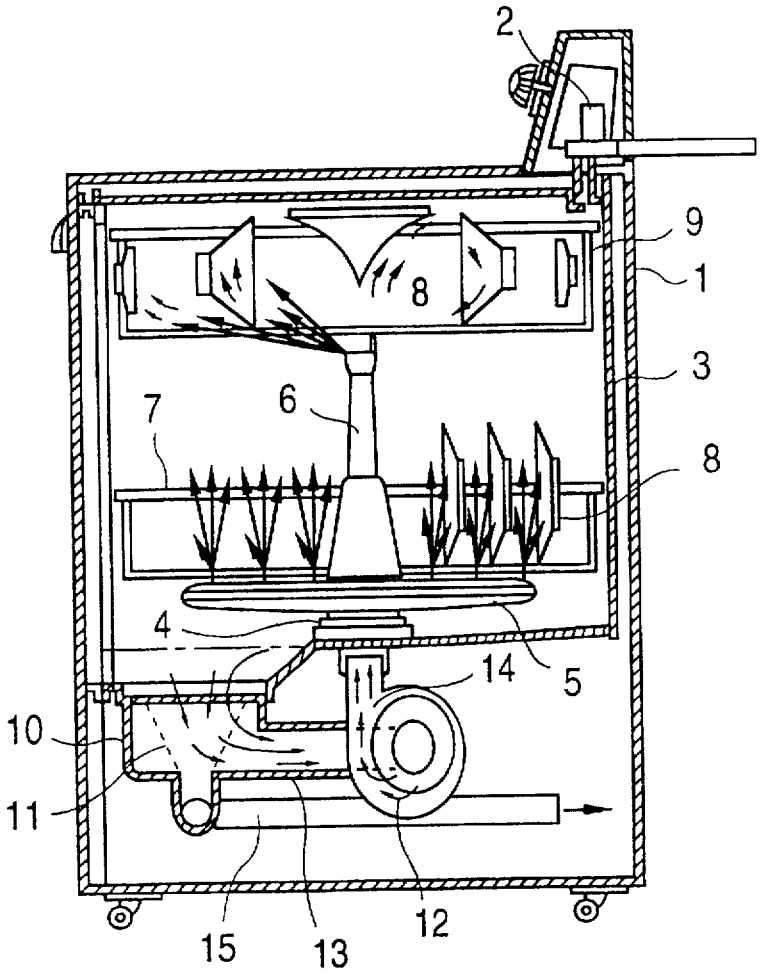
FIG. 49 (PRIOR ART)
FIG. 49 is a cross sectional view showing a conventional washing apparatus.

FIG. 48 is a cross sectional view showing a tableware washing apparatus according to a thirty fifth embodiment of the present invention. This tableware washing apparatus includes drying function, which comprises a blowing means for generating air flow with a velocity and a quantity enough to blow off drops of water stuck to a piece of tableware 8, and spouts it to the piece of tableware. In concrete, the blower blades 40 is arranged in parallel with the disk body 17, namely a high-speed jet stream spouting means. The disk body 17 and the blower blades 40 are coupled to the motor 22 by a single rotation axis 19. The tableware washing apparatus of the present embodiment comprises a second cover 41 which comprises an aperture 41*a* for spouting the air flow from the blowing means, and a pneumatic path 27 which comprises an air quantity variable valve 28 for sending or shutting out the air to the blowing means. This pneumatic path 27 has an end portion exposed to the atmosphere. A water quantity variable valve 26 can shut out the suction of fresh water. A detecting means 50 detects a piece of tableware 8 placed in the washing space.

The tableware washing apparatus comprised as mentioned above detects a piece of a piece of tableware 8 by means of the detecting means 50 when the user places the piece of tableware 8 in the washing space in front of the aperture 18*a* of the first cover 18. The detecting means 50 sends a first detecting signal to a control portion (not illustrated) as a washing start detecting signal. The control portion of the washing apparatus receives the first detecting signal transmitted from the detecting means 50, it drives the motor 22, and opens the water quantity variable valve 26, which has been shutting out the suction of fresh water at the same time. A photoelectric sensor or an ultra audible sound sensor is used as the detecting means, for example.

High-speed jet liquid from the aperture 18*a* of the first cover 18 toward the washing space strikes the piece of tableware 8. The dirt stuck to the piece of tableware 8 is washed down by the impact given by the high-speed jet liquid and the drifting force by the falling water, and in this manner the piece of tableware 8 is cleaned. At this time, the water quantity variable valve 26 is opened for supplying fresh water, while the air quantity variable valve 28 is closed to shut the suction of air to the blower blades 40. When a piece of tableware 8 is washed completely by jet stream liquid, the user takes the piece of tableware 8 out from the washing space for a moment. Since the detecting signal from the detecting means 50 is stopped at this time, the control portion then recognizes the completion of washing. The control portion controls to stop supplying fresh water by closing the water quantity variable valve 26 when it recognizes the interception of the detecting signal transmitted from the detecting means 50. Concurrently with this operation, the air quantity variable valve 28 is opened to supply air toward the blower blades 40 from the pneumatic path 27 exposed to the atmosphere. The supplied air is spouted from the aperture 41*a* of the second cover 41 toward the washing space in front of the aperture 18*a*.

At this time, the user returns the piece of tableware 8 to the washing space once again. The air is spouted toward the washing space strikes the piece of tableware 8, and drifts drops of water stuck to the piece of tableware 8 along its surface to the edge. The spouted pneumatic power on the edge of the piece of tableware 8 overwhelms the surface tension of water. On this account, drops of water is scattered, and a piece of tableware 8 is dewatered. Some drops of water may be scattered when just struck by jet air. At this time, the detecting means 50 detects a piece of tableware 8 which is placed in the washing space, and sends a second detecting signal to the control portion of the washing apparatus (not illustrated). When dewatering is completed, the user takes the piece of tableware 8 out from the washing space. Recognizing the interception of the second detecting signal transmitted from the detecting means 50, the control portion closes the air quantity variable valve 28 and stops driving the motor 22.

In this embodiment, the detecting means 50 enables the washing apparatus to conduct smoothly a series of operations from washing to dewatering. It is possible to control automatically the series of the operations by setting a time for washing as well as for blowing. However, it does not work well when the degree of dirt stuck on each piece of tableware 8 is different. On the other hand, if a washing apparatus lets the user judge the completion of the washing, washing operation is conducted effectively. Accordingly, the washing apparatus in this embodiment is easy and convenient to use because it enables the user to wash and clean each piece of tableware 8 in accordance with its degree of dirt.

In this embodiment, both the start and the end of the washing are detected by means of a signal outputted from the detecting means 50. A separate sensor may be arranged for detecting each of the start and the end of the washing.

In this embodiment, the start of washing is notified by the transmission of the first detecting signal and the completion of washing is notified by the interception of the first detecting signal. It may be of course replaced by any other ways.

A washing apparatus which does not install a blowing means may be comprised to drive and stop a high-speed jet stream spouting means in accordance with the start and the completion of washing, which is able to wash each piece of tableware 8 in accordance with its degree of dirt.

The embodiments mentioned so far refer to a tableware washing apparatus. But, the use of the washing apparatus of the present invention is not limited to washing tableware, it can be used for washing clothes, a human body, animals and so on. If the washing apparatus is installed in a bath tub, for example, the high-speed jet liquid renders a massaging effect.

It is even possible to choose a house or a car as a washing object. With regard to a small washing object, electronic parts and electronic materials can be washed by this washing apparatus.

What is claimed is:

1. A washing apparatus, comprising:

a high-speed jet stream spouting device for spouting washing liquid in the form of high-speed jet liquid toward a washing object, said high-speed let stream spouting device having a rotating object rotated by a motor to generate the high-speed jet liquid;

a first cover having at least an aperture through which said high-speed jet liquid passes, and covering said high-speed jet stream spouting device;

blowing means for spouting gas toward said object;

a second cover having an aperture through which said gas passes, and covering said blowing means; and washing liquid supplying means for supplying said washing liquid to said high-speed jet stream spouting device.

2. The washing apparatus of claim 1, further comprising:

jet mist scattering protection means for shutting out scatter of jet mist generated when high-speed jet liquid is spouted to a washing object.

3. The washing apparatus of claim 2, wherein, said jet mist scattering protection means covers a washing space extending from an aperture of said first cover to a washing object.

4. The washing apparatus of claim 3, wherein, said jet mist scattering protection means includes a fluid portion covering a washing space extending from an aperture of said first cover to the washing object.

5. The washing apparatus of claim 3, wherein, said jet mist scattering protection means covering a washing space extending from an aperture of said first cover to said washing object includes a fluid portion where the washing object is put in and out to and from said washing space therethrough, and a solid material for the rest of portion.

6. The washing apparatus of claim 2, further comprising:

dirt protection means for protecting a surface of a jet mist scattering protection means, which faces a washing space, from dirt.

7. The washing apparatus of claim 1, further comprising:

washing start detecting means for outputting a washing start detecting signal for notifying a start of washing by detecting a washing object placed in a washing space;

washing completion detecting means for outputting a washing completion detecting signal for notifying a completion of washing by detecting washing operation is completed; and high-speed jet stream supplying control means for driving a high-speed jet stream spouting device by receiving said washing start detecting signal and stopping driving a high-speed jet stream spouting device by receiving said washing completion detecting signal.

8. The washing apparatus of claim 1, wherein, said main body of washing apparatus is placed in a place facing a user, and said aperture of said first cover is placed so that high-speed jet liquid is spouted downward in front of the user.

9. The washing apparatus of claim 1, wherein, said main body of washing apparatus is placed obliquely in front of said user, and said aperture of said first cover is placed so that high-speed jet liquid is spouted downward in front of a user.

10. The washing apparatus of claim 1, further comprising:

jet stream rocking means for changing the area where fluid spouted from the aperture strikes a washing object.

11. The washing apparatus of claim 1, further comprising:

detergent mixing means for mixing detergent to the washing liquid.

12. The washing apparatus of claim 1, further comprising:

washing liquid heating means for heating washing liquid which is spouted to the washing object.

13. The washing apparatus of claim 1, further comprising:

gas heating means for heating gas which is spouted to the washing object.

14. The washing apparatus of claim 1, wherein, said aperture is arranged all over the circumference of the rotating object.

15. A washing apparatus, comprising:

a high-speed jet stream spouting device including a rotating object having a plurality of radial shaped flow paths extending from a center portion to a circumference of said rotating object, and a liquid supplying portion for supplying washing liquid to a central portion of said radial shaped flow paths, for supplying washing liquid in the form of high-speed jet liquid toward a washing object;

a first cover having at least an aperture through which said high-speed jet liquid passes, and cover said high-speed jet stream spouting device;

a motor which rotates said rotating object to generate the high-speed jet liquid; and washing liquid supplying means for supplying said washing liquid to said high-speed jet stream spouting device.

16. The washing apparatus of claim 15, wherein, said washing liquid supplying portion supplies washing liquid to a portion of said radial shape flow paths, said supplied washing liquid is accelerated in said portion of said radial shape flow paths by rotation, and said accelerated washing liquid is spouted from an aperture in the form of high-speed jet liquid toward a desired washing space.

17. The washing apparatus of claim 15, wherein, said radial shape flow path is inclined forward in the direction of rotation from its central portion to its circumferential portion.

18. The washing apparatus of claim 15, wherein, said radial shape flow paths has a larger cross section standing vertically against the flow path in its central portion than in its circumferential portion.

19. The washing apparatus of claim 15, wherein, said washing liquid supplying portion includes adjusting means for adjusting the quantity of washing liquid supplied to said radial shape flow paths.

20. The washing apparatus of claim 15, further comprising:

a supplementary plate provided under said rotating means for receiving washing liquid which fails to be spouted from an aperture of said first cover.

21. The washing apparatus of claim 15, further comprising:

branching means arranged at the front portion of said aperture of said first cover in the direction of rotation.

22. The washing apparatus of claim 15, further comprising:

a second liquid supplying portion for supplying a liquid to a portion of said radial shape flow paths in a central portion of said radial shape flow paths.

23. The washing apparatus of claim 15, wherein, said high-speed jet stream spouting device includes a plurality of rotating objects arranged in parallel in the rotating axis direction, a plurality of liquid supplying portions for supplying washing liquid supplied from said washing liquid supplying means to said radial shape flow paths of said each rotating objects, and rotating means for rotating said each rotating objects.

24. The washing apparatus of claim 15, wherein, said high-speed jet stream spouting device includes a plurality of rotating objects -arranged in parallel in the radius direction of said rotating objects, a plurality of liquid supplying portions for supplying washing liquid supplied from said washing liquid supplying means to said radial shape flow paths of said each rotating objects, and rotating means for rotating said each rotating objects.

25. A washing apparatus, comprising:

a high-speed jet stream spouting device including a rotating object having a plurality of radial shaped flow paths extending from a center portion to a circumference of said rotating object, and a liquid supplying portion for supplying washing liquid to a central portion of said radial shaped flow paths, for supplying washing liquid in the form of high-speed jet liquid toward a washing object;

a first cover having at least an aperture though which said high-speed jet liquid passes, and covering said high-speed jet stream spouting device;

blowing means for spouting gas toward said washing object;

a second cover having an aperture through which said gas passes, and covering said blowing means;

a motor which rotates said rotating object to generate the high-speed jet liquid;

washing liquid supplying means for adjusting supplying said washing liquid to said high-speed jet stream spouting [means] device;

liquid quantity adjusting means for adjusting supplying quantity of said washing liquid; and gas quantity adjusting means for adjusting a quantity of said supplying gas.

26. The washing apparatus of claim 25, wherein, said high-speed jet stream spouting device includes a blowing means, said gas quantity adjusting means adjusts a quantity of gas and supplies said gas to high-speed jet stream spouting device after said washing liquid supplying means stops supplying washing liquid to said high-speed jet stream spouting device.

27. The washing apparatus of claim 25, wherein, said blowing means includes blower blades, each axis of said blower blades is coupled with a rotation axis of the high-speed jet stream spouting device; and said blower blades spouts gas to a washing object by rotation of said axis.

28. The washing apparatus of claim 25, wherein, said blowing means includes blower blades for blowing gas by rotation, and at least one of a rotation axis of said blower blades or a rotation axis of a rotating object is removable from a rotation axis of rotating means.

29. The washing apparatus of claim 25, wherein, high-speed jet stream spouting device is equipped at the first cover arranged on one side of a rotating object, blowing means having blower blades is equipped on the other side of said rotating object.

* * * * *